US010939222B2

(12) United States Patent
Lee et al.

(10) Patent No.: US 10,939,222 B2
(45) Date of Patent: Mar. 2, 2021

(54) THREE-DIMENSIONAL AUDIO PLAYING METHOD AND PLAYING APPARATUS

(71) Applicant: LG ELECTRONICS INC., Seoul (KR)

(72) Inventors: Tung Chin Lee, Seoul (KR); Sejin Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/636,188

(22) PCT Filed: Nov. 14, 2017

(86) PCT No.: PCT/KR2017/012881
§ 371 (c)(1),
(2) Date: Feb. 3, 2020

(87) PCT Pub. No.: WO2019/031652
PCT Pub. Date: Feb. 14, 2019

(65) Prior Publication Data

US 2020/0374646 A1 Nov. 26, 2020

Related U.S. Application Data

(60) Provisional application No. 62/543,385, filed on Aug. 10, 2017.

(51) Int. Cl.
*H04S 7/00* (2006.01)
*G10L 19/00* (2013.01)
(Continued)

(52) U.S. Cl.
CPC ..... *H04S 7/302* (2013.01); *G10L 19/008* (2013.01); *H04R 3/12* (2013.01); *H04S 2400/01* (2013.01);
(Continued)

(58) Field of Classification Search
CPC ... H04S 7/00; H04S 7/30; H04S 7/302; H04S 7/303; H07S 2400/01; H07S 2420/01;
(Continued)

(56) References Cited

U.S. PATENT DOCUMENTS 9,769,589 B2 * 9/2017 Umminger ..... H04S 7/304
2013/0272527 A1 * 10/2013 Oomen ..... H04S 3/004 381/17
(Continued)

FOREIGN PATENT DOCUMENTS

JP 2013243572 A 12/2013
KR 1020160136716 A 11/2016
KR 1020160145646 A 12/2016

OTHER PUBLICATIONS

Urgen Herre, et al., "MPEG-H 3D Audio—The New Standard for Coding of Immersive Spatial Audio", In: IEEE Journal of Selected Topics in Signal Processing, Aug. 2015, vol. 9, pp. 770-779.
(Continued)

*Primary Examiner* — Thang V Tran
(74) *Attorney, Agent, or Firm* — Dentons US LLP

(57) ABSTRACT

A three-dimensional audio playing method and playing apparatus are disclosed. The three-dimensional audio playing method according to the present invention comprises: a decoding step of decoding a received audio signal and outputting the decoded audio signal and metadata; a room impulse response (RIR) decoding step of decoding RIR data when the RIR data is included in the received audio signal; a head-related impulse response (HRIR) generation step of generating HRIR data by using user head information when the RIR data is included in the received audio signal; a binaural room impulse response (BRIR) synthesis step of generating BRIR data by synthesizing the decoded RIR data and modeled HRIR data; and a binaural rendering step of outputting a binaural rendered audio signal by applying the
(Continued)

generated BRIR data to the decoded audio signal. In addition, the three-dimensional audio playing method and playing apparatus, according to the present invention, support a 3DoF environment and a 6DoF environment. Moreover, the three-dimensional audio playing method and playing apparatus according to the present invention provide parameterized BRIR or RIR data. The three-dimensional audio playing method according to an embodiment of the present invention enables a more stereophonic and realistic three-dimensional audio signal to be provided.

18 Claims, 37 Drawing Sheets

(51) Int. Cl.
*H04R 3/00* (2006.01)
*G10L 19/008* (2013.01)
*H04R 3/12* (2006.01)

(52) U.S. Cl.
CPC ..... *H04S 2420/01* (2013.01); *H04S 2420/03* (2013.01)

(58) Field of Classification Search
CPC ... H07S 2420/03; G10L 19/00; G10L 19/008; H04R 3/00; H04R 3/12; H04R 29/00; H04R 5/00; H04R 5/02
See application file for complete search history.

(56) References Cited

U.S. PATENT DOCUMENTS

2016/0198281 A1* 7/2016 Oh ..... H03H 21/0012 381/310
2016/0323688 A1* 11/2016 Lee ..... H04S 7/307
2017/0019746 A1* 1/2017 Oh ..... G10L 19/20
2017/0188175 A1* 6/2017 Oh ..... H04S 7/306
2018/0077514 A1* 3/2018 Lee ..... H04S 7/304
2018/0091918 A1* 3/2018 Lee ..... H04S 7/303

OTHER PUBLICATIONS

H. Moon, et al, "MPEG-H 3D Audio Decoder Structure and Complexity Analysis", The Journal of Korean Institute of Communications and Information Sciences, Feb. 2017, vol. 42 No. 02, pp. 432-443.

* cited by examiner

FIG. 10
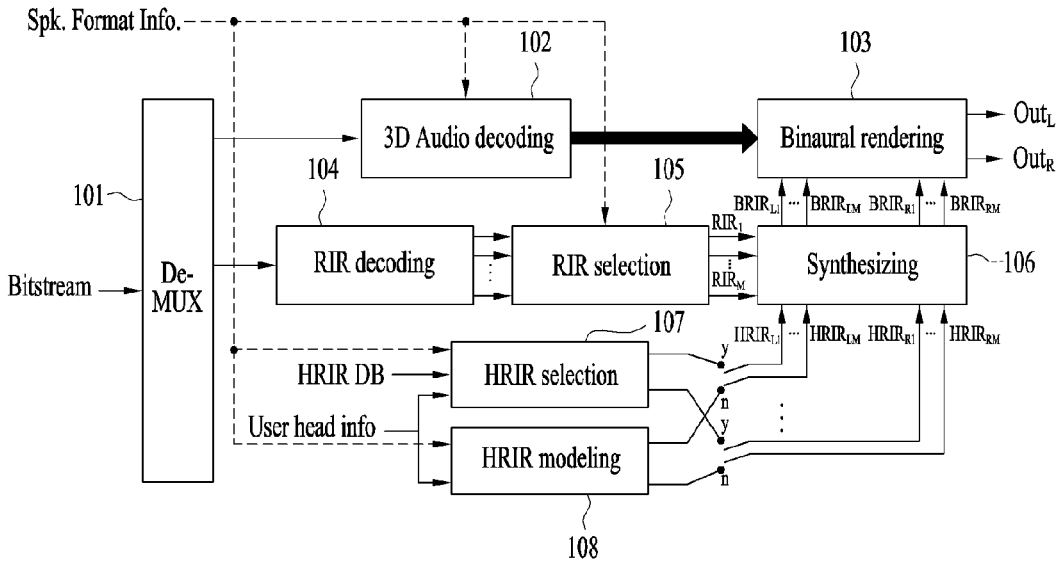
(a)
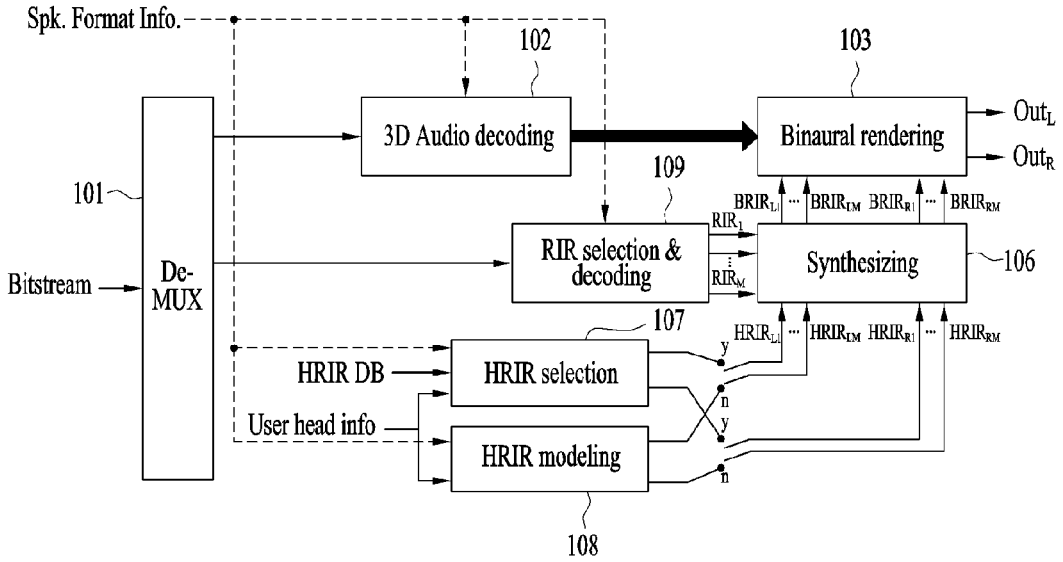
(b)

FIG. 12
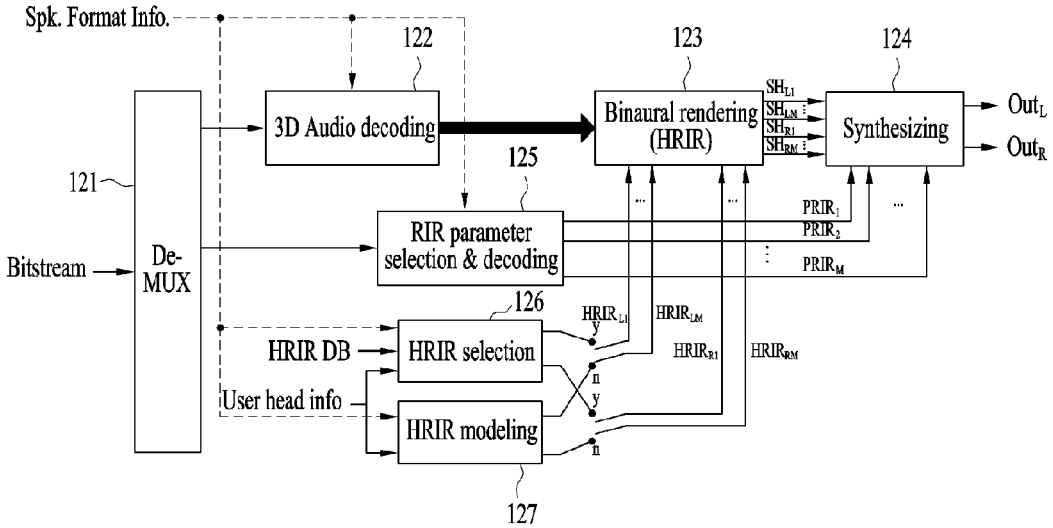
(a)
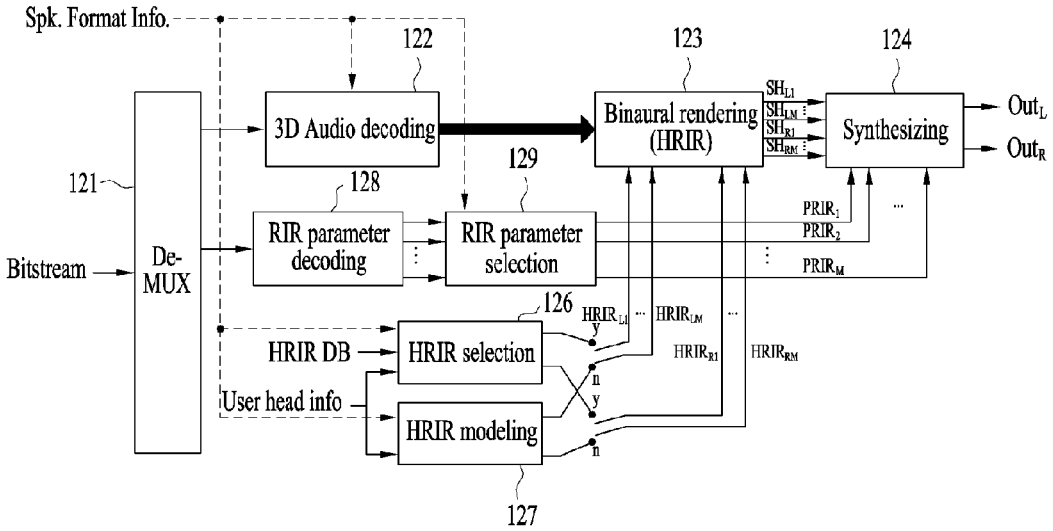
(b)

FIG. 14
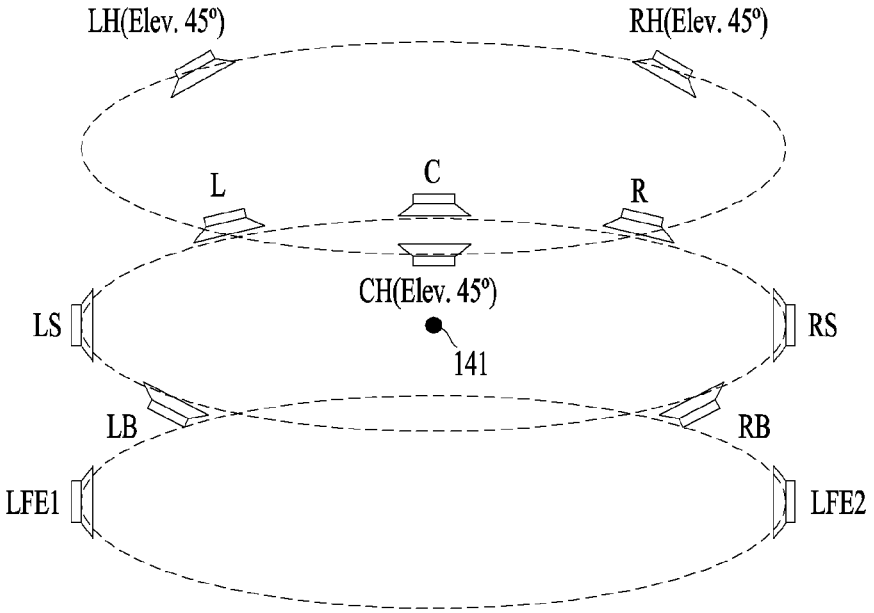
(a)
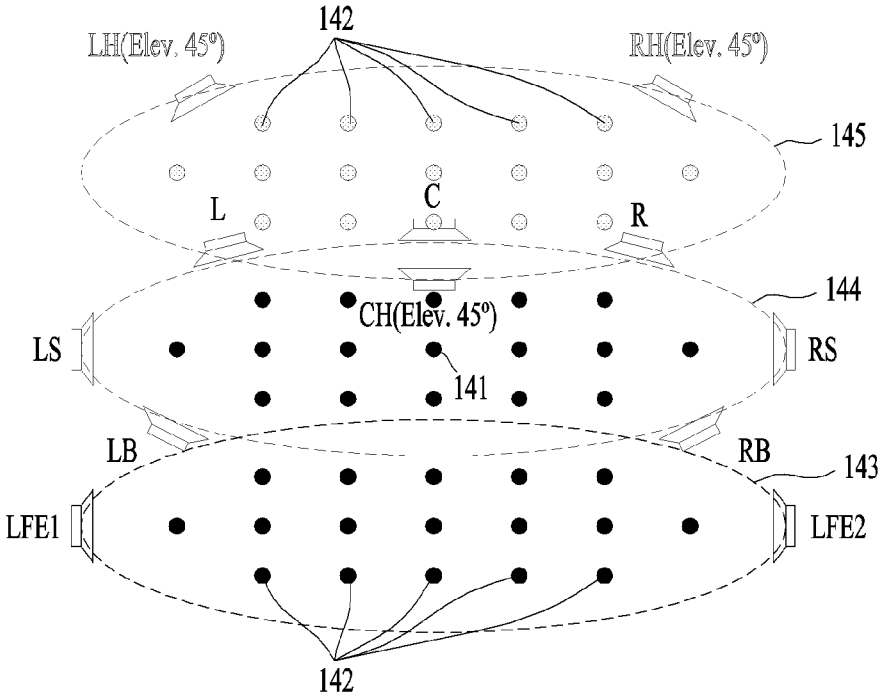
(b)

FIG. 16
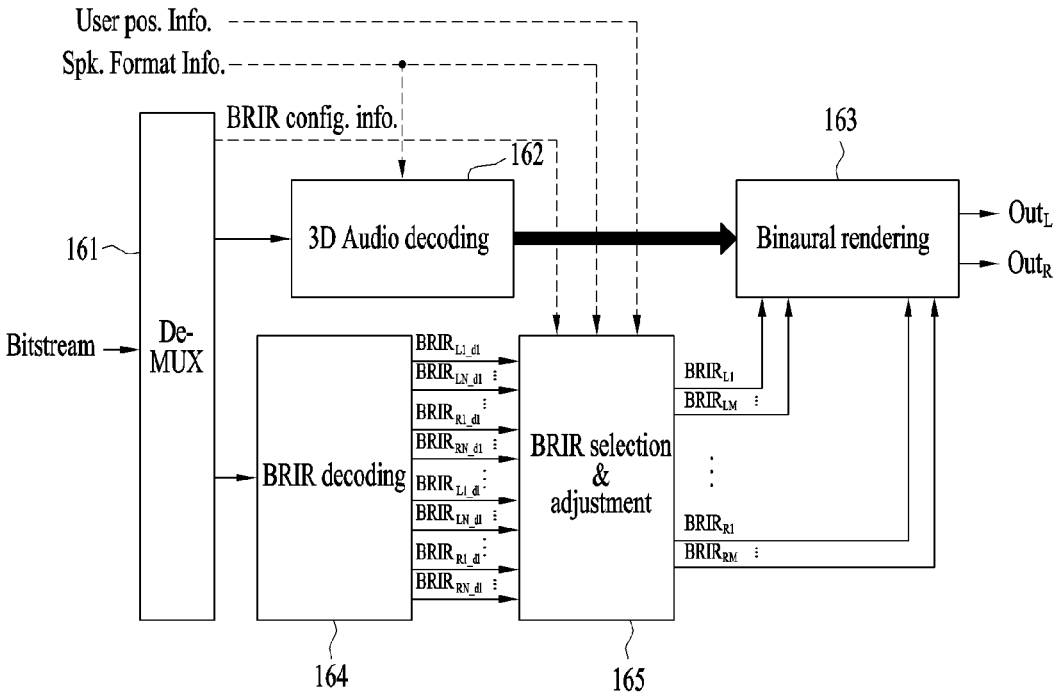
(a)
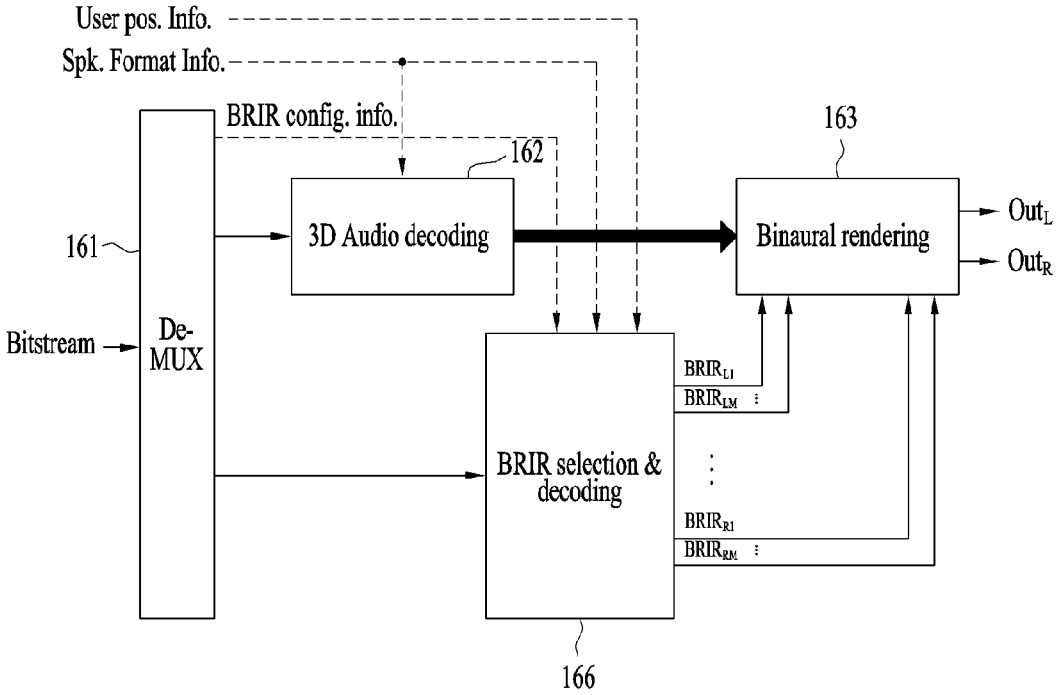
(b)

FIG. 25

| Syntax | No. of bits | Mnemonics |
|---|---|---|
| mpegh3daLocalSetupInformation() 251 | | |
| { | | |
| **is6DoFMode**; 252 | 1 | **bslbf** |
| if(is6DoFMode) { | | |
| **up_az**; | 9 | **uimsbf** |
| **up_el**; | 8 | **uimsbf** |
| **up_dist**; | 10 | **uimsbf** |
| } | | |
| **bsRenderingType**; 253 | 1 | **uimsbf** |
| switch (bsRenderingType) { | | |
| case 0: | | |
| LoudspeakerRendering(); 254 | | |
| case 1: | | |
| BinauralRendering(); 255 | | |
| } | | |
| **bsNumWIREoutputs**; | 16 | **uimsbf** |
| if (bsNumWIREoutputs > 0) { | | |
| for (n = 0; n < bsNumWIREoutputs; n++) { | | |
| **WireID**[n]; | 16 | **uimsbf** |
| } | | |
| } | | |
| **hasLocalScreenSizeInformation**; | 1 | **bslbf** |
| if (hasLocalScreenSizeInformation) { | | |
| LocalScreenSizeInformation(); | | |
| } | | |
| } | | |

FIG. 26

| Syntax | No. of bits | Mnemonics |
|---|---|---|
| BinauralRendering() 255 | | |
| { | | |
| if(is6DOFMode) | | |
| { | | |
| **bsNumMeasuredPositions;** | | |
| for (p = 0; p < bsNumMeasuredPositions; p++) { | 10 | uimsbf |
| **positionAzimuth[p];** | | |
| **positionElevation[p];** | 9 | uimsbf |
| **positionDistance[p];** | 8 | uimsbf |
| } | 10 | uimsbf |
| **bsNumLoudspeakers;** | | |
| localLoudspeakerSetup = SpeakerConfig3d(); | 16 | uimsbf |
| for (n = 0; n < bsNumLoudspeakers; n++) { | | |
| if (speakerLayoutType <= 1) { | | |
| **loudspeakerAzimuth[n];** | | |
| **loudspeakerElevation[n];** | 9 | uimsbf |
| } | 8 | uimsbf |
| **loudspeakerDistance[n];** | | |
| **loudspeakerCalibrationGain[n];** | 10 | uimsbf |
| } | 7 | uimsbf |
| **externalDistanceCompensation;** | | |
| | 1 | bslbf |
| **is6DoFRoomData;** | | |
| if(is6DoFRoomData) | 1 | bslbf |
| { | | |
| **bs6DoFRoomDataFormatID;** 261 | | |
| switch(bs6DoFRoomDataFormatID) { | 1 | bslbf |
| case 0: | | |
| RoomFirData6DoF(); 262 | | |
| break; | | |
| case 1: | | |
| FdRoomRendererParam6DoF(); 263 | | |
| break; | | |
| case 2: | | |
| TdRoomRendererParam6DoF(); 264 | | |
| break; | | |
| } | | |
| HRIRGeneration(); 265 | | |
| } | | |
| else | | |
| { | | |
| **bs6DoFBinauralDataFormatID;** 266 | 1 | bslbf |
| switch(bs6DoFBinauralDataFormatID) { | | |
| case 0: | | |
| BinauralFirData6DoF(); 267 | | |
| break; | | |
| case 1: | | |
| FdBinauralRendererParam6DoF(); 268 | | |
| break; | | |
| case 2: | | |
| TdBinauralRendererParam6DoF(); 269 | | |
| break; | | |
| } | | |
| } | | |
| } | | |

FIG.27

| | | |
|---|---|---|
| else // if(is6DOFMode) | | |
| { | | |
| **isRoomData**; 270 | 1 | bslbf |
| if(isRoomData) | | |
| { | | |
| **bsRoomDataFormatID**; 271 | 1 | bslbf |
| switch (bsRoomDataFormatID) { | | |
| case 0: | | |
| RoomFirData(); 272 | | |
| break; | | |
| case 1: | | |
| FdRoomRendererParam(); 273 | | |
| break; | | |
| case 2: | | |
| TdRoomRendererParam(); 274 | | |
| break; | | |
| } | | |
| HRIRGeneration(); 275 | | |
| } | | |
| else | | |
| { | | |
| **bsBinauralDataFormatID**; 276 | 1 | bslbf |
| ByteAlign(); | | |
| switch (bsBinauralDataFormatID) { | | |
| case 0: | | |
| BinauralFirData(); | | |
| break; | | |
| case 1: | | |
| FdBinauralRendererParam(); | | |
| break; | | |
| case 2: | | |
| TdBinauralRendererParam(); | | |
| break; | | |
| } | | |
| } | | |
| } | | |
| } // for (r = 0; r < bsNumBinauralDataRepresentation; r++) | | |
| } | | |

FIG. 28

| Syntax | No. of bits | Mnemonics |
|---|---|---|
| RoomFirData6DoF() 262 | | |
| { | | |
| for(p =0; p<bsNumMeasuredPositions ;p++) { | | |
| **bsNumRirCoefs_6DoF[p];** | | |
| for(pos = 0; pos < bsNumLoudspeakers; pos++) { | **24** | **uimsbf** |
| for(i=0; i<bsNumRirCoefs_6DoF[p]; i++) { | | |
| **bsFirCoefRoom_6DoF[p][pos][i];** | **32** | **bslbf** |
| } | | |
| } | | |
| } | | |

FIG. 29

| Syntax | No. of bits | Mnemonics |
|---|---|---|
| FdRoomRendererParam6DoF() 263 | | |
| { | | |
| for(p=0; p<bsNumMeasuredPositions; p++) { | | |
| **dInitRir_6DoF[p];** | **10** | **uimsbf** |
| **kMaxRir_6DoF[p];** | **6** | **uimsbf** |
| **kConvRir_6DoF[p];** | **6** | **uimsbf** |
| **kAnaRir_6DoF[p];** | **6** | **uimsbf** |
| VoffRirParam6DoF(); 2631 | | |
| SfrRirParam6DoF(); 2632 | | |
| QtdlRirParam6DoF(); 2633 | | |
| } | | |
| } | | |

FIG. 30

| Syntax | No. of bits | Mnemonics |
|---|---|---|
| VoffRirParam6DoF() 2631 | | |
| { | | |
| for(p=0; p<bsNumMeasuredPositions; p++) { | | |
| **nBitNFilterRir_6DoF[p];** | **4** | **uimsbf** |
| **nBitNFftRir_6DoF[p];** | **3** | **uimsbf** |
| **nBitNBlkRir_6DoF[p];** | **3** | **uimsbf** |
| for(k=0; k<kMaxRir_6DoF[p]; k++) { | | |
| **nFilterRir_6DoF;** | **nBitNFilterRir_6DoF[p]** | **uimsbf** |
| **nFftRir_6DoF;** | **nBitNFftRiR_6DoF[p]** | **uimsbf** |
| fftLength = pow(2, nFft_6DoF[p][k]); | | |
| **nBlkRir_6DoF;** | **nBitNBlkRir_6DoF[p]** | **uimsbf** |
| for (b=0; b<nBlk_6DoF[p][k]; b++) { | | |
| for(nr=0; nr< bsNumLoudspeakers; nr++) { | | |
| for(v=0; v<fftLength; v++) { | | |
| **VoffCoeffRirReal_6DoF[p][k][b][nr][v];** | **32** | **bslbf** |
| **VoffCoeffRirImag_6DoF[p][k][b][nr][v];** | **32** | **bslbf** |
| } | | |
| } | | |
| } | | |
| } | | |
| } | | |
| } | | |

FIG. 31

| Syntax | No. of bits | Mnemonics |
|---|---|---|
| SfrRirParam6DoF() 2632 | | |
| { | | |
| for(p=0; p<bsNumMeasuredPositions; p++) { | | |
| for (k=0; k<kAnaRir_6DoF[p]; k++) { | | |
| **fcAnaRir_6DoF[p][k];** | **32** | **bslbf** |
| **rt60Rir_6DoF[p][k];** | **32** | **bslbf** |
| **nrgLrRir_6DoF[p][k];** | **32** | **bslbf** |
| } | | |
| } | | |
| } | | |

FIG. 32

| Syntax | No. of bits | Mnemonics |
|---|---|---|
| QtdlRirParam6DoF() 2633 | | |
| { | | |
| for(p=0; p<bsNumMeasuredPositions; p++) { | | |
| for (k=0; k<kMaxRir_6DoF[p]-kConvRir_6DoF[p]; k++) { | | |
| **nBitQtdlLagRir_6DoF[p][k];** | **4** | **bslbf** |
| for (nr=0; nr< bsNumLoudspeakers; nr++) { | | |
| **QtdlGainRirReal_6DoF[p][k][nr];** | **32** | **bslbf** |
| **QtdlGainRirImag_6DoF[p][k][nr];** | **32** | **bslbf** |
| **QtdlLagLeft_6DoF[p][k][nr];** | **nBitQtdlLagRir_6DoF[p][k]** | **bslbf** |
| } | | **bslbf** |
| } | | **uimsbf** |
| } | | **uimsbf** |
| } | | |

FIG. 33

| Syntax | No. of bits | Mnemonics |
|---|---|---|
| TdRoomRendererParam6DoF() 264 | | |
| { | | |
| for(p=0; p<bsNumMeasuredPositions; p++) { | | |
| **bsDelayRir_6DoF[p];** | 16 | uimsbf |
| **bsDirectLenRir_6DoF[p];** | 16 | uimsbf |
| **bsNbDiffuseBlocksRir_6DoF[p];** | 8 | uimsbf |
| for(chan=0; chan< bsNumLoudspeakers; chan++) { | | |
| **bsFmaxDirectRir_6DoF[p][chan];** | 32 | bslbf |
| } | | |
| for(block=0; block<bsNbDiffuseBlocksRir_6DoF[p]; block++) { | | |
| **bsFmaxDiffuseRir_6DoF[p][block];** | 32 | bslbf |
| } | | |
| for(chan=0; chan< bsNumLoudspeakers; chan++) { | | |
| **bsWeightsRir_6DoF[p][chan];** | 32 | bslbf |
| } | | |
| for(chan=0; chan< bsNumLoudspeakers; chan++) { | | |
| for(tap=0; tap<bsDirectLenRir_6DoF[p]; tap++) { | | |
| **bsFIRDirectRir_6DoF[p][chan][tap];** | 32 | bslbf |
| } | | |
| } | | |
| for(bloc=0; bloc<bsNbDiffuseBlocksRir_6DoF[p]; bloc++) { | | |
| for(tap=0; tap<bsDirectLenRir_6DoF[p]; tap++) { | | |
| **bsFIRDiffuseRir_6DoF[p][bloc][tap];** | 32 | bslbf |
| } | | |
| } | | |
| } | | |
| } | | |

FIG. 34

| Syntax | No. of bits | Mnemonics |
|---|---|---|
| BinauralFirData6DoF() 267 | | |
| { | | |
| for(p =0; p<bsNumMeasuredPositions ;p++) { | | |
| **bsNumCoefs_6DoF[p];** | 24 | uimsbf |
| for(pos = 0; pos <nBrirPairs; pos++) { | | |
| for(i=0; i<bsNumCoefs_6DoF[p]; i++) { | | |
| **bsFirCoefLeft_6DoF[p][pos][i];** | 32 | bslbf |
| **bsFirCoefRight_6DoF[p][pos][i];** | 32 | bslbf |
| } | | |
| } | | |
| } | | |

FIG. 35

| Syntax | No. of bits | Mnemonics |
|---|---|---|
| FdBinauralRendererParam6DoF() 268 | | |
| { | | |
| for(p=0; p<bsNumMeasuredPositions; p++) { | | |
| **dInit_6DoF[p];** | **10** | **uimsbf** |
| **kMax_6DoF[p];** | **6** | **uimsbf** |
| **kConv_6DoF[p];** | **6** | **uimsbf** |
| **kAna_6DoF[p];** | **6** | **uimsbf** |
| VoffBrirParam6DoF(); 2681 | | |
| SfrBrirParam6DoF(); 2682 | | |
| QtdlBrirParam6DoF(); 2683 | | |
| } | | |
| } | | |

FIG. 36

| Syntax | No. of bits | Mnemonics |
|---|---|---|
| VoffBrirParam6DoF() 2681 | | |
| { | | |
| for(p=0; p<bsNumMeasuredPositions; p++) { | | |
| **nBitNFilter_6DoF[p];** | **4** | **uimsbf** |
| **nBitNFft_6DoF[p];** | **3** | **uimsbf** |
| **nBitNBlk_6DoF[p];** | **3** | **uimsbf** |
| for(k=0; k<kMax_6DoF[p]; k++) { | | |
| **nFilter_6DoF[p][k];** | **nBitNFilter_6DoF[p]** | **uimsbf** |
| **nFft_6DoF[p][k];** | **nBitNFft_6DoF[p]** | **uimsbf** |
| fftLength = pow(2, nFft_6DoF[p][k]); | | |
| **nBlk_6DoF[p][k];** | **nBitNBlk_6DoF[p]** | **uimsbf** |
| for (b=0; b<nBlk_6DoF[p][k]; b++) { | | |
| for(nr=0; nr<nBrirPairs; nr++) { | | |
| for(v=0; v<fftLength; v++) { | | |
| **VoffCoeffLeftReal_6DoF[p][k][b][nr][v];** | **32** | **bslbf** |
| **VoffCoeffLeftImag_6DoF[p][k][b][nr][v];** | **32** | **bslbf** |
| **VoffCoeffRightReal_6DoF[p][k][b][nr][v];** | **32** | **bslbf** |
| **VoffCoeffRightImag_6DoF[p][k][b][nr][v];** | **32** | **bslbf** |
| } | | |
| } | | |
| } | | |
| } | | |
| } | | |
| } | | |

FIG. 37

| Syntax | No. of bits | Mnemonics |
|---|---|---|
| SfrBrirParam6DoF() 2682 | | |
| { | | |
| for(p=0; p<bsNumMeasuredPositions; p++) { | | |
| for (k=0; k<kAna_6DoF[p]; k++) { | 32 | bslbf |
| **fcAna_6DoF[p][k];** | 32 | bslbf |
| **rt60_6DoF[p][k];** | 32 | bslbf |
| **nrgLr_6DoF[p][k];** | | |
| } | | |
| } | | |
| } | | |

FIG. 38

| Syntax | No. of bits | Mnemonics |
|---|---|---|
| QtdlBrirParam6DoF() 2683 | | |
| { | | |
| for(p=0; p<bsNumMeasuredPositions; p++) { | | |
| for (k=0; k<kMax_6DoF[p]-kConv_6DoF[p]; k++) { | | |
| **nBitQtdlLag_6DoF[p][k];** | 4 | bslbf |
| for (nr=0; nr<nBrirPairs; nr++) { | | |
| **QtdlGainLeftReal_6DoF[p][k][nr];** | 32 | bslbf |
| **QtdlGainLeftImag_6DoF[p][k][nr];** | 32 | bslbf |
| **QtdlGainRightReal_6DoF[p][k][nr];** | 32 | bslbf |
| **QtdlGainRightImag_6DoF[p][k][nr];** | 32 | bslbf |
| **QtdlLagLeft_6DoF[p][k][nr];** | nBitQtdlLag_6DoF[p][k] | uimsbf |
| **QtdlLagRight_6DoF[p][k][nr];** | nBitQtdlLag_6DoF[p][k] | uimsbf |
| } | | |
| } | | |
| } | | |
| } | | |

FIG. 39

| Syntax | No. of bits | Mnemonics |
|---|---|---|
| TdBinauralRendererParam6DoF() 269 | | |
| { | | |
| for(p=0; p<bsNumMeasuredPositions; p++) { | | |
| **bsDelay_6DoF[p]**; | **16** | **uimsbf** |
| **bsDirectLen_6DoF[p]**; | **16** | **uimsbf** |
| **bsNbDiffuseBlocks_6DoF[p]**; | **8** | **uimsbf** |
| for(chan=0; chan< nBrirPairs; chan++) { | | |
| **bsFmaxDirectLeft_6DoF[p][chan]**; | **32** | **bslbf** |
| **bsFmaxDirectRight_6DoF[p][chan]**; | **32** | **bslbf** |
| } | | |
| for(block=0; block<bsNbDiffuseBlocks_6DoF[p]; block++) { | | |
| **bsFmaxDiffuseLeft_6DoF[p][block]**; | **32** | **bslbf** |
| **bsFmaxDiffuseRight_6DoF[p][block]**; | **32** | **bslbf** |
| } | | |
| for(chan=0; chan< nBrirPairs; chan++) { | | |
| **bsWeights_6DoF[p][chan]**; | **32** | **bslbf** |
| } | | |
| for(chan=0; chan< nBrirPairs; chan++) { | | |
| for(tap=0; tap<bsDirectLen_6DoF[p]; tap++) { | | |
| **bsFIRDirectLeft_6DoF[p][chan][tap]**; | **32** | **bslbf** |
| **bsFIRDirectRight_6DoF[p][chan][tap]**; | **32** | **bslbf** |
| } | | |
| } | | |
| for(bloc=0; bloc<bsNbDiffuseBlocks_6DoF[p]; bloc++) { | | |
| for(tap=0; tap<bsDirectLen_6DoF[p]; tap++) { | | |
| **bsFIRDiffuseLeft_6DoF[p][bloc][tap]**; | **32** | **bslbf** |
| **bsFIRDiffuseRight_6DoF[p][bloc][tap]**; | **32** | **bslbf** |
| } | | |
| } | | |
| } | | |
| } | | |

FIG. 40

| Syntax | No. of bits | Mnemonics |
|---|---|---|
| RoomFirData() 272 | | |
| { | | |
| **bsNumRirCoefs;** | **24** | **uimsbf** |
| for(pos = 0; pos <numSpeakers; pos++) { | | |
| for(i=0; i<bsNumRirCoefs; i++) { | | |
| **bsFirCoefRir[pos][i];** | **32** | **bslbf** |
| } | | |
| } | | |
| } | | |

FIG. 41

| Syntax | No. of bits | Mnemonics |
|---|---|---|
| FDRoomRendererParam() 273 | | |
| { | | |
| **dInitRir;** | **10** | **bslbf** |
| **kMaxRir;** | **6** | **uimsbf** |
| **kConvRir;** | **6** | **uimsbf** |
| **kAnaRir;** | **6** | **uimsbf** |
| VoffRirParam(); 2731 | | |
| SfrBrirParam(); 2732 | | |
| QtdlBrirParam(); 2733 | | |
| } | | |

FIG. 42

| Syntax | No. of bits | Mnemonics |
|---|---|---|
| VoffRirParam() ~ 2731 | | |
| { | | |
| **nBitNFilterRir;** | **4** | **uimsbf** |
| **nBitNFftRir;** | **3** | **uimsbf** |
| **nBitNBlkRir;** | **3** | **uimsbf** |
| for(k=0; k<kMaxRir; k++) { | | |
| **nFilterRir[k];** | **nBitNFilterRir** | **uimsbf** |
| **nFftRir[k];** | **nBitNFftRir** | **uimsbf** |
| fftLength = pow(2, nFftRir[k]); | | |
| **nBlkRir[k];** | **nBitNBlkRir** | **uimsbf** |
| for (b=0; b<nBlkRir[k]; b++) { | | |
| for(nr=0; nr<numSpeakers; nr++) { | | |
| for(v=0; v<fftLength; v++) { | | |
| **VoffCoeffRirReal[k][b][nr][v];** | **32** | **bslbf** |
| **VoffCoeffRirImag[k][b][nr][v];** | **32** | **bslbf** |
| } | | |
| } | | |
| } | | |
| } | | |
| } | | |

FIG. 43

| Syntax | No. of bits | Mnemonics |
|---|---|---|
| SfrRirParam() ~ 2732 | | |
| { | | |
| for (k=0; k<kAnaRir; k++) { | | |
| **fcAnaRir[k];** | **32** | **bslbf** |
| **rt60Rir[k];** | **32** | **bslbf** |
| **nrgLrRir[k];** | **32** | **bslbf** |
| } | | |

FIG. 44

| Syntax | No. of bits | Mnemonics |
|---|---|---|
| QtdlRirParam() 2733 | | |
| { | | |
| for (k=0; k<kMaxRir-kConvRir; k++) { | | |
| **nBitQtdlLagRir[k];** | **4** | **bslbf** |
| for (nr=0; nr<numSpeakers; nr++) { | | |
| **QtdlGainRirReal[k][nr];** | **32** | **bslbf** |
| **QtdlGainRirImag[k][nr];** | **32** | **bslbf** |
| **QtdlLagRir[k][nr];** | **nBitQtdlLagRir[k]** | **uimsbf** |
| } | | |
| } | | |
| } | | |

FIG. 45

| Syntax | No. of bits | Mnemonics |
|---|---|---|
| TdRoomRendererParam() 274 | | |
| { | | |
| **bsDelayRir;** | **16** | **uimsbf** |
| **bsDirectLenRir;** | **16** | **uimsbf** |
| **bsNbDiffuseBlocksRir;** | **8** | **uimsbf** |
| for(chan=0; chan< numSpeakers; chan++) { | | |
| **bsFmaxDirectRir[chan];** | **32** | **bslbf** |
| } | | |
| for(block=0; block<bsNbDiffuseBlocksRir; block++) { | | |
| **bsFmaxDiffuseRir[block];** | **32** | **bslbf** |
| } | | |
| for(chan=0; chan< numSpeakers; chan++) { | | |
| **bsWeightsRir[chan];** | **32** | **bslbf** |
| | | |
| for(chan=0; chan< numSpeakers; chan++) { | | |
| for(tap=0; tap<bsDirectLen; tap++) { | | |
| **bsFIRDirectRir[chan][tap];** | **32** | **bslbf** |
| } | | |
| } | | |
| | | |
| for(bloc=0; bloc<bsNbDiffuseBlocksRir; bloc++) { | | |
| for(tap=0; tap<bsDirectLenRir; tap++) { | | |
| **bsFIRDiffuseRir[bloc][tap];** | **32** | **bslbf** |
| } | | |
| } | | |
| } | | |

FIG. 46

| Syntax | No. of bits | Mnemonics |
|---|---|---|
| HRIRGeneration() 275 | | |
| { | | |
| **bsHRIRDataFormatID;** | 1 | bslbf |
| switch(bsHRIRDataFormatID) { | | |
| case 0: | | |
| HRIRFIRData(); 2751 | | |
| break; | | |
| case 1: | | |
| HRIRModeling(); 2752 | | |
| break; | | |
| } | | |
| } | | |

FIG. 47

| Syntax | No. of bits | Mnemonics |
|---|---|---|
| HRIRFIRData() 2751 | | |
| { | | |
| **bsNumHRIRCoefs;** | 24 | uimsbf |
| for (pos=0; n< nBrirPairs; pos++) { | | |
| for(i=0; i<bsNumHRIRCoefs; i++) { | | |
| **bsFirHRIRCoefLeft**[pos][i]; | 32 | bslbf |
| **bsFirHRIRCoefRight**[pos][i]; | 32 | bslbf |
| } | | |
| } | | |
| } | | |

| Syntax | No. of bits | Mnemonics |
|---|---|---|
| HRIRModeling() 2752 | | |
| { | | |
| bsNumHRIRCoefs; | 24 | uimsbf |
| HeadRadius; | 10 | uimsbf |
| PinnaModelIdx; | 3 | uimsbf |
| } | | |

THREE-DIMENSIONAL AUDIO PLAYING METHOD AND PLAYING APPARATUS

This application is a National Stage Application of International Application No. PCT/KR2017/012881, filed on Nov. 14, 2017, which claims the benefit of U.S. Provisional Application No. 62/543,385, filed on Aug. 10, 2017, all of which are hereby incorporated by reference in their entirety for all purposes as if fully set forth herein.

TECHNICAL FIELD

A present disclosure relates to a three-dimensional audio play method and play device. In particular, the present disclosure relates to an audio playing method and audio playing apparatus based on a method for transmitting binaural room impulse response (BRIR) or room impulse response (RIR) data, which are used for three-dimensional audio play, and a BRIR/RIR parameterization method.

BACKGROUND ART

Recently, with the development of IT technology, various smart devices are being developed. In particular, these smart devices basically provide audio output having various effects. In particular, various methods have been attempted for more realistic audio output in a virtual reality environment or a three-dimensional audio environment. In this context, MPEG-H is being developed as a new international audio coding standard technology. MPEG-H is a new international standardization project for immersive multimedia services using an ultra-high resolution large-screen display (e.g., over 100 inches) and an ultra-multichannel audio system (e.g., 10.2 channels or 22.2 channels). In particular, in the MPEG-H standardization project, a subgroup named "MPEG-H 3D Audio AhG (Adhoc Group)" has been established and active in an effort to implement an ultra-multichannel audio system.

A MPEG-H 3D Audio encoding/decoding device provides immersive audio to listeners using a multichannel speaker system. In addition, they provide realistic 3D audio effects in a headphone environment. Due to these features, the MPEG-H 3D Audio decoder is being considered as a VR audio standard.

Existing standardized 3D audio encoding/decoding devices (e.g., MPEG-H 3D Audio) all provide a three-dimensional audio signal by applying the binaural room impulse response (BRIR) or the head-related impulse response (HRIR) held by the decoder or the receiver to the reproduced audio signal. That is, only the data already held is used. This may obstruct a user from experiencing 3D audio in various environments. Therefore, the present disclosure proposes a method to experience 3D audio in an optimal environment, overcoming the limitations of existing encoders by encoding an audio signal at the encoder stage while encoding BRIR or RIR most suitable for the audio signal.

As mentioned above, VR audio is intended to make a user feel that the user is present in a space without noticing any difference from reality when listening to sound, and one of the most important factors to achieve this purpose is BRIR. In other words, in order to provide an environment similar to reality, BRIR should reflect spatial characteristics well. However, in playing audio content through the MPEG-H 3D Audio encoder and providing the same through headphones, the BRIR pre-stored in the decoder is used. In addition, for VR contents, various environments may be considered, but it is practically impossible to pre-obtain BRIRs for all the environments through the decoder and retain them as a database (DB). Further, in the case where only basic feature information about the space is provided to allow the decoder to model the BRIR in, it is necessary to verify whether the modeled BRIR reflects the characteristics of the space well. Therefore, to address such issues, the present disclosure proposes a method to extract only the characteristic information about the BRIR or RIR to create and transmit parameters directly applicable to audio signals.

In this regard, most existing 3D audio encoding/decoding devices merely support up to three degrees of freedom (referred to as "3DoF"). For example, when motion of a head is accurately tracked in any space, it is possible to provide the best visual feature and sound for the user's posture or position at that moment may be provided. Such motion is divided into 3DoF or 6DoF that enables the motion. For example, 3DoF means that the user is allowed to make motion on the X, Y, and Z axes as in the case when the user turns his head in a fixed position without moving the body. On the other hand, 6DoF means that movements along the X, Y, and Z axes as well as rotation about the X, Y, and Z axes are allowed. Therefore, 3DoF fails to reflect the positional movement of the user, making it difficult to provide realistic sound. In view of the above, the present disclosure proposes a method of rendering audio in response to change in position of a user in a 6DoF environment by applying a spatial modeling technique to 3D audio encoding/decoding devices.

Generally, in a communication environment, an audio signal having a capacity much smaller than that of video signals is encoded in order to maximize bandwidth efficiency. Recently, many technologies by which VR audio contents, which are of increasing interest, can be implemented and experienced have been developed, but there is a lack of devices capable of efficiently encoding/decoding the contents. In this regard, MPEG-H 3D Audio has been recently developed as an encoding/decoding device capable of providing 3D audio effects, but is limited so as to be used only in the 3DoF environment.

Recently, 3D audio encoding/decoding devices have adopted a binaural renderer to enable experience of 3D audio through headphones. However, the binaural room impulse response (BRIR) data used as an input to the binaural renderer is valid only in a 3DoF environment because it is a response measured at a fixed position. Moreover, in order to build a VR environment, BRIRs for a wide variety of environments are needed. However, it is impossible to obtain BRIRs for all environments as a database. Therefore, the present disclosure adds a function of modeling intended spatial responses by providing spatial information to a 3D audio encoding/decoding device. Further, the present disclosure proposes an audio playing method and audio playing apparatus that enable a 3D audio encoding/decoding device to be used even in a 6DoF environment by rendering a response modeled according to a user's position in real time by receiving user position information.

DISCLOSURE

Technical Problem

An object of the present disclosure is to provide a method and apparatus for transmitting and receiving BRIR/RIR data for three-dimensional audio play.

Another object of the present disclosure is to provide a three-dimensional audio play method and politics using BRIR/RIR.

Another object of the present disclosure is to provide a method and apparatus for transmitting and receiving BRI/RIR data in order to play a 3D audio signal in a 6DoF environment.

Another object of the present disclosure is to provide an MPEG-H 3D audio play apparatus capable of playing a three-dimensional audio signal in a 6DoF environment.

Technical Solution

In one aspect of the present disclosure, a method for playing three-dimensional audio may include a decoding operation of decoding a received audio signal and outputting a decoded audio signal and metadata, an room impulse response (RIR) decoding operation of decoding RIR data when the received audio signal contains the RIR data, a head-related impulse response (HRIR) generation operation of generating HRIR data based on user head information when the received audio signal contains the RIR data, a binaural room impulse response (BRIR) synthesis operation of synthesizing the decoded RIR data and modeled HRIR data and generating BRIR data, and a binaural rendering operation of applying the generated BRIR data to the decoded audio signal and outputting a binaural rendered audio signal.

The method may further include receiving speaker format information, wherein the RIR decoding operation may include selecting a portion of the RIR data related to the speaker format information and decoding only the selected portion of the RIR data.

The HRIR generation operation may include modeling and generating HRIR data related to the user head information and the speaker format information.

The HRIR generation operation may include selecting and generating the HRIR data from an HRIR database (DB).

The method may further include checking 6 degrees of freedom (DoF) mode indication information (is6DoFMode) contained in the received audio signal, and when 6DoF is supported, acquiring user position information and speaker format information from the information (is6DoFMode).

The RIR decoding operation may include selecting a portion of the RIR data related to the user position information and the speaker format information and decoding only the selected portion of the RIR data.

In another aspect of the present disclosure, a method for playing three-dimensional audio may include a decoding operation of decoding a received audio signal and outputting a decoded audio signal and metadata, an room impulse response (RIR) decoding operation of decoding an RIR parameter when the received audio signal contains the RIR parameter, a head-related impulse response (HRIR) generation operation of generating, HRIR data based on user head information when the received audio signal contains the RIR parameter, a rendering operation of applying the generated HRIR data to the decoded audio signal and outputting a binaural rendered audio signal, and a synthesis operation of correcting the binaural rendered audio signal such as to be suitable for spatial characteristics by applying the decoded RIR parameter thereto and outputting the corrected audio signal.

The method may further include checking information (isRoomData) indicating whether an RIR parameter for a 3 degrees of freedom (DoF) environment is included, the information (isRoomData) being contained in the received audio signal, checking, based on the information (isRoomData), information (bsRoomDataFormatID) indicating an RIR parameter type provided in the 3DoF environment, and acquiring one or more of a 'RoomFirData( )' syntax, a 'FdRoomRendererParam( )' syntax, or a 'TdRoomRendererParam( )' syntax as an RIR parameter syntax related to the information (bsRoomDataFormatID).

The method may further include checking information (is6DoFRoomData) indicating whether an RIR parameter for a 6 degrees of freedom (DoF) environment is included, the information (is6DoFRoomData) being contained in the received audio signal, checking, based on the information (is6DoFRoomData), information (bs6DoFRoomDataFormatID) indicating an RIR parameter type provided in the 6DoF environment, and acquiring one or more of a 'RoomFirData6DoF( )' syntax, a 'FdRoomRendererParam6DoF( )' syntax, or a 'TdRoomRendererParam6DoF( )' syntax as an RIR parameter syntax related to the information (bs6DoFRoomDataFormatID).

In another aspect of the present disclosure, an apparatus for playing three-dimensional audio may include an audio decoder configured to decode a received audio signal and outputting a decoded audio signal and metadata, an room impulse response (RIR) decoder configured to decode RIR data when the received audio signal contains the RIR data, a head-related impulse response (HRIR) generator configured to generate HRIR data based on user head information when the received audio signal contains the RIR data, a binaural room impulse response (BRIR) synthesizer configured to synthesize the decoded RIR data and modeled HRIR data and generate BRIR data, and a binaural renderer configured to apply the generated BRIR data to the decoded audio signal and output a binaural rendered audio signal.

The RIR decoder may be configured to receive speaker format information and to select a portion of the RIR data related to the speaker format information and decode only the selected portion of the RIR data.

The HRIR generator may include an HRIR modeler configured to model and generate HRIR data related to the user head information and the speaker format information.

The HRIR generator may include an HRIR selector configured to selecting and generating the HRIR data from an HRIR database (DB).

The RIR decoder is configured to check 6 degrees of freedom (DoF) mode indication information (is6DoFMode) contained in the received audio signal and to acquire user position information and speaker format information from the information (is6DoFMode) when 6DoF is supported.

The RIR decoder may be configured to select a portion of the RIR data related to the user position information and the speaker format information and decode only the selected portion of the RIR data.

In another aspect of the present disclosure, an apparatus for playing three-dimensional audio may include an audio decoder configured to decode a received audio signal and outputting a decoded audio signal and metadata, an room impulse response (RIR) decoder configured to decode an RIR parameter when the received audio signal contains the RIR parameter, a head-related impulse response (HRIR) generator configured to generate HRIR data based on user head information when the received audio signal contains the RIR parameter, a binaural renderer configured to apply the generated HRIR data to the decoded audio signal and output a binaural rendered audio signal, and a synthesizer configured to correct the binaural rendered audio signal such as to be suitable for spatial characteristics by applying the decoded RIR parameter thereto and output the corrected audio signal.

The RIR decoder may be configured to check information (isRoomData) indicating whether an RIR parameter for a 3 degrees of freedom (DoF) environment is included, the information (isRoomData) being contained in the received audio signal, check, based on the information (isRoomData), information (bsRoomDataFormatID) indicating an RIR parameter type provided in the 3DoF environment, and acquire one or more of a 'RoomFirData( )' syntax, a 'FdRoomRendererParam( )' syntax, or a 'TdRoomRendererParam( )' syntax as an RIR parameter syntax related to the information (bsRoomDataFormatID).

The RIR decoder is configured to check information (is6DoFRoomData) indicating whether an RIR parameter for a 6 degrees of freedom (DoF) environment is included, the information (is6DoFRoomData) being contained in the received audio signal, check, based on the information (is6DoFRoomData), information (bs6DoFRoomDataFormatID) indicating an RIR parameter type provided in the 6DoF environment, and acquire one or more of a 'RoomFirData6DoF( )' syntax, a 'FdRoomRendererParam6DoF( )' syntax, or a 'TdRoomRendererParam6DoF( )' syntax as an RIR parameter syntax related to the information (bs6DoFRoomDataFormatID).

Advantageous Effects

With an audio playing method and audio playing apparatus according to embodiments of the present disclosure, the following effects may be obtained.

First, by enabling an audio encoder and an audio decoder to transmit and receive BRIR/RIR, various BRIRs/RIRs may be applied to an audio or object signal.

Second, as position change information about a user is used for application to a 6DoF environment, a three-dimensional and realistic audio signal may be provided by changing the BRIR/RIR according to the user's position.

Third, efficiency of MPEG-H 3D Audio implementation may be enhanced with next-generation three-dimensional immersive audio encoding technology. That is, in various audio application fields such as games or virtual reality (VR) space, a natural and realistic effect may be provided in response to an audio object signal, which frequently changes.

DESCRIPTION OF DRAWINGS

FIG. 10 illustrates an RIR decoding operation according to the third example of the present disclosure.

FIG. 12 illustrates an RIR decoding operation according to the fourth example of the present disclosure.

FIG. 14 illustrates 3DoF and 6DoF applied to the present disclosure.

FIG. 16 illustrates a BRIR decoding operation in a 6DoF environment according to the fifth example of the present disclosure.

FIGS. 25 to 48 illustrate syntax structures used in an audio playing method and apparatus according to an example of the present disclosure.

FIG. 49 shows a flowchart of an audio encoding method according to the present disclosure.

BEST MODE

Hereinafter, exemplary embodiments disclosed herein will be described in detail with reference to the accompanying drawings. The same reference numbers will be used throughout the drawings to refer to the same or like parts, and redundant description thereof will be omitted. As used herein, the suffixes "module," "unit," and "means" are added or used interchangeably to facilitate preparation of this specification and are not intended to suggest distinct meanings or functions. In the following description of the embodiments of the present disclosure, a detailed description of known technology will be omitted to avoid obscuring the subject matter of the present disclosure. Accompanying drawings are intended to facilitate understanding of the embodiments disclosed herein, and should not be construed as limiting the technical idea disclosed in this specification. The disclosure should be understood as covering all modifications, equivalents, and alternatives falling within the spirit and scope of the embodiments. In addition, in the present disclosure, some terms are presented in Korean and English for convenience of explanation, but the meanings of the employed terms are the same.

As mentioned above, BRIR is a binaural spatial response measured in a space. Therefore, the measured BRIR includes not only a response to a head-related impulse response (HRIR), which is also known as a head-related transfer function (HRTF) and is obtained by measuring only the binaural feature information, but also the feature information about the space. For this reason, the BRIR may be considered to be a response combining an HRIR and a room impulse response (RIR), which is obtained by measuring the feature information about the space. When the BRIR is filtered to an audio signal for listening, the played audio signal may make the user feel like the user is present in a space where the BRIR is measured. Because of such characteristics, BRIR may be the most basic and important element in playing immersive audio using headphones in fields such as VR.

Figure 1:
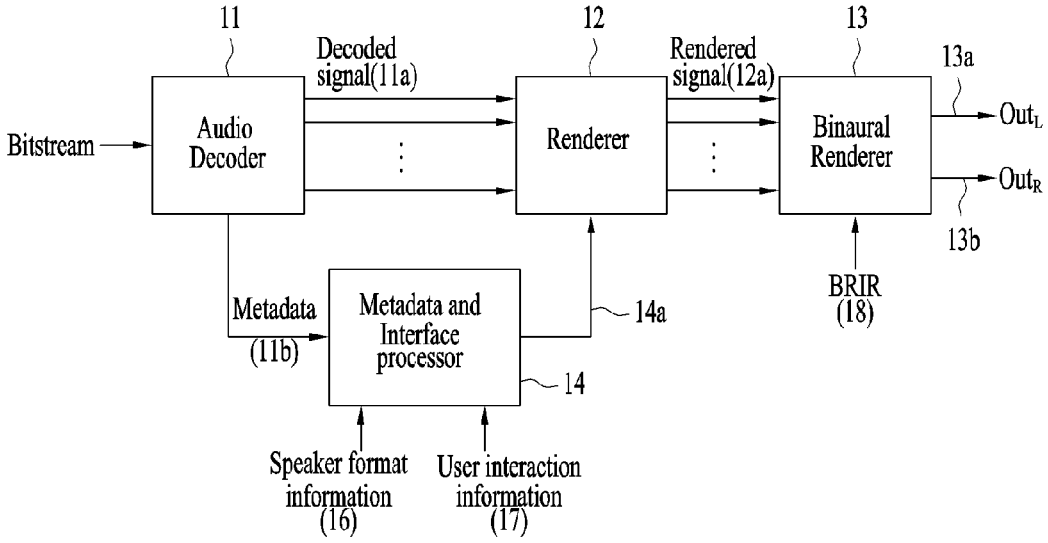
FIG. 1 shows a basic configuration of an audio playing apparatus to which the present disclosure is applied.

FIG. 1 shows a basic configuration of an audio playing apparatus to which the present disclosure is applied. The audio playing apparatus of FIG. 1 may include an audio decoder 11, a renderer 12, a binaural renderer 13, and a metadata and interface processor 14. Hereinafter, the audio playing apparatus of the present disclosure will be described in detail.

The audio decoder 11 receives an audio signal (e.g., an audio bitstream), and generates a decoded signal 11*a* and metadata 11*b*. The metadata information 11*b* is transmitted to the metadata processor 14, and the metadata processor 14 sets a final playback environment by combining speaker format info 16 and user interaction information 17, which are additionally input from the outside, and outputs the set playback environment information 14*a* to the renderer 12.

The renderer 12 performs rendering on the decoded signal 11*a* input according to the speaker environment set by the user with reference to the playback environment information 14*a*, and outputs the rendered signal 12*a*. The renderer 12 may output the rendered signal 12*a* through gain and delay correction in a mixing operation. The output rendered signal 12*a* is filtered by the BRIR 18 in the binaural renderer 13. Then, 2-channel surround binaural rendered signals 13*a* and 13*b* are output.

When the audio decoder 11 is configured as an "MPEG-H 3D Audio Core Decoder," the decoded signal 11*a* may include any type of signal (e.g., a channel signal, an object signal, and an HOA signal). In addition, the metadata 11*b* may be output as object metadata. In addition, when the feature of the object is to be changed in the user interaction information 17, the metadata processor 14 modifies the object metadata information. The BRIR used in the binaural renderer 13 is information used only in the decoder. If the decoder does not have or receive the BRIR, immersive audio may not be experienced through headphones.

In this regard, the existing standardized MPEG-H 3D Audio uses a BRIR measured for a point in a space. Therefore, in order to apply MPEG-H 3D Audio to the VR field that needs to be applied to various spaces, additional considerations on the measurement and use of BRIR are needed. As a most intuitive method, BRIR for an environment that is frequently used in VR may be pre-measured or pre-produced and retained as a database (DB) so as to be applied to the MPEG-H 3D Audio decoder. However, retaining a large number of BRIR DBs is limited. In addition, even if BRIRs with features similar to those of a space in which VR content has been recorded is used in a BRIR DB, it may be ensured that they exactly match the environment intended by the producer. In addition, when VR audio is extended to a 6DoF environment, the BRIR DB grows exponentially, which requires a huge storage space to be secured. In this context, described below are a method for producing or measuring, by a producer, a BRIR or RIR for an environment intended by the producer and transmitting the same, and an audio playing method and apparatus using the same according to the present disclosure.

Figure 2:
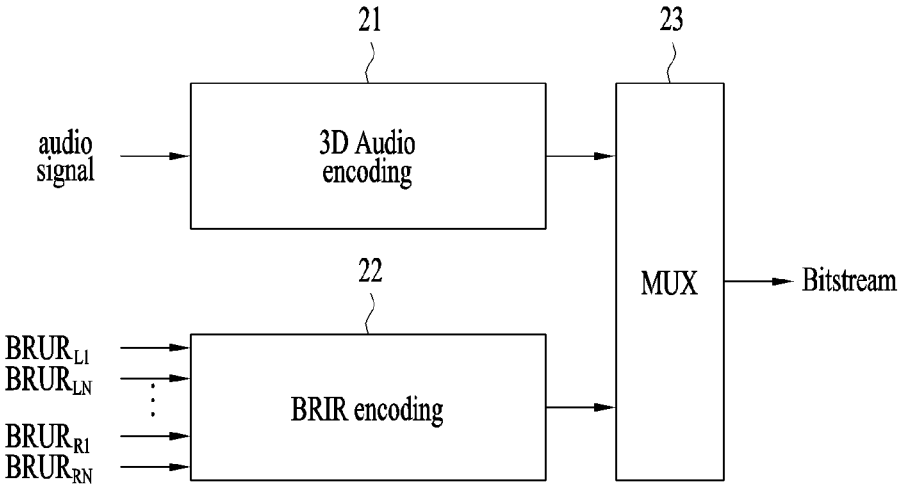
FIG. 2 illustrates a BRIR encoding operation, according to a first example of the present disclosure.
Figure 3:
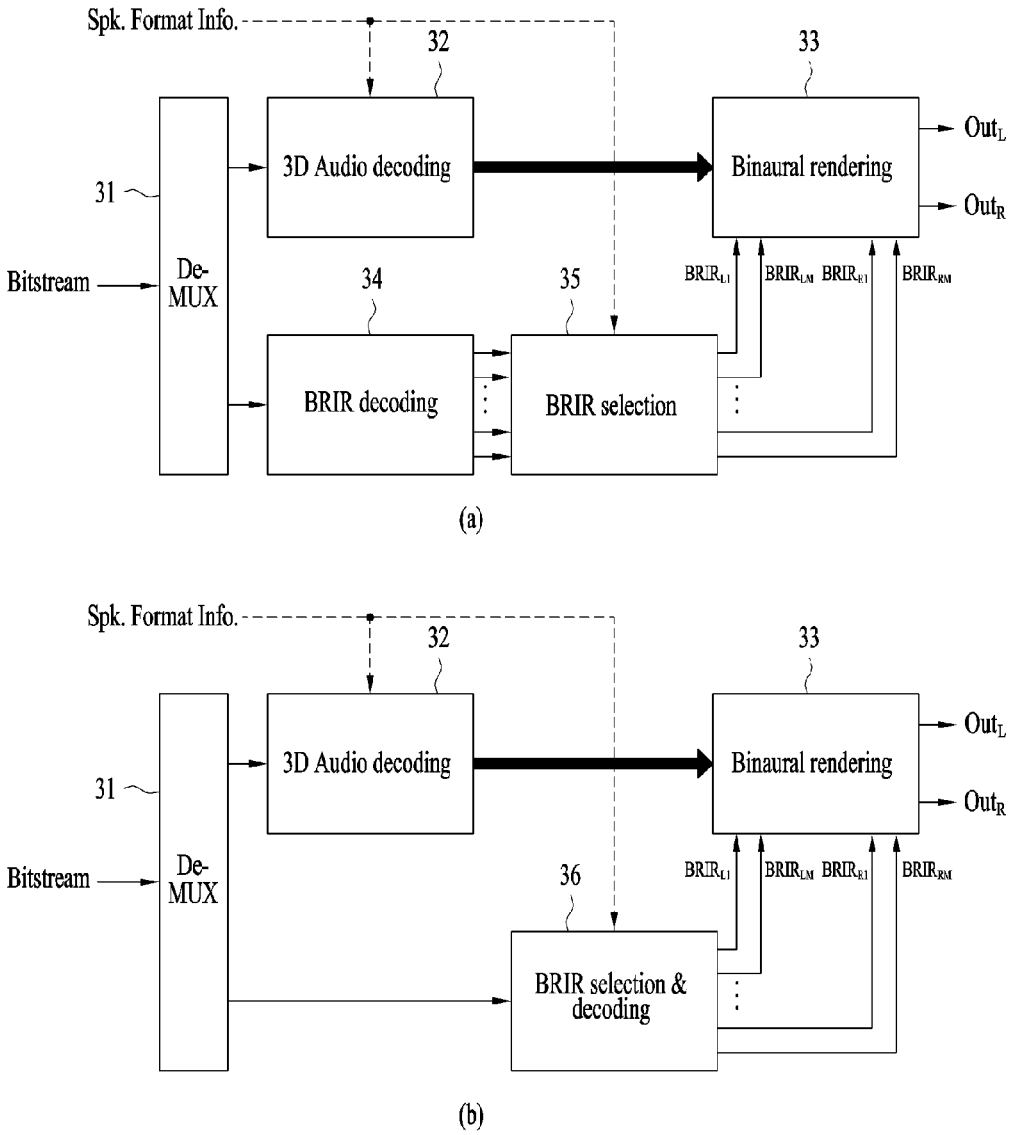
FIGS. 3 and 4 illustrate a BRIR decoding operation according to the first example of the present disclosure.
Figure 4:
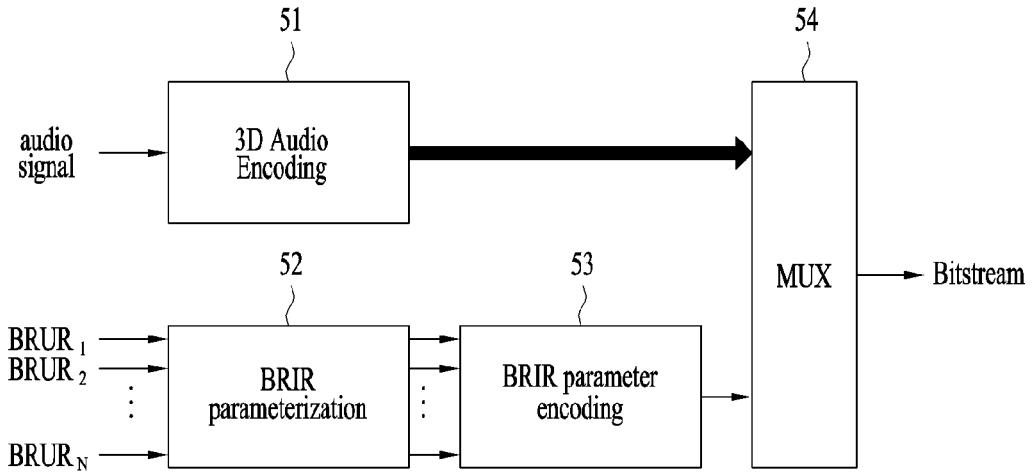

FIG. 2 illustrates a BRIR encoding operation, according to a first example of the present disclosure. FIGS. 3 and 4 illustrate a BRIR decoding operation according to the first example of the present disclosure.

Referring to FIG. 2, the encoding operation according to the first example of the present disclosure includes not only a 3D audio encoder 21 (3D Audio Encoding) but also a BRIR encoder 22 (BRIR Encoding). This configuration will be described in detail below. An input audio signal is encoded through the 3D audio encoder 21 in accordance with an encoding format, and multiple separately input BRIRs ($BRIR_{L1}$, $BRIR_{R1}$, . . . , $BRIR_{LN}$, $BRIR_{RN}$) are also encoded through the BRIR encoder 22. A multiplexer 23 (MUX) packs the encoded audio data and BRIR data together into one bitstream and transmits the bitstream.

BRIRs input to the BRIR encoder 22 are generally measured or produced in a speaker format environment of a predetermined standard. For example, when it is assumed that BRIRs for a 22.2 speaker channel are input, N=22. In addition, since BRIRs are responses reflecting the characteristics of the ears, there is always a pair of left and right BRIRs. Therefore, N*2 BRIRs are input to the BRIR encoder 22. In general, it is advantageous to transmit as many BRIRs as possible to maximize flexibility. However, only necessary BRIRs are transmitted in order to effectively use a limited bandwidth. In the case where a VR content creator produces an audio signal in a 5.1 channel environment, only five BRIRs may be transmitted.

FIGS. 3 and 4 illustrate a BRIR decoding operation according to the first example of the present disclosure. Specifically, FIG. 3(*a*) illustrates an operation of selecting only a desired BRIR after decoding all BRIRs, and FIG. 3(*b*) illustrates an operation of decoding only the selected BRIR after selecting the desired BRIR. FIGS. 4(*a*) and 4(*b*) add a BRIR parameterization operation to FIGS. 3(*a*) and 3(*b*), respectively.

Referring to FIG. 3(*a*), a decoder according to the first example of the present disclosure may include a de-multiplexer 31 (DeMUX), a 3D audio decoder 32 (3D Audio decoding), a BRIR decoder 34 (BRIR decoding), a BRIR selector 35 (BRIR selection), and a binaural renderer 33 (Binaural Rendering).

Upon receiving a bitstream, the de-multiplexer 31 (DeMUX) separates the encoded audio data and encoded BRIR data included in the bitstream from each other. The 3D audio decoder 32 (3D Audio decoding) decodes the separated audio data, performs primary rendering on the audio signal according to a configured speaker format (Spk. Format Info), and outputs the rendered signal. In this regard, in FIG. 3(*a*), the audio signal output from the 3D audio decoder 32 is indicated by a bold solid line, which means that the signal includes two or more signals. Hereinafter, the bold solid lines in other drawings have the same meaning. The BRIR decoder 34 (BRIR decoding) decodes the BRIR data separated by the de-multiplexer 31. The BRIR selector 35 (BRIR selection) selects only BRIRs that are necessary according to the configured speaker format (Spk. Format Info) among all the decoded BRIRs. The binaural renderer 33 (binaural rendering) applies the selected BRIRs to the rendered audio output signal and outputs a binaural rendered 2-channel surround audio signals $Out_L$, $Out_R$.

In general, increasing the number of speakers may allow user to experience more realistic audio when they listen to audio. Similarly, using more BRIRs in binaural rendering may allow users to experience more realistic 3D audio. In this regard, as another use example, all decoded BRIR data may be output to the binaural renderer 33 without the BRIR selector 35 of FIG. 3(*a*). However, as the number of BRIRs used increases, the amount of computation may also increase. If the binaural renderer 33 fails to process computation of many BRIRs within a sufficiently short time, delay may occur in the rendering operation, resulting in degradation of a sense of realism. Therefore, the BRIR selector 35 may be selectively employed by a system designer in consideration of system performance and efficiency.

FIG. 3(*b*) illustrates another decoder according to the first example of the present disclosure. Referring to FIG. 3(*b*), the de-multiplexer 31 (DeMUX), the 3D audio decoder 32 (3D Audio decoding), and the binaural renderer 33 (Binaural Rendering) are the same as those in FIG. 3(*a*). However, the BRIR decoder 34 (BRIR decoding) and the BRIR selector 35 (BRIR selection) used in FIG. 3(*a*) are integrated to configure a BRIR selection and decoding unit 36 (BRIR selection & decoding). In other words, in FIG. 3(*b*), the BRIR selection and decoding unit 36 receives the speaker format information (Spk. Format Info) set by the user and selectively decodes only necessary BRIRs in BRIR decoding.

FIG. 4 illustrates another BRIR decoding operation according to the first example of the present disclosure. Specifically, FIG. 4(*a*) illustrates an operation of selecting and parameterizing only a desired BRIR after decoding all BRIRs, and FIG. 4(*b*) illustrates an operation of decoding and parameterizing only the selected BRIR after selecting the desired BRIR.

Referring to FIG. 4(*a*), the example may include a de-multiplexer 41 (DeMUX), a 3D audio decoder 42 (3D Audio decoding), a BRIR decoder 44 (BRIR decoding), and a BRIR selector 45 (BRIR selection), and a binaural renderer 43 (Binaural Rendering). Operations of the respective elements are the same as those of the de-multiplexer 31 (DeMUX), the 3D audio decoder 32 (3D Audio decoding), the BRIR decoder 34 (BRIR decoding), the BRIR selector 35 (BRIR selection), and the binaural renderer 33 (Binaural Rendering) of FIG. 3(*a*). However, the example of FIG. 4(*a*) may further include a BRIR parameterizer 46 (BRIR parameterization) configured to parameterize BRIR data selected by the BRIR selector 45 for computational efficiency. Accordingly, the binaural renderer 43 may perform efficient binaural rendering by utilizing the parameterized BRIR data.

In other words, instead of filtering the BRIR directly to the audio signal, parameters obtained by extracting only feature information about the BRIR may be applied to the audio signal for binaural rendering. In this case, the amount of computation may be reduced up to one-tenth of the amount of computation in direct filtering of BRIRs. In this regard, the BRIR parameterization operation will be described in detail later with reference to FIGS. 7 and 8.

FIG. 4(*b*) illustrates another decoder according to the first example of the present disclosure. Referring to FIG. 4(*b*), the de-multiplexer 41 (DeMUX), the 3D audio decoder 42 (3D Audio decoding), the binaural renderer 43 (Binaural Rendering), and the BRIR parameterizer 46 (BRIR parameterization) are the same as those in FIG. 4(*a*). However, the BRIR decoder 44 (BRIR decoding) and the BRIR selector 45 (BRIR selection) employed in FIG. 4(*a*) are integrated to configure a BRIR selection and decoding unit 47 (BRIR selection & decoding). In other words, in FIG. 4(*b*), the BRIR selection and decoding unit 47 receives the speaker format information (Spk. Format Info) set by the user and selectively decodes only necessary BRIRs in BRIR decoding.

Figure 5:
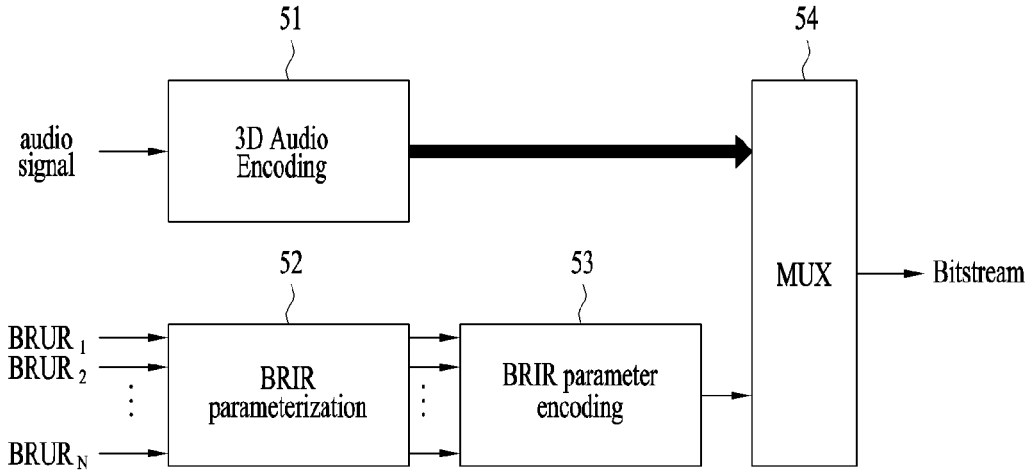
FIG. 5 illustrates a BRIR encoding operation according to a second example of the present disclosure.
Figure 6:
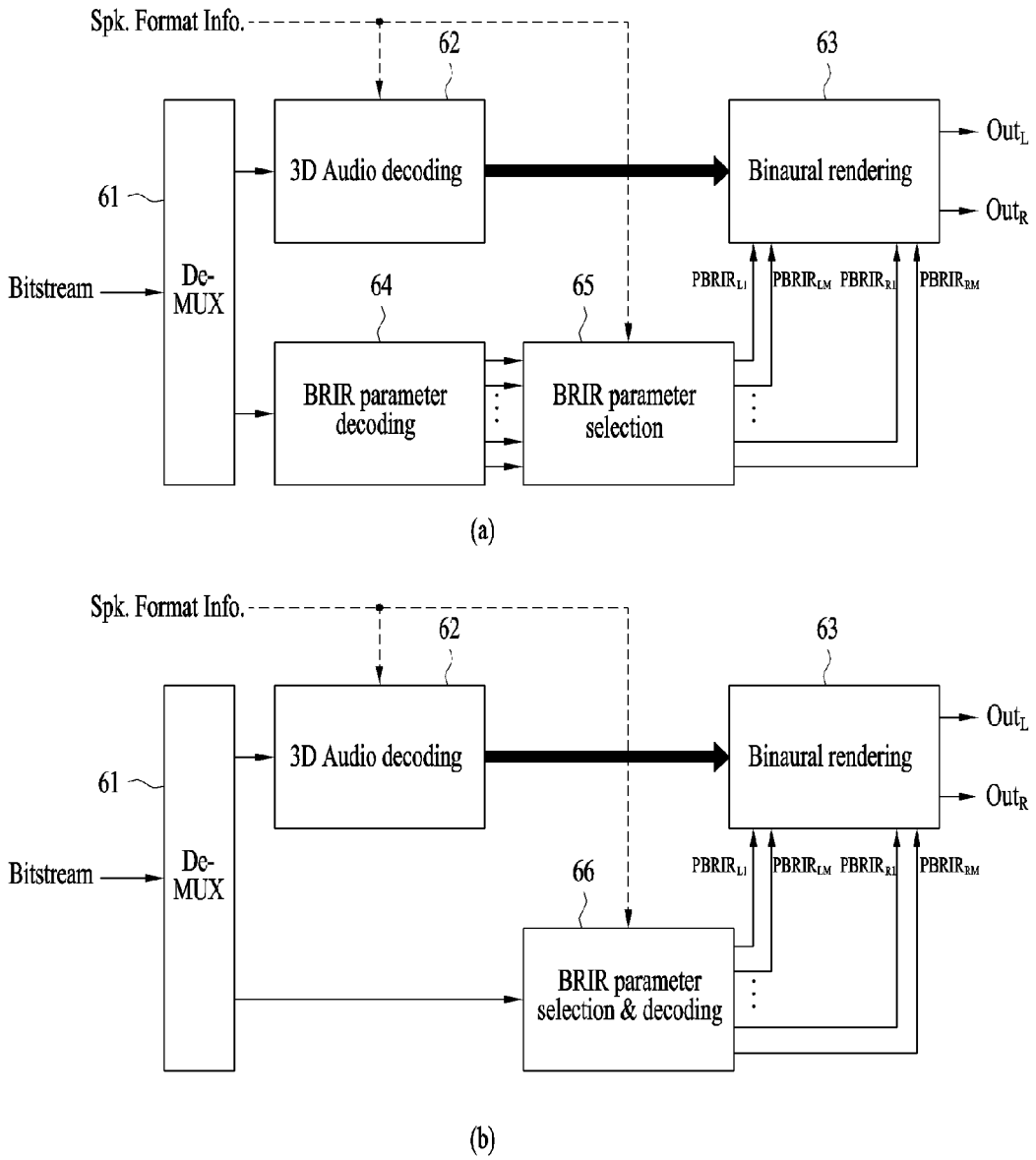
FIG. 6 illustrates a BRIR decoding operation according to the second example of the present disclosure.

FIG. 5 illustrates a BRIR encoding operation according to a second example of the present disclosure. FIG. 6 illustrates a BRIR decoding operation according to the second example of the present disclosure. That is, the above-described BRIR parameterization operation may be performed in advance in the encoding operation.

Referring to FIG. 5, the encoding operation according to the second example of the present disclosure includes a 3D audio encoder 51 (3D Audio Encoding) and a BRIR parameterizer 52 (BRIR parameterization), and a BRIR parameter encoder 53 (BRIR parameter Encoding). In other words, an input audio signal is encoded through the 3D audio encoder 51 according to an encoding format, and a parameterization operation of extracting BRIR parameters for multiple BRIRs ($BRIR_1$, $BRIR_2$, . . . , $BRIR_N$) input to the BRIR parameterizer 52 is performed. The BRIR parameter encoder 53 performs encoding on the parameterized BRIR data. A multiplexer 54 (MUX) packs the encoded audio data and BRIR data together into one bitstream and transmits the bitstream.

FIG. 6 illustrates a BRIR decoding operation according to the second example of the present disclosure. Specifically, FIG. 6(*a*) illustrates an operation of selecting only a desired BRIR parameter after decoding all BRIR parameters, and FIG. 6(*b*) illustrates an operation of decoding only the selected BRIR parameter after selecting the desired BRIR parameter.

Referring to FIG. 6(*a*), a decoder according to the second example of the present disclosure may include a de-multiplexer 61 (DeMUX), a 3D audio decoder 62 (3D Audio decoding), a BRIR parameter decoder 64 (BRIR parameter decoding), a BRIR parameter selector 65 (BRIR parameter selection), and a binaural rendering 63 (Binaural Rendering). Specifically, in FIG. 6(*a*), when a bitstream is input, the encoded audio data and BRIR parameter data are separated by the de-multiplexer 61. Then, the audio data is input to the 3D audio decoder 62 and decoded. Then, an audio signal rendered according to a configured speaker format (Spk. Format Info) is output. A separated BRIR parameter data is input to the BRIR parameter decoder 64 to reconstruct the BRIR parameters. The reconstructed BRIR parameters are then applied directly to the audio signal through the binaural renderer 63, and binaural rendered 2-channel audio signals $Out_L$, $Out_R$ are output.

FIG. 6(*b*) illustrates another decoder according to the second example of the present disclosure. Referring to FIG. 6(*b*), the de-multiplexer 61 (DeMUX), the 3D audio decoder 62 (3D Audio decoding), and the binaural renderer 63 (Binaural Rendering) are the same as those in FIG. 6(*a*). However, the BRIR parameter decoder 64 (BRIR parameter decoding) and the BRIR parameter selector 65 (BRIR parameter selection) employed in FIG. 6(*a*) are integrated to configure a BRIR parameter selection and decoding unit 66 (BRIR parameter selection & decoding). In other words, in FIG. 6(*b*), the BRIR selection and decoding unit 66 receives the speaker format information (Spk. Format Info) set by the user and selectively decodes only necessary BRIRs in BRIR decoding.

Figure 7:
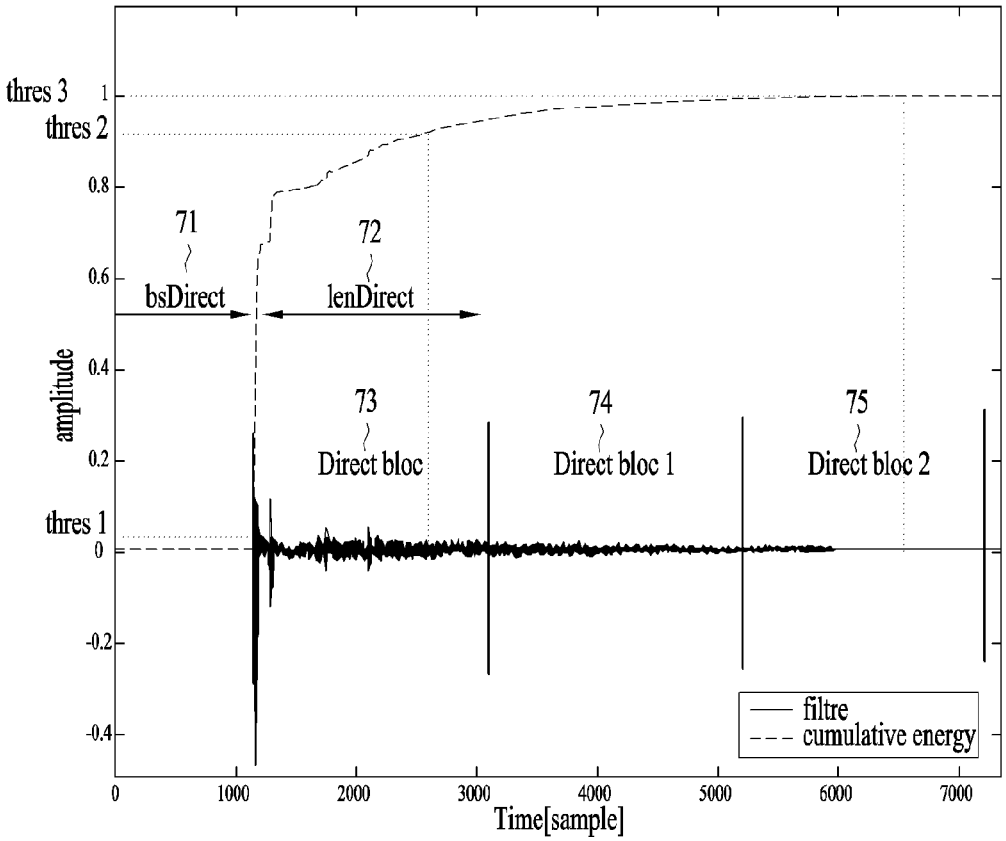
FIGS. 7 and 8 exemplarily show a BRIR parameter extraction operation applied to the present disclosure.
Figure 8:
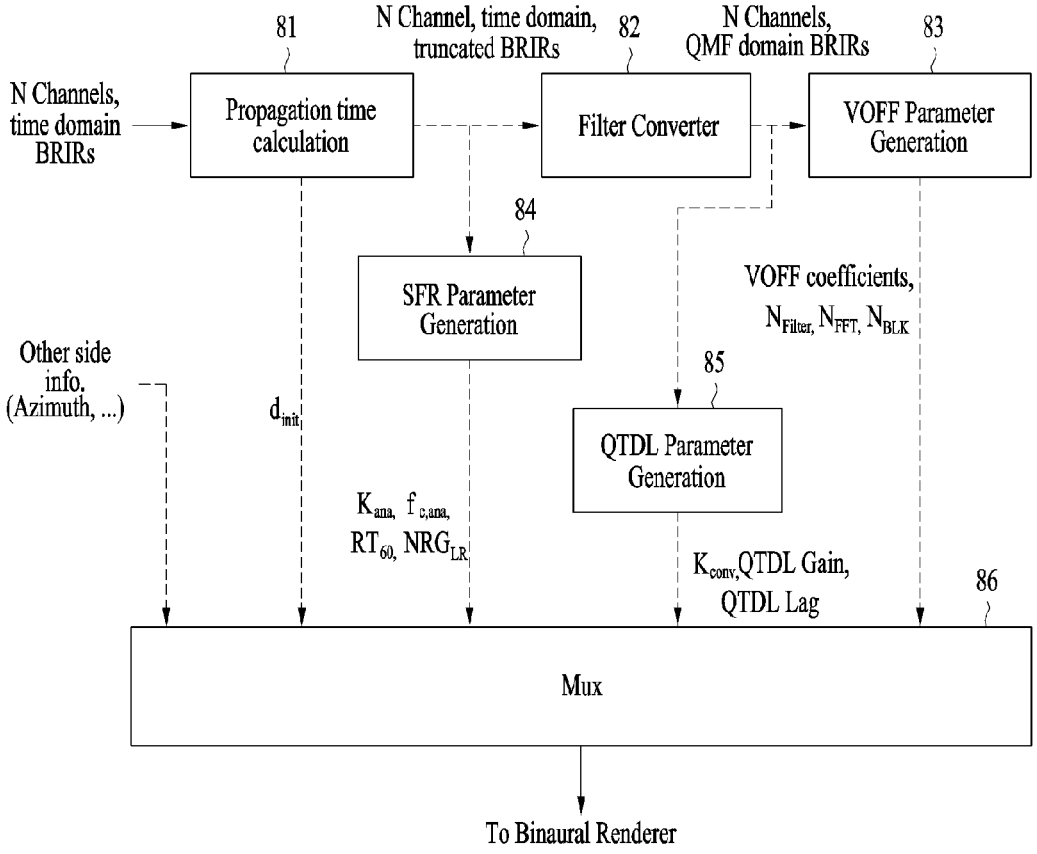

FIGS. 7 and 8 exemplarily show a BRIR parameter extraction operation applied to the present disclosure. In this regard, the above-described BRIR parameterization operation may be utilized by applying the method used in MPEG-H 3D Audio. MPEG-H 3D Audio uses two methods: "time domain binaural rendering" in the time domain and "frequency domain binaural rendering" in the frequency domain. When the "time domain binaural rendering" method is used, parameters are extracted by analyzing the BRIRs in the time domain. When the "frequency domain binaural rendering" method is used, parameters extracted by analyzing the BRIRs in the frequency domain. These methods will be described below separately.

FIG. 7 illustrates parameters extracted for the "time domain binaural rendering". For example, the parameters extracted in the time domain may include a 'propagation delay' 71, a 'direct filter block' 73 (hereinafter, 'direct block'), M 'diffuse filter blocks' 74 and 75 (hereinafter, 'diffuse blocks'), and a 'correction gain' applied to a diffuse filter.

The propagation delay 71 refers to the time required for a direct sound of a BRIR to reach the ears. In general, since all BRIRs have different propagation delays, the largest propagation delay among the BRIRs is selected as a representative value for the entire BRIRs. The 'direct block' 73 may be extracted by analyzing energy for each BRIR. The user may set a threshold of the energy to distinguishably determine the 'direct block' 73 and the 'diffuse blocks' 74 and 75. When 'direct block' 73 is selected in each BRIR, the rest of the BRIR is considered as 'diffuse blocks' 74 and 75. The 'diffuse blocks' 74 and 75 may be subdivided into M blocks by additionally applying another threshold. Since the 'diffuse blocks' 74 and 75 are allowed to maintain only rough characteristics compared to the 'direct block' 73, the diffuse blocks of all BRIRs may be averaged into one representative 'diffuse block' for computational efficiency. If one representative 'diffuse block' is considered for all BRIR 'diffuse blocks', it may not match the gain of the existing 'diffuse block'. To address this issue, a correction gain is additionally calculated to extract parameters. Therefore, when the parameterization operation is performed in this manner, the above-described four types of parameters may be extracted.

The extracted parameters are applied at binaural rendering. The 'direct blocks' 73 extracted from each BRIR are subjected to fast convolution so as to be applied to each rendering. In order to use a representative 'diffuse block' obtained in consideration of the amount of computation, the audio signal is down-mixed into a mono channel, and is then subjected to fast convolution together with the 'diffuse block'. However, the correction gain extracted as the parameter may be used as the downmix coefficient that is used in the downmix operation.

FIG. 8 illustrates parameters extracted for the "frequency domain binaural rendering". For example, parameters extracted in the frequency domain may include a 'propagation time', 'VOFF parameters' (VOFF coefficient, VOFF filter length, FFT size and number of blocks per band), 'SFR parameters' (also known as reverberator parameters, representing the number of bands for late reverberation, a center frequency of bands for late reverberation, a reverberation time, and energy)', and 'QTDL parameters (QTDL gain, QTDL time lag)'.

A propagation time calculator 81 (propagation time calculation) calculates a BRIR 'propagation time' in the time domain. The 'propagation time' has the same meaning as the 'propagation delay' extracted in the time domain parameterization operation of FIG. 7. In the frequency domain, to, the energy of the BRIR is calculated to obtain a propagation time extract the parameter 'propagation time'.

A filter converter 82 generates a QMF domain BRIR. Generally, a BRIR includes direct sound, early reflection, and late reverberation components. The components have different properties and are thus processed using different methods in binaural rendering. When the BRIR is presented in the QMF domain, three processing methods may be used for the respective components in binaural rendering. In a low frequency QMF band, variable order filtering in frequency domain (VOFF) processing (using a VOFF parameter) and sparse frequency reverberator (SFR) processing (using a 'reverberation' parameter) are used simultaneously. The above processing operations are used to filter the 'direct & early reflection' and 'late reverberation' regions of the BRIR, respectively.

A VOFF parameter generator 83 (VOFF parameter generation)) extracts VOFF parameters by analyzing an energy decay curve (EDC) of the BRIR for each frequency band. The EDC is information calculated by accumulating the energy of the BRIR over time. Therefore, by analyzing the information, the early reflection region and late reverberation region of the BRIR may be distinguished. When the early reflection and late reverberation regions are determined through the EDC, the regions are designated as a VOFF processing region and a SFR processing region, respectively to perform processing. Coefficient information corresponding to the VOFF processing region may be extracted in the QMF domain of the BRIR.

SFR parameter generation 84 is an operation of extracting, as parameters, the number of bands used, a band center frequency, a reverberation time, energy, and the like, which are used for representation of late reverberation, through the SFR processing. In this regard, a region where the SFR processing is used (that is, a region where the reverberation parameter is used) is not well recognized even through filtering. Accordingly, for such a region, a correct filter coefficient is not extracted. Instead, only main information such as energy and reverberation time is extracted by analyzing the EDC of late reverberation (that is, the region where the SFR processing is to be performed).

A QMF domain Tapped-Delay Line (QTPL) parameter generator 85 (QTPL parameter generation) performs QTPL processing on a band that is not subjected to VOFF processing and SFR processing. Since QTDL processing is also one of the rough filtering methods, the most significant gain component (generally, the largest gain component) for each QMF band and the position information abbot the component are used as parameters instead of filter coefficients.

In binaural rendering, FFT-based fast convolution is performed on the VOFF processing region to apply a VOFF coefficient to a rendered signal. In addition, in the SFR processing region, artificial reverberation is generated with reference to the reverberation time and the energy of the band, and convolutions thereof is performed on the rendered signal. In addition, for the band in which QTDL processing is performed, the extracted gain information is directly applied to the rendered signal. In general, since QTDL is performed only for a high frequency band, and humans have a poor resolution regarding recognition of high frequency components, very rough filtering may be performed for a high frequency QMF band.

In "frequency domain parameterization," parameters are extracted on a per frequency band basis. A band in which VOFF processing and SFR processing are to be performed may be directly selected from among the entire frequency bands, QTDL processing is automatically performed for the remaining bands according to the selected number of bands. In addition, the ultra-high frequency band may be such that any processing is not performed therein. Since VOFF, SFR or QTDL parameters are extracted for all bands, much more parameters are extracted than those extracted in the time domain parameterization operation.

The BRIR parameters generated by the parameter generator 81, 82, 83, 84, 85 are multiplexed with other information in the multiplexer 86 (MUX) and used as BRIR parameter data for the binaural renderer.

Figure 9:
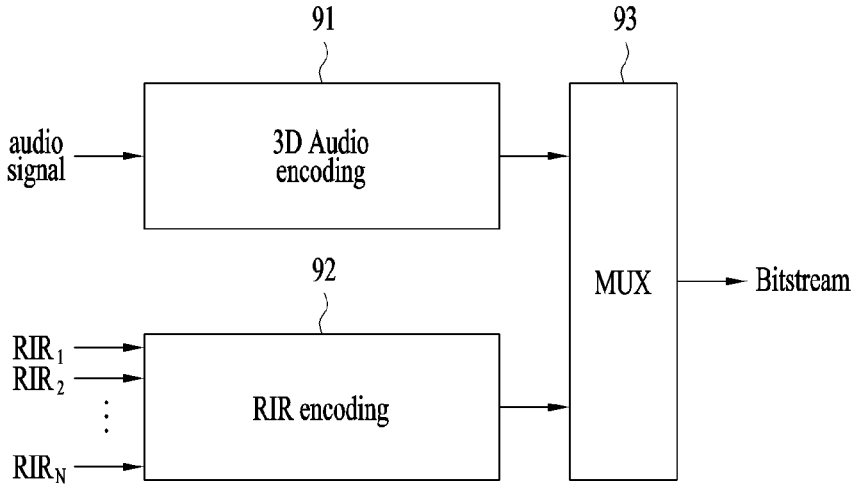
FIG. 9 illustrates an RIR encoding operation according to a third example of the present disclosure.

FIG. 9 illustrates an RIR encoding operation according to a third example of the present disclosure. FIG. 10 illustrates an RIR decoding operation according to the third example of the present disclosure.

When a transmitter transmits, over an audio signal and a bitstream, a BRIR produced or measured during production of VR audio contents by a producer, the user may experience the VR audio contents in an environment intended by the producer by filtering the BRIR from the received audio signal. In general, however, the BRIR transmitted from the transmitter is very likely to be measured by a producer or using a dummy head or the like, and therefore the transmitted BRIR may not be considered to properly reflect the unique binaural characteristics of the user. Therefore, there is a need for a method for applying, by a receiver, a BRIR suitable for all users. In the third example of the present disclosure, RIRs are encoded and transmitted in instead of BRIRs to allow all users who experience VR content to apply BRIRs optimized for the users.

Referring to FIG. 9, the encoding operation according to the third example of the present disclosure includes a 3D audio encoder 91 (3D Audio Encoding) and an RIR encoder 92 (RIR Encoding). Specifically, an input audio signal is encoded through the 3D audio encoder 91 in accordance with an encoding format, and RIR encoding is performed on multiple RIRs ($RIR_1$, $RIR_2$, . . . , $RIR_N$) by the RIR encoder. A multiplexer 93 (MUX) packs the encoded audio data and RIR data together into one bitstream and transmits the bitstream.

In this regard, similar to the BRIR, the RIR used in FIG. 9 is a response measured in a speaker format environment supported by a 3D audio encoding/decoding device. However, the RIR reflects only spatial characteristics rather than the binaural characteristics of the user. Therefore, the number of input RIRs in FIG. 9 is equal to the number of channels. For example, when an audio signal produced in a 22.2 channel environment is input, 22 RIRs are input to the RIR encoder 92.

FIG. 10 illustrates an RIR decoding operation according to the third example of the present disclosure. Specifically, FIG. 10(*a*) FIG. 10(*a*) illustrates an operation of selecting only a desired RIR after decoding all RIRs, and FIG. 3(*b*) illustrates an operation of decoding only the selected RIR after selecting the desired RIR.

Referring to FIG. 10(*a*), a decoder according to the third example of the present disclosure may include a de-multiplexer 101 (DeMUX), a 3D audio decoder 102 (3D Audio decoding), an RIR decoder 104 (RIR decoding), an RIR selector 105 (RIR selection), and a binaural renderer 103 (Binaural Rendering), which utilizes BRIR data. The decoder according to the third example of the present disclosure may also include an HRIR selector 107 (HRIR selection) configured to receive an HRIR database (DB) and user head information (user head info.) and generate HRIR data, and an HRIR modeler 108 (HRIR modeling). The decoder according to the third example of the present disclosure may further include a BRIR synthesizer 106 (Synthesizing) configured to sympathize the RIR data and HRIR data to generate BRIR data to be utilized in the binaural renderer 103. A configuration of the decoder will be described in detail below.

When a bitstream is input, audio data and RIR data are separated by the de-multiplexer 101. Then, the separated audio data is input to the 3D audio decoder 102 and decoded into an audio signal rendered so as to correspond to a configured speaker format (Spk. Format Info). The separated RIR data is input to the RIR decoder 104 and decoded.

In this regard, the HRIR selector 107 and the HRIR modeler 108 are elements separately added to the decoder in order to reflect the binaural feature information about a user who uses content. The HRIR selector 107 is a module that pre-retains an HRIR DB of various users and selects and outputs an HRIR most suitable for a user with reference to user head information additionally input from the outside. The HRIR DB is assumed to be measured in an azimuth angle range of 0° to 360° and an elevation angle range of −90° to 90° for each user. The HRIR modeler 108 is a module configured to model and output an HRIR suitable for a user with reference to the user head information and the direction information about a sound source (e.g., the position information about a speaker).

The decoder according to the third example of the present disclosure may select and use any one of the HRIR selector 107 and the HRIR modeler 108. For example, in FIGS. 10(*a*) and 10(*b*), a switch may be provided and set such that an output of the HRIR selection module 107 is used on a path 'y', and an output of the HRIR modeling module 108 is used on a path 'n'. When one of the two modules is selected, an HRIR pair corresponding to the set output speaker format is output. For example, when it is assumed that the set output speaker format is 5.1 channels, the HRIR selection module 107 or the HRIR modeling module 108 outputs five pairs of HRIRs ($HRIR_{1_L}$, $HRIR_{1_R}$, . . . , $HRIR_{5_L}$, $HRIR_{5_R}$). The speaker format information (Spk. Format Info) may also be referred to by the RIR selector 105 (RIR selection) to output only related RIRs (e.g., RIRs measured at a configured speaker format position). Similarly, when it is assumed that the set output speaker format is 5.1 channels, 5 RIRs ($RIR_1$, $RIR_2$, . . . , $RIR_5$) are output. The output HRIR pairs and RIRs are synthesized by the BRIR synthesizer 106 to generate a BRIR. In the synthesizing operation through the BRIR synthesizer 106, only an HRIR pair and an RIR corresponding to the same speaker position may be used. For example, when 5 pairs of HRIRs and RIRs prepared with reference to the 5.1-channel speaker format are synthesized, $RIR_1$ is applied only to $HRIR_{1_L}$ and $HRIR_{1_R}$ to output a BRIR pair of $BRIR_{1_L}$ and $BRIR_{1_R}$, and $RIR_5$ is applied only to $HRIR_{5_L}$, and $HRIR_{5_R}$ to output another BRIR pair of $BRIR_{5_L}$ and $BRIR_{5_R}$. Therefore, when a speaker format is set to 5.1 channels, 5 pairs of BRIRs in total are synthesized and output. The output multiple BRIR pairs are filtered to the audio signal by the binaural renderer 103 (binaural rendering), and thus final binaural rendered signals $Out_L$/$Out_R$ are output.

FIG. 10(*b*) illustrates another decoder according to the third example of the present disclosure. Referring to FIG. 10(*b*), the de-multiplexer 101 (DeMUX), the 3D audio decoder 102 (3D Audio decoding), the binaural renderer 103 (Binaural Rendering), the HRIR selector 107 (HRIR selection), the HRIR modeler 108 (HRIR modeling), and the BRIR synthesizer 106 (Synthesizing) are the same as in FIG. 10(*a*). However, the RIR decoder 104 (RIR decoding) and the RIR selector 105 (RIR selection) employed in FIG. 10(*a*) are integrated to configure an RIR selection and decoding unit 109 (RIR selection & decoding). In other words, in FIG. 10(*b*), the RIR selection and decoding unit 109 receives the speaker format information (Spk. Format Info) set by the user and selectively decodes only necessary RIRs.

Figure 11:
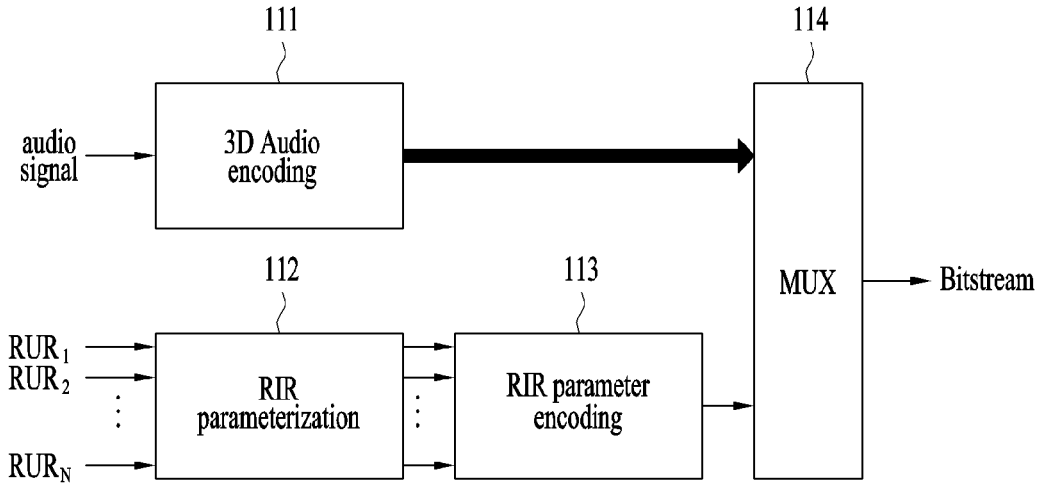
FIG. 11 illustrates an RIR encoding operation according to a fourth example of the present disclosure.

FIG. 11 illustrates an RIR encoding operation according to a fourth example of the present disclosure. FIG. 12 illustrates an RIR decoding operation according to the fourth example of the present disclosure. In the fourth example of the present disclosure, the RIR parameterization operation in FIGS. 10 and 11 (the third example) is performed in advance in the encoding operation.

For RIRs input to the encoder, main feature information about the RIRs may be extracted and encoded for computational efficiency. Therefore, since the RIRs are reconstructed by the decoder in the form of parameters, they may not be directly synthesized with the filter coefficients of the HRIR. A fourth example of the present disclosure proposes a method for applying a method for encoding and decoding RIR parameters to VR audio decoding.

Referring to FIG. 11, the encoding operation according to the fourth example of the present disclosure includes a 3D audio encoder 111 (3D Audio Encoding), an RIR parameterizer 112 (RIR parameterization), and an RIR parameter encoder 113 (RIR parameter Encoding). In other words, an input audio signal is encoded through the 3D audio encoder 111 according to an encoding format, and a parameterization operation of extracting RIR parameters for multiple RIRs ($RIR_1$, $RIR_2$, . . . , $RIR_N$) input to the RIR parameterizer 112 is performed. The RIR parameter encoder 113 performs encoding on the parameterized RIR data. A multiplexer 114 (MUX) packs the encoded audio data and RIR data together into one bitstream and transmits the bitstream. This operation will be described in detail below.

The RIR parameterization operation of FIG. 11 is similar to the BRIR parameterization operation of FIG. 5 described above. That is, like the BRIR, a response of RIR includes 'direct', 'early reflection' and 'late reverberation' components. The RIR response may be applied in the time domain in a similar manner to FIG. 7 described above, and may be applied in the frequency domain (e.g., QMF domain) in a similar manner to FIG. 8. That is, the above-described BRIR parameterization operation may be used in the same manner in extracting the RIR parameters. Accordingly, the RIR parameter generator 112 of FIG. 11 may also extract parameters based on the time domain parameterization and frequency domain parameterization. The extracted parameters are input to the RIR parameter encoder 113 so as to be encoded. The RIR parameters may be encoded in the same manner as when the BRIR parameters of FIG. 5 described above are encoded. The encoded RIR parameter data is multiplexed with the encoded audio data and transmitted in a bitstream.

FIG. 12 illustrates an RIR decoding operation according to the fourth example of the present disclosure. Specifically, FIG. 12(*a*) illustrates an operation of selecting a desired BRIR parameter and decoding only the selected BRIR parameter, and FIG. 12(*b*) illustrates an operation of selecting only a desired BRIR parameter after decoding all BRIR parameters.

Referring to FIG. 12(*b*), a decoder according to the second example of the present disclosure may include a de-multiplexer 121 (DeMUX), a 3D audio decoder 122 (3D Audio decoding), an RIR parameter decoder 128 (RIR parameter decoding), an RIR parameter selector 129 (RIR parameter selection), and a binaural renderer 123 (Binaural Rendering). The decoder according to the fourth example of the present disclosure may also include an HRIR selector 126 (HRIR selection) configured to receive an HRIR DB and user head information (user head info.) and generate HRIR data, and an HRIR modeler 127 (HRIR modeling). The decoder according to the fourth example of the present disclosure may further include a synthesizer 124 (synthesizing) configured to perform binaural rendering based on the HRIR data and sympathize the RIR data for an output signal of the binaural renderer 123 to output final rendered 2-channel audio signals Out and $Out_R$.

FIG. 12(*a*) illustrates another decoder according to the fourth example of the present disclosure. Referring to FIG. 12(*a*), the de-multiplexer 121 (DeMUX), the 3D audio decoder 122 (3D Audio decoding), the binaural renderer 123 (Binaural Rendering), the HRIR selector 126 (HRIR selection), the HRIR modeler 127 (HRIR modeling), and the synthesizer 124 (Synthesizing) are the same as those of FIG. 12(*b*). However, in FIG. 12(*a*), the RIR parameter decoder 128 (RIR parameter decoding) and the RIR parameter selector 129 (RIR parameter selection) employed in FIG. 12(*b*) are integrated to configured the RIR parameter selection and decoding unit 125 (RIR parameter selection & decoding). In other words, in FIG. 12(*a*), the RIR selection and decoding unit 125 receives the speaker format information (Spk. Format Info) set by the user and selectively decodes only necessary RIRs in RIR decoding. This operation will be described in detail below.

FIG. 12(*a*) illustrates the entire decoding and rendering operations for playback of VR audio. The bitstream input to the decoder is separated into audio data and RIR parameter data by the de-multiplexer 121 (DeMUX). The RIR parameter data is decoded by the RIR parameter selection and decoding unit 125 to reconstruct RIR parameters.

The HRIR data may be obtained using one of the HRIR selector 126 (HRIR selection) and the HRIR modeler 127 (HRIR modeling). The two modules 126 and 127 are intended to provide the most suitable HRIR for the user with reference to the user head information and speaker format information as input information. Accordingly, when the speaker format is selected as 5.1 channels, 5 pairs of HRIRs ($HRIR_{1_L}$, $HRIR_{1_R}$, . . . , $HRIR_{1_L}$, $HRIR_{5_R}$) are generated and provided. The provided HRIR pairs are then applied to a decoded audio signal output with reference to the speaker format by the 3D audio decoder 122. For example, when it is assumed that the selected speaker format is 5.1 channels, five channel signals and one woofer signal are rendered and output by the 3D audio decoder 122, and the HRIR pairs are applied so as to correspond to the speaker format position. In other words, when it is assumed that the output signals of 5.1 channels are sequentially referred to as $S_1$, $S_2$, . . . , $S_5$ (except for the woofer), $HRIR_{1_L}$ and $HRIR_{1_R}$ are filtered only to $S_1$ to output $SH_{1_L}$ and $SH_{1_R}$, and $HRIR_{5_L}$ and $HRIR_{5_R}$ are filtered only to S5 to output $SH_{5_L}$ and $SH_{5_R}$.

Even when the signals output from the binaural renderer 123 (Binaural Rendering)) are played directly through headphones, 3D audio may be experienced. However, the audio may be less realistic because only binaural feature information about the user is reflected. Therefore, in order to add a sense of realism to the signal output from the binaural renderer 123, parameters obtained by extracting the feature information of the RIR may be applied. In FIG. 12, the synthesizer 124 (Synthesizing) outputs a more realistic audio signal by applying RIR parameters to signals $SH_{1_L}$, $SH_{1_R}$, . . . , $SH_{5_L}$, $SH_{5_R}$ to which only HRIRs are filtered.

The RIR parameters used as inputs to the synthesizer 124 may be selected with reference to, for example, a playback speaker format after decoding all RIR parameters (128 and 129 in FIG. 12(*b*)). Alternatively, the RIR parameters may be selected with reference to the playback speaker format, and then decoded (125 in FIG. 12(*a*)). The selected parameters are applied to the binaural rendered signal by the synthesizer 124.

Figure 13:
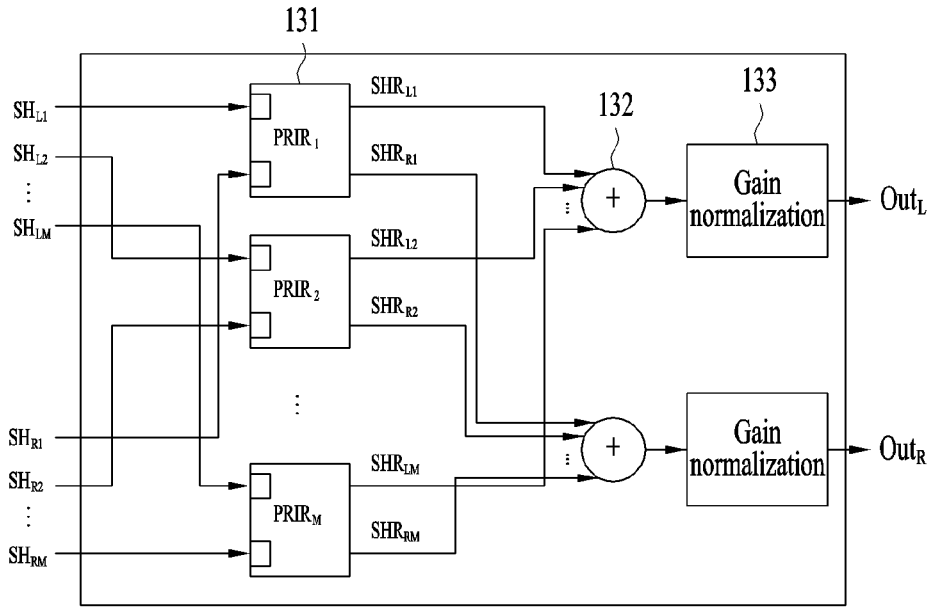
FIG. 13 exemplarily shows an audio output signal synthesis operation applied to the fourth example of the present disclosure.

Hereinafter, a synthesis operation of the synthesizer 124 applied to the present disclosure will be described with reference to FIG. 13. First, even the RIR parameters may be applied so as to correspond to the speaker format position. For example, when the RIR parameters selected by the 5.1-channel speaker format are $PRIR_1$, $PRIR_2$, . . . , and $PRIR_5$ (131), $PRIR_1$ is applied only to $SH_{1_L}$ and $SH_{1_R}$ to output $SHR_{1_L}$ and $SHR_{1_R}$, and $PRIR_{5_R}$ is applied only to $SH_{5_L}$ and $SH_{5_R}$ to output $SHR_{5_L}$ and $SHR_{5_R}$. Then, $SHR_{1_L}$, . . . , and $SHR_{5_L}$ are added (132), and a final signal $Out_L$ is output through gain normalization 133. In addition, $SHR_{1_R}$, . . . , and $SHR_{5_R}$ are added (132), and a final signal $Out_R$ is output through gain normalization 133. The audio output signals $Out_L$ and $Out_R$ reflect not only unique head feature information about the user but also spatial information intended by the producer, and therefore the user may experience more realistic 3D audio.

In this regard, the transmission scheme for the BRIRs and RIRs applied to the first to fourth examples of the present disclosure described above is effective only in the case of 3DoF. That is, 3D audio may be experienced only when the user's position is fixed. In order to use the BRIRs and RIRs even in the case of 6DoF, that is, to experience 3D audio while moving freely in a space, all BRIR/RIR should be measured in a range of movement of the user, and the VR audio encoding/decoding device should detect position change information about the user to apply an appropriate BRIR/RIR to the audio signal according to change in position of the user. FIG. 14 illustrates 3DoF and 6DoF applied to the present disclosure. Specifically, FIG. 14 intuitively illustrates the range in which the user is allowed to move in 3DoF and 6DoF.

FIG. 14 illustrates a 10.2-channel speaker environment as an example. FIG. 14(*a*) shows a range of movement of a user in a 3DoF environment. FIG. 14(*b*) shows a range of movement of the user in a 6DoF environment.

That is, the range of movement of the user is fixed to only one position 141 in FIG. 14(*a*), whereas in FIG. 14(*b*), the user is allowed to move not only to the fixed position 141 but also various positions 142 (all parts indicated by dots) surrounded by multichannel speakers. Therefore, in order for the VR Audio encoding/decoding device to support 6DoF, BRIRs/RIRs measured at numerous positions 142 exemplarily shown in FIG. 14(*b*) are needed. In this regard, a method of measuring BRIRs/RIRs in a 10.2 channel speaker environment will be described below with reference to FIGS. 14(*a*) and 14(*b*).

The small dots in FIG. 14 may be understood as points at which BRIRs/RIRs are measured. In FIG. 14(*b*), there are many measurement points, and thus the measurement points are divided by layers. While FIG. 14(*b*) shows only three layers 143, 144, and 145 of the measurement points of the BRIRs/RIRs, this is merely an example. Measurement may be performed even between layers. In general, speakers are disposed at the same distance from the user's position, except for the subwoofer speakers. Therefore, the user may be assumed to be at the center of all speakers, and the BRIR/RIR may be measured only at one position 141 as shown in FIG. 14(*a*) when the user wants to experience 3DoF VR audio. However, when the user wants to experience 6DoF VR audio, it is necessary to measure the BRIRs/RIRs at equal intervals within the range surrounded by the speakers as shown in FIG. 14(*b*). Unlike 3DoF, 6DoF requires BRIRs/RIRs to be measured not only in the horizontal plane but also in the vertical plane. As the number of measured BRIR/RIRs increases, the performance may be expected to be enhanced. However, considering efficiency of computation and storage space in using BRIRs/RIRs, it is necessary to secure proper intervals.

The BRIR/RIRs are measured or produced by the producer at numerous positions in a space, but the 6DoF playback environment for the user may differ from the environment in which the producer has produced the BRIRs/RIRs. For example, the producer may set the distance between the user and the speakers to 1 m and measures BRIRs/RIRs (assuming that the user moves only within a radius of 1 m) in consideration of the speaker format specification, but the user may be in a space in which the user is allowed to move more than 1 m. For simplicity, it is assumed that the user is allowed to move within a range of a radius of 2 m. Therefore, the user's space is twice as large as the response environment measured by the producer. Considering this case, it should be allowed to change the measured response characteristics based on the information about the positions at which BRIRs/RIRs are measured and a distance that the user is allowed to move. In this regard, the response characteristics may be changed using the following two methods. A first method is to change the response gain of the BRIRs/RIRs, and the second method is to change the response characteristics by adjusting the Direct/Reverberation (D/R) ratio of the BRIRs/RIRs.

In the first method, it may be considered that the distances of all measured responses in the playback environment for the user are up to twice larger than the distance in the producer's response measurement environment. Therefore, the measured response gain is changed by applying the inverse square law, which states that the size of a sound source is inversely proportional to the square of a distance. A basic equation conforming to the inverse square law is represented as Equation 1.

$$\frac{\text{Gain}_1}{\text{Gain}_2} = \frac{Dist_2^2}{Dist_1^2} \qquad \text{Equation 1}$$

In Equation 1, $\text{Gain}_1$ and $\text{Dist}_1$ denote a gain and a distance between sound sources for a response measured by the producer, and $\text{Gain}_2$ and $\text{Dist}_2$ denote a gain and a distance between sound sources for a changed response. Thus, using Equation 2, the gain of the changed response may be obtained.

$$\text{Gain}_2 = \left(\frac{Dist_1}{Dist_2}\right)^2 \text{Gain}_1 \qquad \text{Equation 2}$$

A second method is a method of changing the D/R ratio of Equation 3 given below.

$$D/R = \frac{P_D}{P_R} = \frac{\int_0^{t_1} h^2(t)dt}{\int_{t_1}^{t} h^2(t)dt} \qquad \text{Equation 3}$$

In Equation 3, the numerator of the D/R ratio denotes the power of the "direct part", and the denominator denotes the power of the "early reflection part" and the "late reverberation part". Here, h(t) denotes the response of BRIR/RIR, and $t_1$ denotes the time taken from the start of measurement of a response to measurement of the "direct part". In general, the D/R ratio is calculated in dB. As can be seen from the equation, the D/R ratio is controlled with the ratio of the power PD of the "direct part" to the power PR of the "early reflection part" and "late reverberation part". Changing this ratio may change the characteristics of the BRIR/RIR, thereby changing the sensed distance.

The method of adjusting the D/R ratio may also be applied as a representative method used in distance rendering. To change the sensed distance between the user and the sound source to a closer distance, the gain of the "direct part" of the response may be adjusted to increase. To change the sensed distance to a farther distance, the gain of the "direct part" may be adjusted to decrease. In general, when the distance is doubled, the D/R ratio is reduced by 6 dB. Accordingly, when the range of movement of the user is twice as wide as the one measured by the producer, as previously assumed, the power of the "direct part" of the previously measured BRIR/RIR may be reduced by 3 dB or the power of the "early reflection" and "late reverberation part" may be increased by 3 dB to change the characteristics of the BRIR/RIR to characteristics similar to response characteristics measured at a farther distance. Considering that the user may change the sense of distance using the D/R ratio, the producer may pre-provide the $t_1$ values of all BRIR/RIRs (the time taken to measure the direct part from the start of the response), or $t_1$ information about all BRIR/RIRs may be extracted using the parameterization method described above. Hereinafter, various examples for efficiently use of BRIRs/RIRs in a 6DoF environment according to the present disclosure will be described.

Figure 15:
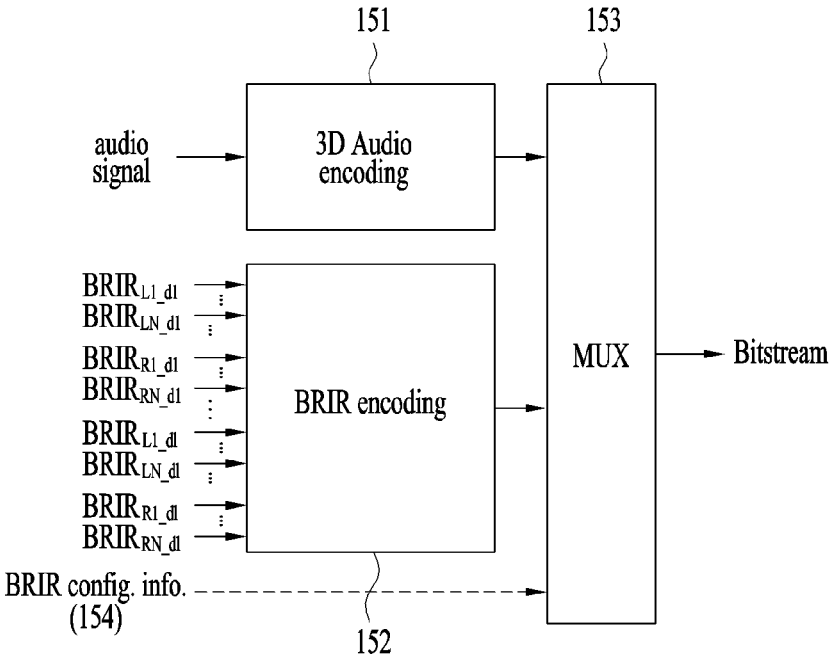
FIG. 15 illustrates a BRIR encoding operation in a 6DoF environment according to a fifth example of the present disclosure.

FIG. 15 illustrates a BRIR encoding operation in a 6DoF environment according to a fifth example of the present disclosure. FIG. 16 illustrates a BRIR decoding operation in a 6DoF environment according to the fifth example of the present disclosure.

The encoding modules and operations shown in FIG. 15 are all similar to the operations in the 3DoF environment of FIG. 2 described above. Initially, a 3D audio decoder 151 encodes an input audio signal to generate an encoded audio signal. However, the BRIRs input to a BRIR encoder 152 (BRIR encoding) are not BRIRs for one point (in 3DoF), but many BRIRs measured at various points (in 6DoF) as shown in FIG. 14(*b*). For example, when BRIRs are measured at 10 points in a 5.1-channel speaker environment, the number of BRIRs input to the BRIR encoder 152 (BRIR encoding) is 100 (2×5×10) in total (except for a response to a woofer speaker). $BRIR_{Ln_di}$ input to the BRIR encoder 152 denotes a BRIR for the left ear for the n-th speaker at a point di in a speaker format environment arranged in a space. Unlike encoding at 3DoF, BRIR configuration information 154 is additionally input in encoding at 6DoF. The configuration information includes position information and response feature information (e.g., $t_1$ information in Equation 3, reverberation time, etc.) about BRIRs input to the BRIR encoder 152, and spatial feature information (e.g., the structure and size of the space) about measurement of the BRIRs. The BRIR encoder 152 may perform encoding using the same encoding method as used for encoding in 3DoF. Once the BRIRs for all points are encoded, a multiplexer 153 (MUX) packs the encoded audio signal, the BRIR configuration information 154, and the encoded BRIR data together into one bitstream and transmits the bitstream.

FIG. 16(*a*) illustrates a decoding operation at 6 DoF, according to the fifth example of the present disclosure. A de-multiplexer 161 (De-MUX) extracts the encoded audio data, the BRIR data, and the BRIR configuration info from the input bitstream. The encoded audio data is input to a 3D audio decoder 162, and is then decoded and rendered with reference to the configured speaker format (Spk Format info.). The BRIR data is input to a BRIR decoder 164 to reconstruct all BRIRs. The reconstructed BRIRs are input to a BRIR selection and adjustment unit 165 (BRIR selection & adjustment) to select and output only BRIRs necessary for playback. In addition, the BRIR selection and adjustment unit 165 checks whether the range of a space in which the user is allowed to move is similar to the range in which the BRIRs are measured by the producer, with reference to the environmental information (e.g., space size information, movement range information, etc.) received from the outside and the BRIR configuration information 154. When the range in which the user is allowed to move is different from the range in which the BRIRs are measured, the measured BRIR characteristics are changed using the above-described method of changing BRIR response characteristics. For example, when it is assumed that the range in which the user is allowed to move is 2 m from a center point and the range in which BRIRs are measured is 1 m from the center point, the power of the "direct part" of the measured BRIR is reduced by 3 dB or the power of the "early reflection part" and "late reverberation part" is increased by 3 dB. Then, the BRIRs measured at the closest point are selected and output based on the user position info. For example, when it is assumed that the configured speaker format is 5.1 channels as in the environment assumed in 3DoF, five pairs of BRIRs ($BRIR_{L1}$, $BRIRR_{R1}$, . . . , $BRIR_{L5}$, $BRIR_{R5}$) are selected and output for a point in the BRIR selection 165. The selected BRIRs are input to the binaural renderer 163 (binaural rendering) to filter the audio signal and output final binaural rendered 2-channel audio output signals $Out_L$ and $Out_R$.

Compared to the example of FIG. 16(*a*), the example of FIG. 16(*b*) integrates the BRIR decoder 164 (BRIR decoding) and the BRIR selection and adjustment unit 165 (BRIR selection& adjustment) into a BRIR selection and decoding unit 166 (BRIR selection & decoding). The BRIR selection and decoding unit 166 selectively decodes only BRIRs necessary for the binaural rendering by referring to the speaker format information (Spk. Format info) configured in the decoding operation in BRIR decoding in advance.

Figure 17:
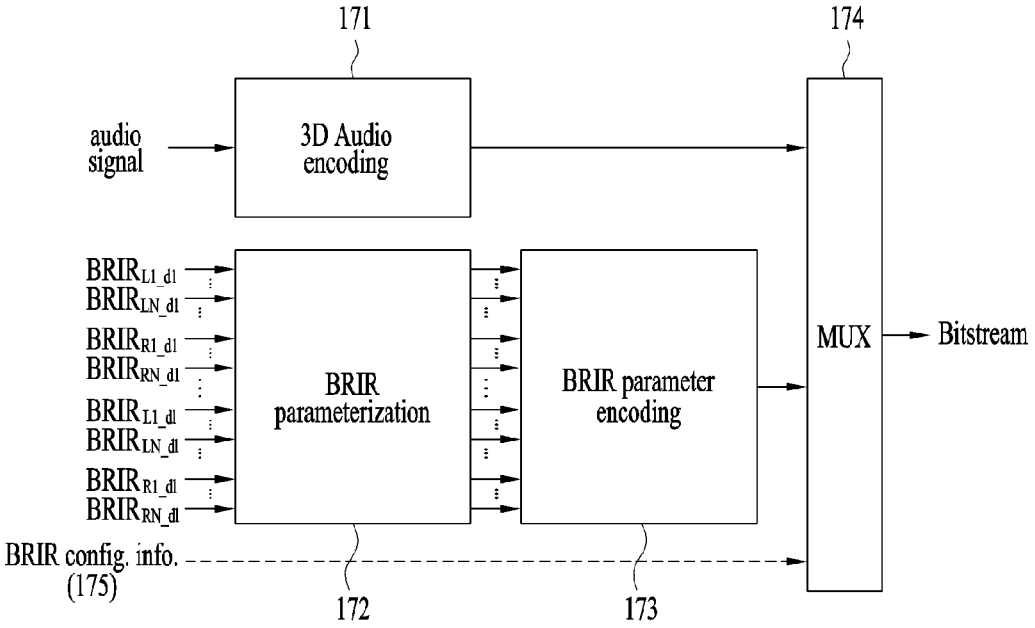
FIG. 17 illustrates a BRIR encoding operation in a 6DoF environment according to a sixth example of the present disclosure.
Figure 18:
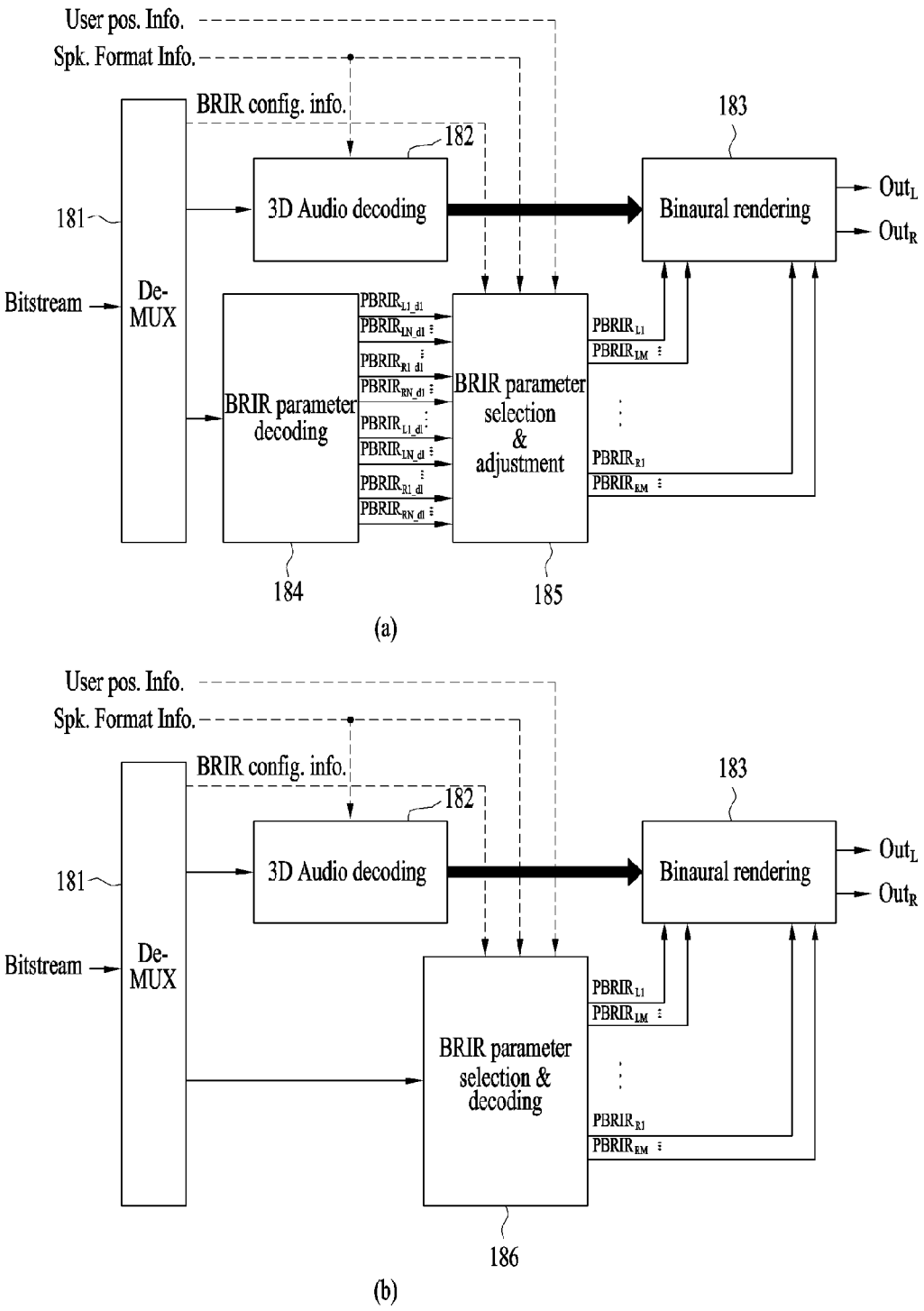
FIG. 18 illustrates a BRIR decoding operation in a 6DoF environment according to the sixth example of the present disclosure.

FIG. 17 illustrates a BRIR encoding operation in a 6DoF environment according to a sixth example of the present disclosure. FIG. 18 illustrates a BRIR decoding operation in a 6DoF environment according to the sixth example of the present disclosure.

FIG. 17 illustrates the example of FIG. 5 for 3DoF environment in consideration of the 6DoF environment. In FIG. 17, a BRIR parameter generator 172 (BRIR parameterization) extracts parameters from the information of all input BRIRs, and the extracted parameters are encoded by a BRIR parameter encoder 173 (BRIR parameter encoding). The encoding operation of the BRIR parameter encoder 173 may be substantially the same as that of the BRIR parameter encoder 53 of FIG. 5 except for data amount.

A multiplexer 174 (MUX) packs the encoded BRIR parameter data, the BRIR configuration information (BRIR config. Info) 175, and the audio data encoded by the 3D audio encoder 171 (3D Audio encoding) into a bitstream and transmits the bitstream.

FIGS. 18(*a*) and 18(*b*) are similar to the operations of FIGS. 16(*a*) and 16(*b*) except that parameters for the BRIRs are transmitted. Specifically, FIG. 18(*a*) illustrates a decoding operation in a 6DoF environment according to the sixth example of the present disclosure. A de-multiplexer 181 (De-MUX) extracts the encoded audio data, the BRIR parameter data, and the BRIR configuration info from the input bitstream. The encoded audio data is input to a 3D audio decoder 182, and is then decoded and rendered with reference to the configured speaker format (Spk Format info.). The BRIR parameter data is input to a BRIR parameter decoder 184 to reconstruct all BRIR parameters. The reconstructed BRIR parameters are input to a BRIR parameter selection and adjustment unit 185 to select and output only BRIR parameters necessary for playback. In addition, the BRIR parameter selecting and adjusting unit 185 checks whether the range of a space in which the user is allowed to move is similar to the range in which the BRIRs are measured by the producer, with reference to environmental information (e.g., space size information, movement range information, etc.) received from the outside and the BRIR configuration information 175. When the range in which the user is allowed to move is different from the range in which the BRIRs are measured, the measured BRIR characteristics are changed using the above-described method of changing BRIR response characteristics. The selected BRIR parameters are input to a binaural renderer 183 (binaural rendering) to filter the audio signal and output final binaural rendered 2-channel audio output signals $Out_L$ and $Out_R$.

Compared to the example of FIG. 18(*a*), the example of FIG. 18(*b*) integrates the BRIR parameter decoder 184 (BRIR parameter decoding) and the BRIR parameter selection and adjustment unit 185 (BRIR parameter selection & adjustment) into a BRIR parameter selection and decoding unit 186 (BRIR parameter selection & decoding). The BRIR parameter selection and decoding unit 186 selectively decodes only BRIR parameters necessary for the binaural rendering by referring to the speaker format information (Spk. Format info) configured in the decoding operation in the BRIR decoding in advance.

Figure 19:
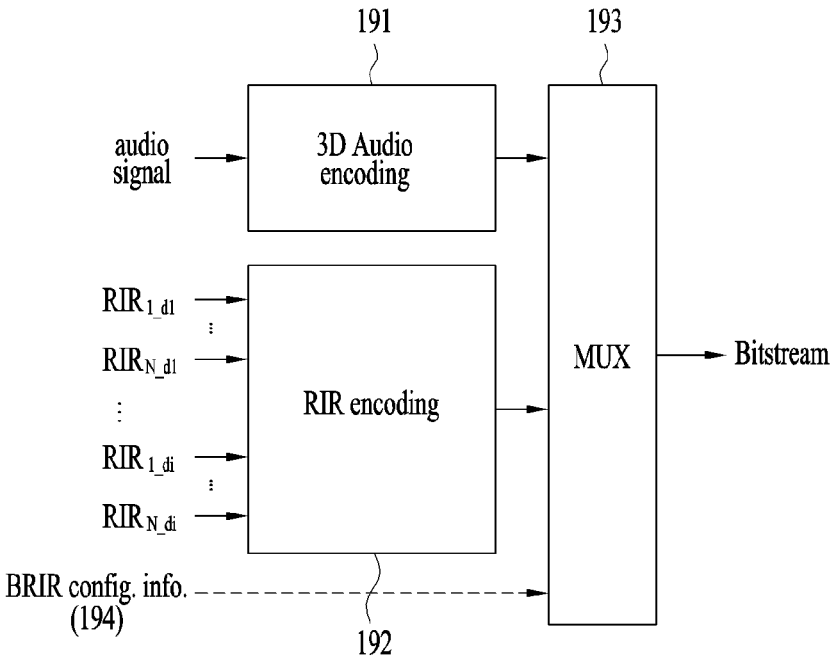
FIG. 19 illustrates an RIR encoding operation in a 6DoF environment according to a seventh example of the present disclosure.
Figure 20:
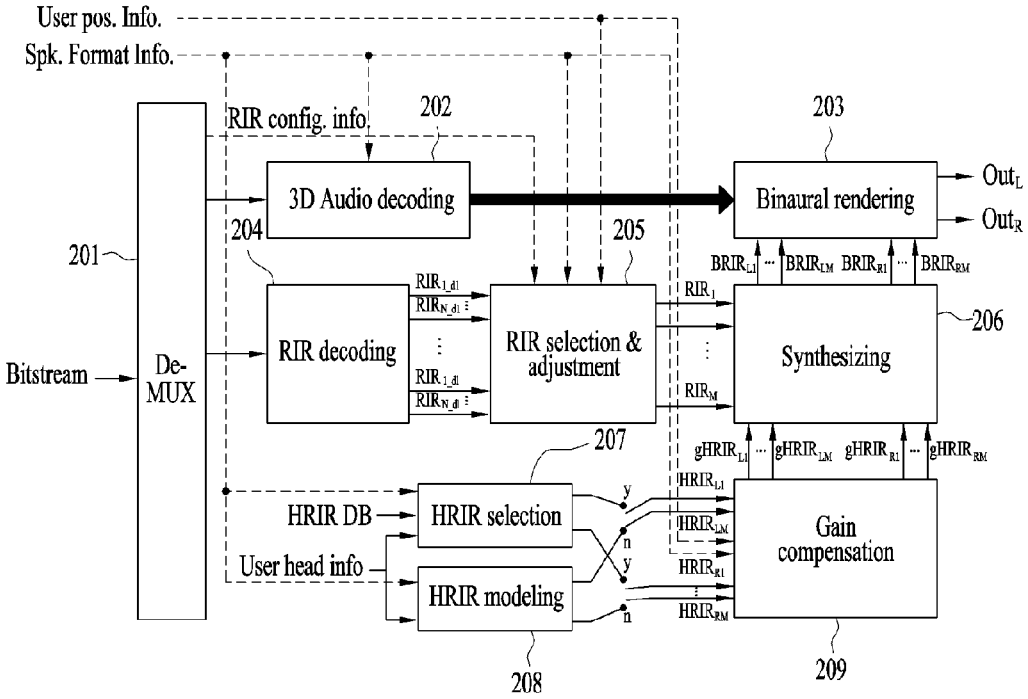
FIGS. 20 and 21 illustrate an RIR decoding operation in a 6DoF environment according to the seventh example of the present disclosure.
Figure 21:
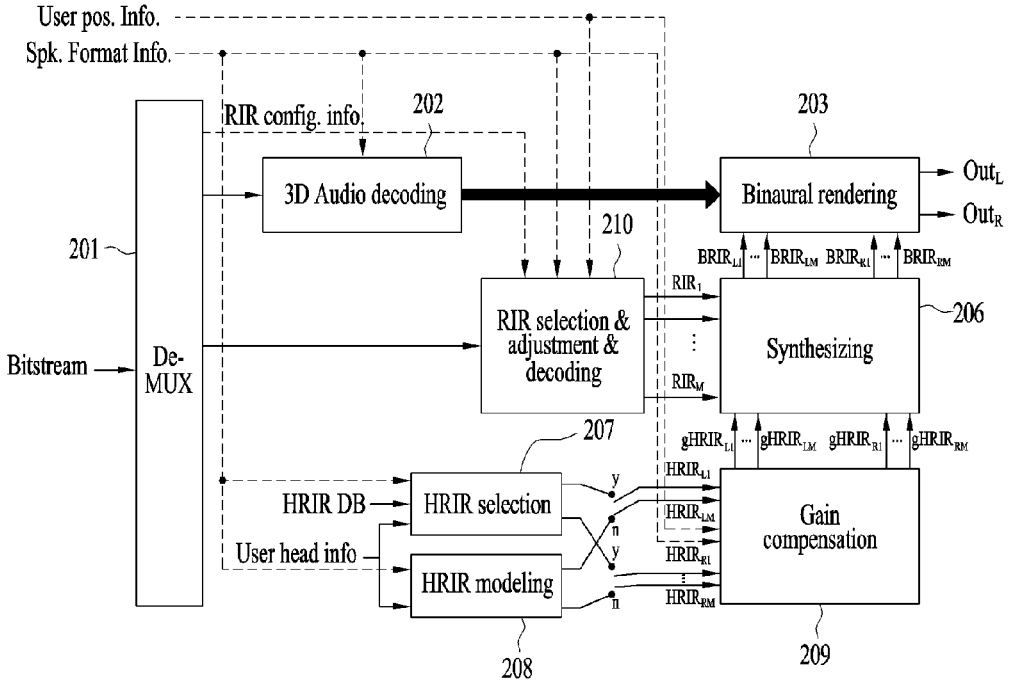

FIG. 19 illustrates an RIR encoding operation in a 6DoF environment according to a seventh example of the present disclosure. FIGS. 20 and 21 illustrate an RIR decoding operation in a 6DoF environment according to the seventh example of the present disclosure.

Referring to FIG. 19, RIRs measured or produced in a space intended by a producer are input to and encoded by an RIR encoder 192. RIRs are measured at various points for 6DoF, only one RIR is measured at a time. However, only one RIR rather than a pair of BRIRs is measured at a time. For example, when it is assumed that RIRs are measured at 10 points in a 5.1-channel speaker environment, 50 (1×5×10) RIRs are input to an RIR encoder 192 (RIR encoding) (except for a response to a woofer speaker). In FIG. 19, RIR configuration information 194 is input. Similar to the BRIR configuration information 154 described above, the information 194 includes measurement position information and response feature information (e.g., $t_1$ information in Equation 3, reverberation time, etc.) about the RIRs, and spatial feature information (e.g., the structure and size of the space) about measurement of the RIRs. The RIR configuration information 194 is input to a multiplexer 193 (MUX) together with the audio data and the RIR data encoded by the 3D audio encoder 191 (3D Audio encoding), and then packed and transmitted in a bitstream.

The overall decoding operation of FIG. 20 is similar to FIG. 10(*a*) applied to a 3DoF environment. However, the example of FIG. 20 receives user position information from the outside to support 6DoF. The input bitstream is input to the de-multiplexer 201 (De-MUX), and the audio data, RIR data, and RIR configuration information 194 are extracted therefrom. The extracted audio data is decoded and rendered with reference to the speaker format information (Spk. format info) by a 3D audio decoder 202 (3D audio decoding) to output a multichannel signal. In addition, the extracted RIR data is input to an RIR decoder 204 to reconstruct all RIRs. The reconstructed RIRs are input to an RIR selection and adjustment unit 205 (RIR selection & adjustment) to select and output an RIR corresponding to a speaker position with reference to the configured speaker format. In this regard, the RIR selection and adjustment unit 205 checks whether the range of a space in which the user is allowed to move is similar to the range in which the RIRs are measured by the producer, with reference to the environmental information (e.g., space size information, movement range information, etc.) and the RIR configuration information 194, as in the procedure carried out by the BRIR selection and adjustment unit 165 (BRIR selection & adjustment) of FIG. 16(*a*). When necessary, the unit changes the response characteristics of the measured RIRs. Then, the RIRs measured at the closest point are selected and output based on the user position info. For example, when a 5.1-channel environment is assumed, five RIRs ($RIR_1$, $RIR_2$, . . . , $RIR_5$) are output in RIR selection & adjustment.

Since the RIR does not contain binaural information about the user, two HRIR generation modules 207 and 208 are used to generate HRIR pairs suitable for the user. In general, HRIRs are measured only once for all directions. Therefore, when the user moves in any space as in the case of 6DoF, the distances from the sound sources vary, and accordingly using the existing HRIRs may locate the sound source at an incorrect position. In order to address this issue, it is necessary to input all HRIRs to a gain compensator 209 (gain compensation) to change the gain of the HRIRs with reference to the distance between the user and the sound source. The information about the distance between the user and the sound source may be checked through user position information and speaker format information input to the gain compensator 209 (gain compensation). For the output HRIR pairs, different gains may be applied according to the position of the user. For example, in a 5.1-channel speaker format environment, when the user moves forward, the movement means that distance to the speakers Left, Center, and Right in front of the user becomes shorter, and thus the gain of the HRIR therefor is adjusted to increase. On the other hand, the gain of the HRIR for the speakers Left Surround and Right Surround positioned on the rear side are adjusted to decrease because the distance thereto is relatively increased. The HRIR pairs having an adjusted gain are input to the synthesizer 206 (Synthesizing) and synthesized with the RIRs output from the RIR selecting and adjustment unit 205 to output BRIR pairs. In the synthesizing operation of the synthesizer 206, only the HRIR pair and the RIR corresponding to the same speaker position are used. For example, in a 5.1-channel speaker format environment, $RIR_1$ is applied only to $HRIR_{1_L}$ and $HRIR_{1_R}$, and $RIR_5$ is applied only to $HRIR_{5_L}$, and $HRIR_{5_R}$. A binaural renderer 203 (binaural rendering) filters the decoded audio signal to the BRIRs output from the synthesizer 206 to output binaural rendered 2-channel audio output signals $Out_L$ and $Out_R$.

Compared to the example of FIG. 20, the example of FIG. 21 integrates the RIR decoder 204 (RIR decoding) and the RIR selection and adjustment unit 205 (RIR selection & adjustment) into an RIR selection and decoding unit 210 (RIR selection & decoding). The RIR selection and decoding unit 210 may decode only RIRs necessary for binaural rendering by referring to the speaker format information (Spk. Format info) configured in the decoding operation in the RIR decoding in advance.

Figure 22:
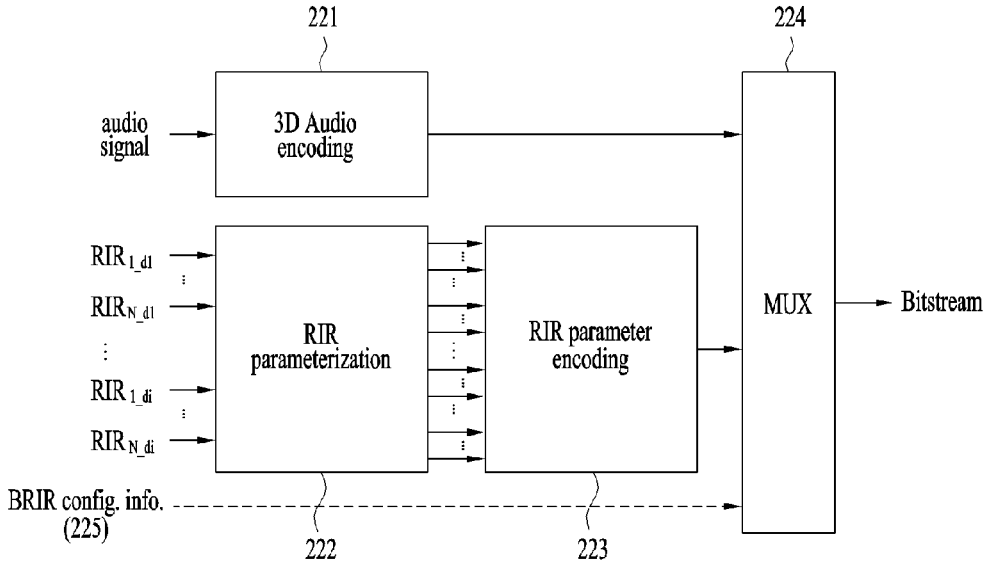
FIG. 22 illustrates an RIR encoding operation in a 6DoF environment according to an eighth example of the present disclosure.
Figure 23:
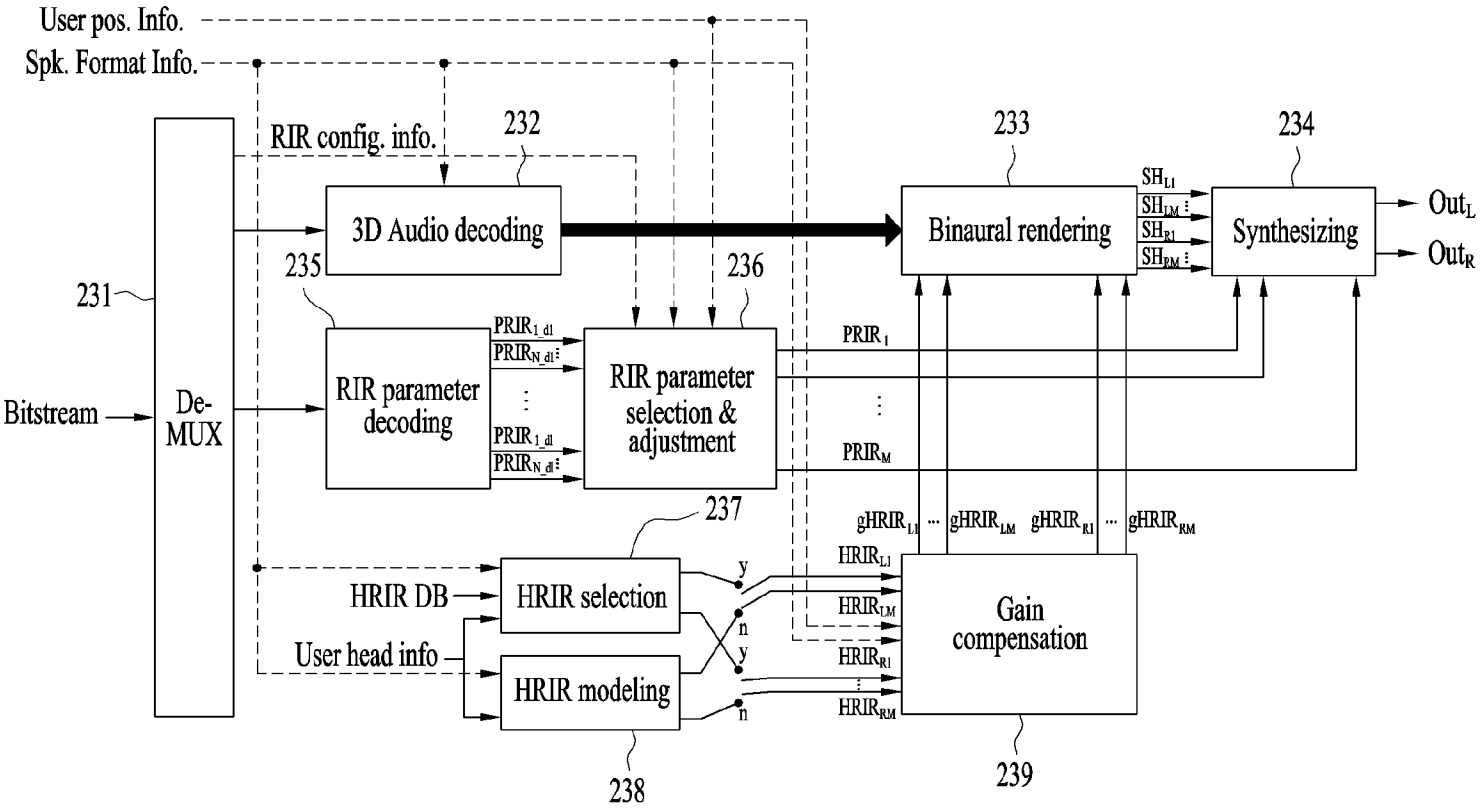
FIGS. 23 and 24 illustrate an RIR decoding operation in a 6DoF environment according to the eighth example of the present disclosure.
Figure 24:
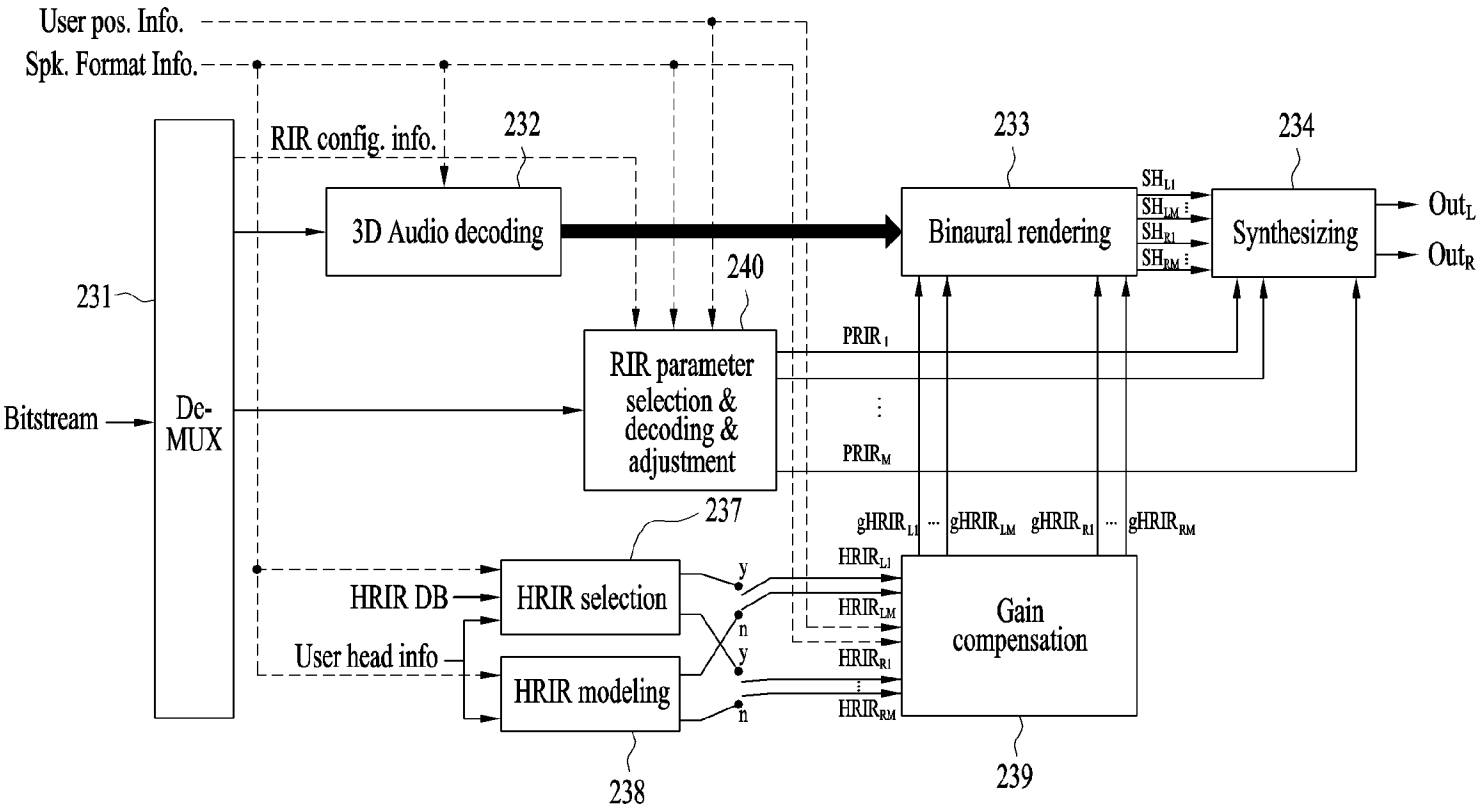

FIG. 22 illustrates an RIR encoding operation in a 6DoF environment according to an eighth example of the present disclosure. FIGS. 23 and 24 illustrate an RIR decoding operation in a 6DoF environment according to the eighth example of the present disclosure.

FIG. 22 illustrates the example of FIG. 11 for 3DoF environment in consideration of the 6DoF environment. In FIG. 22, an RIR parameter generator 222 (RIR parameterization) extracts parameters from the information of all input RRIs, and the extracted parameters are encoded by an RIR parameter encoder 223 (RIR parameter encoding). The operation of the RIR parameter encoder 223 may be substantially the same as that of the RIR parameter encoder 113 of FIG. 11 except for data amount.

Referring to FIG. 22, parameters are extracted from the information of all input RRIs by the RIR parameter generator 222 and encoded by the RIR parameter encoder 223. The encoded RIR parameter data is input to a multiplexer 224 (MUX) together with the audio data and the RIR configuration information 225 encoded by the 3D audio encoder 221 (3D Audio encoding), and then packed into a bitstream.

FIG. 23 illustrates the overall decoding operation according to the eighth example of the present disclosure. Operations leading up to selecting and outputting RIRs are the same as those of the above-described example of FIG. 20. In FIG. 23, however, since RIR parameters are transmitted, RIR parameters are output instead of RIRs. In addition, similarity of the range of a space in which the user is allowed to move is checked with reference to the playback environment information (space size information and movement range information) about the user received from the outside and the RIR configuration information. When necessary, the response characteristics of the measured RIRs are changed using the method described above. In addition, since RIR parameters are received, only the most important parameters are changed. In general, when the user approaches a sound image, the "propagation delay" of the RIR is reduced, and the energy of the "direct part" of the RIR is increased. Therefore, in this example, when RIR parameters are extracted in the time domain, the information of the "propagation delay" and "direct filter block parameter" is changed among the extracted parameters. When parameters are extracted in the frequency domain, the information of the "propagation time" and "VOFF coefficient parameter" is changed. In the case where the playback environment information about the user is larger than the measured environment (when the movement range of the user is wider than the range in which RIRs are measured), the "propagation time" of an RIR needs to be increased, and therefore the value of the parameter "propagation delay" (TD) of "propagation time" (FD) is adjusted in proportion to the extended distance. In general, the signal of the "direct part" refers to an impulse that appears after the "propagation delay" and usually has the greatest value in the RIR. Accordingly, in the present disclosure, the greatest value among the "direct filter block" (TD) and the VOFF coefficients extracted from the respective frequency bands is considered as the "direct part" component. The gain value may be adjusted by applying the amount of change in distance of the D/R ratio of Equation 2 described above, considering the value extracted from the parameter as a gain of the "direct part" of the RIR.

For the HRIR data, the same procedure as the HRIR generation procedure described with reference to FIG. 20 is used. That is, when HRIRs are generated with reference to the format information about the speaker after selecting one of the two HRIR generation modules 237 and 238, the HRIRs are input to the gain compensator 239 (gain compensation) and the gain of the HRIRs is adjusted with reference to the distances between the user and the speakers. The gain-adjusted HRIRs are input to a binaural renderer 233 (Binaural rendering) and applied to a decoded audio signal to output a binaural rendered signal. When a 5.1 channel environment is assumed, five pairs of binaural rendered signals $SH_{1_L}$, $SH_{1_R}$, . . . , $SH_{5_L}$, and $SH_{5_R}$ are output. As mentioned above regarding FIG. 10, a signal to which only HRIRs are filtered does not reflect spatial feature information, and may thus provide a poor sense of realism. Accordingly, the synthesizer 234 may apply the RIR parameters (e.g., $PRIR_1$, $PRIR_2$, . . . , and $PRIR_5$ in the case of 5.1 channels) output from the RIR parameter selection and adjustment unit 236 (RIR parameter selection & adjustment) to the binaural rendered signal to output signals given a sense of realism. In the synthesis operation in the synthesizer 234, the RIR parameters should be applied to the binaural rendered signals according to the speaker position. For example, when a 5.1-channel environment is assumed, $PRIR_1$ is applied only to $SH_{1_L}$ and $SH_{1_R}$ to output $SHR_{1_L}$ and $SHR_{1_R}$, and $PRIR_5$ is applied only to $SH_{5_L}$ and $SH_{5_R}$ to output $SHR_{5_L}$ and $SHR_{5_R}$. Then, signals $SHR_{1_L}$, . . . , and $SHR_{5_L}$ for the left channel are added together and gain normalization is performed to output a final signal $Out_L$. Signal $SHR_{1_R}$, . . . , and $SHR_{5_R}$ for the right channel are added together and gain normalization is performed to output a final signal $Out_R$. In this regard, the synthesizing operation is the same as that of FIG. 13

Compared to the example of FIG. 23, the example of FIG. 24 integrates the RIR parameter decoder 235 (RIR parameter decoding) and an RIR parameter selection and adjustment unit 236 (RIR parameter selection& adjustment) into an RIR parameter selection and decoding unit 240 (RIR parameter selection & decoding & adjustment). The RIR parameter selection and decoding unit 240 may decode only RIR parameters necessary for the binaural rendering by referring to the speaker format information (Spk. Format info) configured in the decoding operation in RIR decoding in advance.

FIGS. 25 to 48 illustrate syntax structures used in an audio playing method and apparatus according to an example of the present disclosure. Specifically, the figures the syntax for BRIRs, BRIR parameters, RIRs or RIR parameters received by the 3D audio decoder in 3DoF and 6DoF environments. In this regard, the syntax proposed in the present disclosure is shown based on, for example, the "MPEG-H 3D Audio decoder," which is a 3D audio decoder. However, the illustrated syntax of the present disclosure is merely an example, and it is apparent that the syntax of the same concept may be applied to other 3D audio decoders in a modified form.

As described in the examples above, the concept of RIR parameters is basically very similar to that of BRIR parameters of MPEG-H 3D Audio, and thus the syntax is shown to be compatible with the BRIR parameter syntax declared in MPEG-H 3D Audio.

FIG. 25 illustrates the syntax of 'mpegh3daLocalSetupInformation( )' 251 applied to the MPEG-H 3D Audio decoder, based on an example of the present disclosure.

An is6DoFMode field 252 indicates whether to use a 6DoF mode. When the field is '0', use of the existing mode (3DoF) may be defined. When the field is '1', use of the 6DoF mode may be defined. In an up_az field, an angle value in terms of azimuth is given as the position information about the user. The given angle value is between Azimuth=−180° and Azimuth=180°. For example, the value may be calculated as user_positionAzimuth=(up_az-128)*1.5 and user_positionAzimuth=min (max (user_positionAzimuth, −180), 180). In an up_el field, an angle value in terms of elevation is given as the position information about the user. The given angle value is given between Elevation=−90° and Elevation=90°. For example, the value may be calculated as user_positionElevation=(up_el−32)*3.0 and user_positionElevation=min (max(user_positionElevation, −90), 90). In an up_dist field, a value in meters in terms of distance is given as the position information about the user. The given length value is between Radius=0.5 m and Radius=16 m. For example, the value may be calculated as user_positionRadius=pow(2.0, (up_dist/3.0))/2.0 and user_positionRadius=min (max(user_positionRadius, 0.5), 16).

A bsRenderingType field 253 defines a rendering type. For example, the field may indicate one of speaker rendering ('LoudspeakerRendering( )' 254) or binaural rendering through headphones ('BinauralRendering( )' 255).

A bsNumWIREoutputs field defines the number of WIREoutputs. For example, the number may be determined between 0 and 65535. A WireID field contains an ID for the WIRE output. A hasLocalScreenSizeInformation field is flag information defining whether local screen size information is available.

FIGS. 26 and 27 show the detailed syntax of 'BinarualRendering( )' 255. Specifically, the figures illustrate a case where the is6DoFMode field 252 have a value of '1' indicating 6DoF.

A bsNumMeasuredPositions field indicates the number of measured positions. A positionAzimuth field defines the azimuth of a measured position. It may have a value between −180° and 180° at intervals of 1°. For example, it may be defined as Azimuth=(loudspeakerAzimuth−256) and Azimuth=min (max (Azimuth, −180), 180). A positionElevation field defines the elevation angle of a measured position. It may have a value between −90° and 90° at intervals of 1°. For example, the elevation may be defined as Elevation=(loudspeakerElevation−128) and Elevation=min (max (Elevation, −90), 90). A positionDistance field defines a distance in cm to a user position (reference point) located at the center of the measured position (and the center of the loudspeakers). For example, it may have a value between 1 and 1023. A bsNumLoudspeakers field indicates the number of loudspeakers in a playback environment. A loudspeakerAzimuth field defines the azimuth of a loudspeaker. It may have a value between −180° and 180° at intervals of 1°. For example, the azimuth may be defined as Azimuth=(loudspeakerAzimuth−256) and Azimuth=min (max (Azimuth, −180), 180). A loudspeakerElevation field defines the elevation angle of the speaker. It may have a value between −90° and 90° at intervals of 1°. For example, the elevation may be defined as Elevation=(loudspeakerElevation−128) and Elevation=min (max (Elevation, −90), 90). A loudspeakerDistance field defines a distance in cm to a user position (reference point) located at the center of the loudspeaker. It may have a value between 1 and 1023. A loudspeakerCalibrationGain field defines a calibration gain of a loudspeaker in dB. That is, it may have a value between 0 and 127 corresponding to a decibel value between Gain=−32 dB and Gain=31.5 dB at intervals of 0.5 dB. For example, the gain may be defined as Gain [dB]=0.5×(loudspeakerGain 64). An externalDistanceCompensation field defines whether to apply the compensation of a loudspeaker to a decoder output signal. When the corresponding flag is 1, signaling for 'loudspeakerDistance' and 'loudspeakerCalibrationGain' is not applied to the decoder.

In addition, an is6DoFRoomData field is flag information indicating whether there is space information (room data) in a 6DoF environment. When there is room data in the 6DoF environment, a bs6DoFRoomDataFormatID field 261 indicates a representation type of 6DoF room data. For example, the room data types by the bs6DoFRoomDataFormatID field 261 are divided into 'RoomFirData6DoF( )' 262, 'FdRoomRendererParam6DoF( )' 263, and 'TdRoomRendererParam6DoF( )' 264. In this regard, the 'RoomFirData6DoF( )' 262, 'FdRoomRendererParam6DoF( )' 263, and 'TdRoomRendererParam6DoF( )' 264 will be described later in detail by separate syntax.

A bs6DoFBimauraIDataFormatID field 266 indicates a BRIR set representation type applied to the 6DoF environment. For example, the BRIR set types applied to the 6DoF environment by the bs6DoFBimauraIDataFormatID field 266 are divided into 'BinauralFirData6DoF( )' 267), 'FdBinauralRendererParam6DoF( )' 268 and 'TdBinauralRendererParam6DoF( )' 269). In this regard, the 'BinauralFirData6DoF( )' 267, 'FdBinauralRendererParam6DoF( )' 268, and 'TdBinauralRendererParam6DoF( )' 269 will be described later in detail by separate syntax.

An isRoomData field 270 is flag information indicating whether there is room data in a 3DoF environment. When there is room data in the 3DoF environment, a bsRoomDataFormatID field 271 indicates a representation type of the 3DoF room data. For example, the room data types by the bsRoomDataFormatID field 271 are divided into 'RoomFirData( )' 272, 'FdRoomRendererParam( )' 273, and 'TdRoomRendererParam( )' 274. In this regard, the 'RoomFirData( )' 272, 'FdRoomRendererParam( )' 273 and 'TdRoomRendererParam( )' 274 will be described later in detail by separate syntax.

A bsBinauraIDataFormatID field 276 indicates a representation type of a BRIR set in a 3DoF environment. For example, the BRIR set types applicable to the 3DoF environment by the bsBimauraIDataFormatID field 276 are divided into 'BinauralFirData( )', 'FdBinauralRendererParam( )', and 'TdBinauralRendererParam( )'. Since detailed syntaxes of 'BinauralFirData( )', 'FdBinauralRendererParam( )' and 'TdBinauralRendererParam( )' related to the BRIR set in the 3DoF environment are defined in the existing MPEG-H 3D Audio standard syntax, detailed description thereof will be omitted.

FIG. 28 shows detailed syntax of 'RoomFirData6DoF( )' 262. A bsNumRirCoefs_6DoF field defines the number of FIR filter coefficients of a 6DoF RIR. In addition, a bsFirCoefRoom_6DoF field defines FIR filter coefficients of the 6DoF RIR.

FIG. 29 shows detailed syntax of 'FdRoomRendererParam6DoF( )' 263. A dInitRir_6DoF field defines the propagation time of the 6DoF RIR. A kMaxRir_6DoF field defines the maximum processing band of the 6DoF RIR. A kConvRir_6DoF field defines the number of bands used for 6DoF RIR convolution. A kAnaRir 6DoF field defines the number of analysis bands used in the 'late reverberation' analysis of the 6DoF RIR. The syntax of 'FdRoomRendererParam6DoF( )' 263 includes syntaxes of 'VoFFRirParam6DoF( )' 2631, 'SfrRirParam6DoF( )' 2632 and 'QtdlRirParam6DoF( )' 2633 as RIR parameters.

FIG. 30 shows detailed syntax of the 'VoFFRirParam6DoF( )' 2661. An nBitNFilterRir_6DoF field defines the number of bits of nFilter used for VOFF analysis in a 6DoF RIR transformed into the frequency domain. An nBitNFftRir_6DoF field defines the number of bits of nFft used for VOFF analysis in the 6DoF RIR transformed into the frequency domain. An nBitNBlkRir_6DoF field defines the number of bits of n_block used for VOFF analysis in the 6DoF RIR transformed into the frequency domain. An nFilterRir_6DoF field defines a band-specific filter length for VOFF in the 6DoF RIR transformed into the frequency domain. An nFftRir_6DoF field defines the length of FFT for each band in performing VOFF analysis in the 6DoF RIR transformed into the frequency domain, which is represented by a power of 2. Here, nFftRir_6DoF[k] denotes an exponent. For example, $2^{nFftRir_6DF[k]}$ represents the length of band-specific FFT for VOFF. An nBlkRir_6DoF field defines the number of band-specific blocks for VOFF in the 6DoF RIR transformed into the frequency domain. A VoffCoeffRirReal_6DoF field defines the real value of a VOFF coefficient of the 6DoF RIR transformed into the frequency domain. A VoffCoeffRirImag_6DoF field defines the imaginary value of the VOFF coefficient of the 6DoF RIR transformed into the frequency domain.

FIG. 31 shows detailed syntax of 'SfrRirParam6DoF( )' 2632.

An fcAnaRir_6DoF field defines the center frequency of a late reverberation analysis band of the 6DoF RIR transformed into the frequency domain. An rt60Rir_6DoF field defines the reverberation time RT60 (in seconds) of the late reverberation analysis band of the 6DoF RIR transformed into the frequency domain. An nrgLrRir_6DoF field defines an energy value (a power of 2) representing the energy of the late reverberation portion in the late reverberation analysis band of the 6DoF RIR transformed into the frequency domain.

FIG. 32 shows detailed syntax of 'QtdlRirParam6DoF( )' 2633.

An nBitQtdlLagRir_6DoF field defines the number of bits of lag used in the QTDL band of a 6DoF RIR transformed into the frequency domain. A QtdlGainRirReal_6DoF field defines the real value of a QTDL gain in the QTDL band of the 6DoF RIR transformed into the frequency domain. A QtdlGainRirImag_6DoF field defines the imaginary value of the QTDL gain in the QTDL band of the 6DoF RIR transformed into the frequency domain. A QtdlLagRir_6DoF field defines a lag value (in units of sample) of QTDL in the QTDL band of the 6DoF RIR transformed into the frequency domain.

FIG. 33 shows detailed syntax of 'TdRoomRendererParam( )' 264 described above.

A bsDelayRir_6DoF field defines the delay of a sample to be applied to the starting portion of an output signal. For example, it is used to compensate for a propagation delay of an RIR removed in the parameterization operation. A bsDirectLenRir_6DoF field defines the sample size of the direct part of the parameterized 6DoF RIR. A bsNbDiffuseBlocksRir_6DoF field defines the number of blocks in the diffuse part of the parameterized 6DoF RIR. A bsFmaxDirectRir_6DoF field defines the cutoff frequency of the direct part of the 6DoF RIR given as a value between '0' and '1'. '1' represents the Nyquist frequency. A bsFmaxDiffuseRir_6DoF field defines the cutoff frequency of the diffuse part of the 6DoF RIR given as a value between 0 and 1. '1' represents the Nyquist frequency. A bsWeightsRir_6DoF field defines a gain value applied to an input channel signal before filtering of the diffuse part of the 6DoF RIR. A bsFIRDirectRir_6DoF field defines the FIR coefficient of the direct part of the parameterized 6DoF RIR. A bsFIRDiffuseRir_6DoF field defines the FIR coefficient of the diffuse part of the parameterized 6DoF RIR.

FIG. 34 shows detailed syntax of 'BinauralFirData6DoF( )' 267 described above. A bsNumCoefs_6DoF field defines the number of FIR filter coefficients of the 6DoF BRIR. A bsFirCoefLeft_6DoF field defines the left FIR filter coefficient of the 6DoF BRIR. A bsFirCoefRight_6DoF field defines the right FIR filter coefficient of the 6DoF BRIR.

FIG. 35 shows detailed syntax of 'FdBinauralRendererParam6DoF( )' 268 described above. A dInit_6DoF field defines the propagation time value of a 6DoF BRIR. A kMax_6DoF field defines the maximum processing band of the 6DoF BRIR. A kConv_6DoF field defines the number of bands used for 6DoF BRIR convolution. A kAna)6DoF field defines the number of analysis bands used for late reverberation analysis of the 6DoF BRIR. The syntax of 'FdBinauralRendererParam6DoF( )' 268 includes syntaxes of 'VoFFBrirParam6DoF( )' 2681, 'SfrBrirParam6DoF( )' 2682 and 'QtdlBrirParam6DoF( )' 2683 as RIR parameters.

FIG. 36 shows detailed syntax of the 'VoffBrirParam6DoF( )' 2701. An nBitNFilter_6DoF field defines the number of bits of nFilter used for VOFF analysis in a 6DoF BRIR transformed into the frequency domain. An nBitNFft_6DoF field defines the number of bits of nFft used for VOFF analysis in the 6DoF BRIR transformed into the frequency domain. An nBitNBlk_6DoF field defines the number of bits of n_block used for VOFF analysis in the 6DoF BRIR transformed into the frequency domain. An nFilter_6DoF field defines the band-specific filter length for VOFF in the 6DoF BRIR transformed into the frequency domain. An nFft_6DoF field defines the length of FFT for each band in performing VOFF analysis in the 6DoF BRIR transformed into the frequency domain, which is represented by a power of 2. Here, nFft_6DoF[k] denotes an exponent. For example, $2^{nFft_6DoF[k]}$ represents the length of band-specific FFT for VOFF. An nBlk_6DoF field defines the number of band-specific blocks for VOFF in the 6DoF BRIRs transformed into the frequency domain. A VoffCoeffLeftReal_6DoF field indicates the real value of a VOFF coefficient of a left 6DoF BRIR transformed into the frequency domain. A VoffCoeffLeftImag_6DoF field defines the imaginary value of the VOFF coefficient of the left 6DoF BRIR transformed into the frequency domain. A VoffCoeffRightReal_6DoF field defines the real value of the VOFF coefficient of a right 6DoF BRIR transformed into the frequency domain. A VoffCoeffRightImag_6DoF field defines the imaginary value of the VOFF coefficient of the right 6DoF BRIR transformed into the frequency domain.

FIG. 37 shows detailed syntax of 'SfrBrirParam6DoF( )' 2268. An fcAna_6DoF field defines the center frequency of the late reverberation analysis band of a 6DoF BRIR transformed into the frequency domain. An rt60_6DoF field defines the reverberation time RT60 (in seconds) of the late reverberation analysis band of the 6DoF BRIR transformed into the frequency domain. An nrgLr_6DoF field defines an energy value (a power of 2) representing the energy of the late reverberation portion in the late reverberation analysis band of the 6DoF BRIR transformed into the frequency domain.

FIG. 38 shows detailed syntax of 'QtdlBrirParam6DoF( )' 2683. An nBitQtdlLag_6DoF field defines the number of bits of lag used in the QTDL band of a 6DoF BRIR transformed into the frequency domain. A QtdlGainLeftReal_6DoF field defines the real value of a QTDL gain in the QTDL band of a left 6DoF BRIR transformed into the frequency domain. A QtdlGainLeftImag_6DoF field defines the imaginary value of the QTDL gain in the QTDL band of the left 6DoF BRIR transformed into the frequency domain. A QtdlGainRightReal_6DoF field defines the real value of a QTDL gain in the QTDL band of a right 6DoF BRIR transformed into the frequency domain. A QtdlGainRightImag)6DoF field defines the imaginary value of the QTDL gain in the QTDL band of the right 6DoF BRIR transformed into the frequency domain. A QtdlLagLeft_6DoF field defines a lag value (in units of sample) of QTDL in the QTDL band of the left 6DoF BRIR transformed into the frequency domain. A QtdlLagRight_6DoF field defines a lag value (in units of sample) of the QTDL in the QTDL band of the right 6DoF BRIR transformed into the frequency domain.

FIG. 39 shows detailed syntax 'TdBinauralRendererParam6DoF( )' 269 described above. A bsDelay_6DoF field defines the delay of a sample (used to compensate for a propagation delay of a BRIR removed in the parameterization operation) to be applied to the starting portion of an output signal. A bsDirectLen_6DoF field defines the sample size of the direct part of the parameterized 6DoF BRIR. A bsNbDiffuseBlocks_6DoF field defines the number of blocks of the diffuse part of the parameterized 6DoF BRIR. A bsFmaxDirectLeft_6DoF field defines the cutoff frequency of the direct part of the left 6DoF BRIR given as a value between '0' and '1'. For example, '1' represents the Nyquist frequency. A bsFmaxDirectRight_6DoF field defines the cutoff frequency of the direct part of the right 6DoF BRIR given as a value between '0' and '1'. For example, '1' represents the Nyquist frequency. A bsFmaxDiffuseLeft_6DoF field defines the cutoff frequency of the diffuse part of the left 6DoF BRIR given as a value between '0' and '1'. For example, '1' represents the Nyquist frequency. A bsFmaxDiffuseRight_6DoF field defines the cutoff frequency of the diffuse part of the right 6DoF BRIR given as a value between '0' and '1'. For example, '1' represents the Nyquist frequency. A bsWeights_6DoF field defines a gain value applied to an input channel signal before filtering of the diffuse part of the 6DoF BRIR. A bsFIRDirectLeft_6DoF field defines the FIR coefficient of the direct part of the parameterized left 6DoF BRIR. A bsFIRDirectRight_6DoF field defines the FIR coefficient of the direct part of the parameterized right 6DoF BRIR. A bsFIRDiffuseLeft_6DoF field defines the FIR coefficient of the diffuse part of the parameterized left 6DoF BRIR. A bsFIRDiffuseRight_6DoF field defines the FIR coefficient of the diffuse part of the parameterized right 6DoF BRIR.

FIG. 40 shows detailed syntax of the 'RoomFirData( )' 272 described above. A bsNumRirCoefs field defines the number of FIR filter coefficients of the RIR. A bsFirCoefRir field defines the FIR filter coefficient of the RIR.

FIG. 41 shows detailed syntax of the 'FdRoomRendererParam( )' 273 described above. A dInitRir field defines the propagation time value of an RIR. A kMaxRir field defines the maximum processing band of the RIR. A kConvRir field defines the number of bands used for RIR convolution. A kAnaRir field defines the number of analysis bands used for late reverberation analysis of the RIR. The syntax of 'FdRoomRendererParam( )' 273 includes syntaxes of 'VoffRirParam( )' 2731, 'SfrBrirParam( )' 2732, and 'QtdlBrirParam( )' 2733.

FIG. 42 shows detailed syntax of the 'VoffRirParam( )' 2731. An nBitNFilterRir field defines the number of bits of nFilter used for VOFF analysis in an RIR transformed into the frequency domain. An nBitNFftRir field defines the number of bits of nFft used for VOFF analysis in the RIR transformed into the frequency domain. An nBitNBlkRir field defines the number of bits of n_block used for VOFF analysis in the RIR transformed into the frequency domain. An nFilterRir field defines a band-specific filter length for VOFF in the RIR transformed into the frequency domain. An nFftRir field defines the length of FFT for each band in performing VOFF analysis in the RIR transformed into the frequency domain, which is represented by a power of 2. Here, nFftRir[k] denotes an exponent. For example, $2^{nFftRir[k]}$ represents the length of band-specific FFT for VOFF. An nBlkRir field defines the number of band-specific blocks for VOFF in the RIR transformed into the frequency domain. A VoffCoeffRirReal field defines the real value of the VOFF coefficient of the RIR transformed into the frequency domain. A VoffCoeffRirImag field defines the imaginary value of the VOFF coefficient of the RIR transformed into the frequency domain.

FIG. 43 shows detailed syntax of 'SfrBrirParam( )' 2732. An fcAnaRir field defines the center frequency of the late reverberation analysis band of an RIR transformed into the frequency domain. An rt60Rir field defines the reverberation time RT60 (in seconds) of the late reverberation analysis band of the RIR transformed into the frequency domain. An nrgLrRir field defines an energy value (a power of 2) representing the energy of the late reverberation portion in the late reverberation analysis band of the RIR transformed into the frequency domain.

FIG. 44 shows detailed syntax of 'QtdlBrirParam( )' 2733. An nBitQtdlLagRir field defines the number of bits of lag used in the QTDL band of an RIR transformed into the frequency domain. A QtdlGainRirReal field defines the real value of a QTDL gain in the QTDL band of the RIR transformed into the frequency domain. A QtdlGainRirImag field defines the imaginary value of the QTDL gain in the QTDL band of the RIR transformed into the frequency domain. A QtdlLagRir field defines a lag value (in units of sample) of QTDL in the QTDL band of the RIR transformed into the frequency domain.

FIG. 45 shows detailed syntax of the 'TdRoomRendererParam( )' 274 described above. A bsDelayRir field defines the delay of a sample (used to compensate for a propagation delay of an RIR removed in the parameterization operation) to be applied to the starting portion of an output signal. A bsDirectLenRir field defines the sample size of the direct part of the parameterized RIR. A bsNbDiffuseBlocksRir field defines the number of blocks in the diffuse part of the parameterized RIR. A bsFmaxDirectRir field defines the cutoff frequency of the direct part of an RIR given as a value between '0' and '1'. For example, '1' represents the Nyquist frequency. A bsFmaxDiffuseRir field defines the cutoff frequency of the diffuse part of the RIR given as a value between '0' and '1'. For example, '1' represents the Nyquist frequency. A bsWeightsRir field defines a gain value applied to an input channel signal before filtering of the diffuse part of the RIR. A bsFIRDirectRir field defines the FIR coefficient of the direct part of the parameterized RIR. A bsFIRDiffuseRir field defines the FIR coefficient of the diffuse part of the parameterized RIR.

FIG. 46 shows detailed syntax of 'HRIRGeneration( )' 275 described above. A bsHRIRDataFormatID field indicates a representation type of an HRIR. The representation type of the HRIR includes 'HRIRFIRData( )' 2751 and 'HRIRModeling( )' 2752.

FIG. 47 shows detailed syntax of 'HRIRFIRData( )' 2751. A bsNumHRIRCoefs field indicates the length of an HRIR filter. A bsFirHRIRCoefLeft field indicates the coefficient value of an HRIR filter for the left ear. A bsFirHRIRCoefRight field indicates the coefficient value of an HRIR filter for the right ear.

Figures 48, 49:
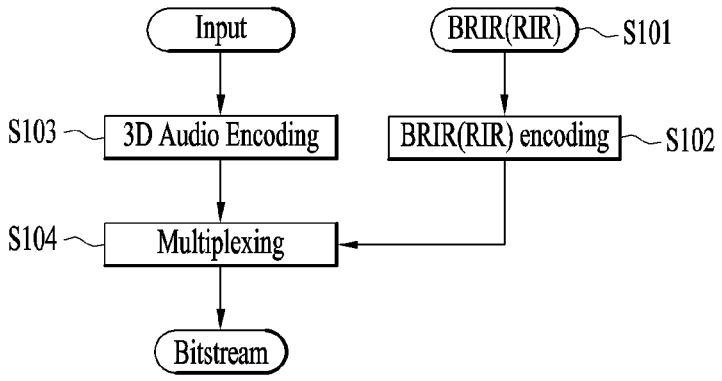

FIG. 48 shows detailed syntax of 'HRIRModeling( )' 2752. A HeadRadius field indicates a head radius, which is represented in cm. A PinnaModelIdx field represents an index of a table in which coefficients used in modeling a Pinna model are defined.

Figure 50:
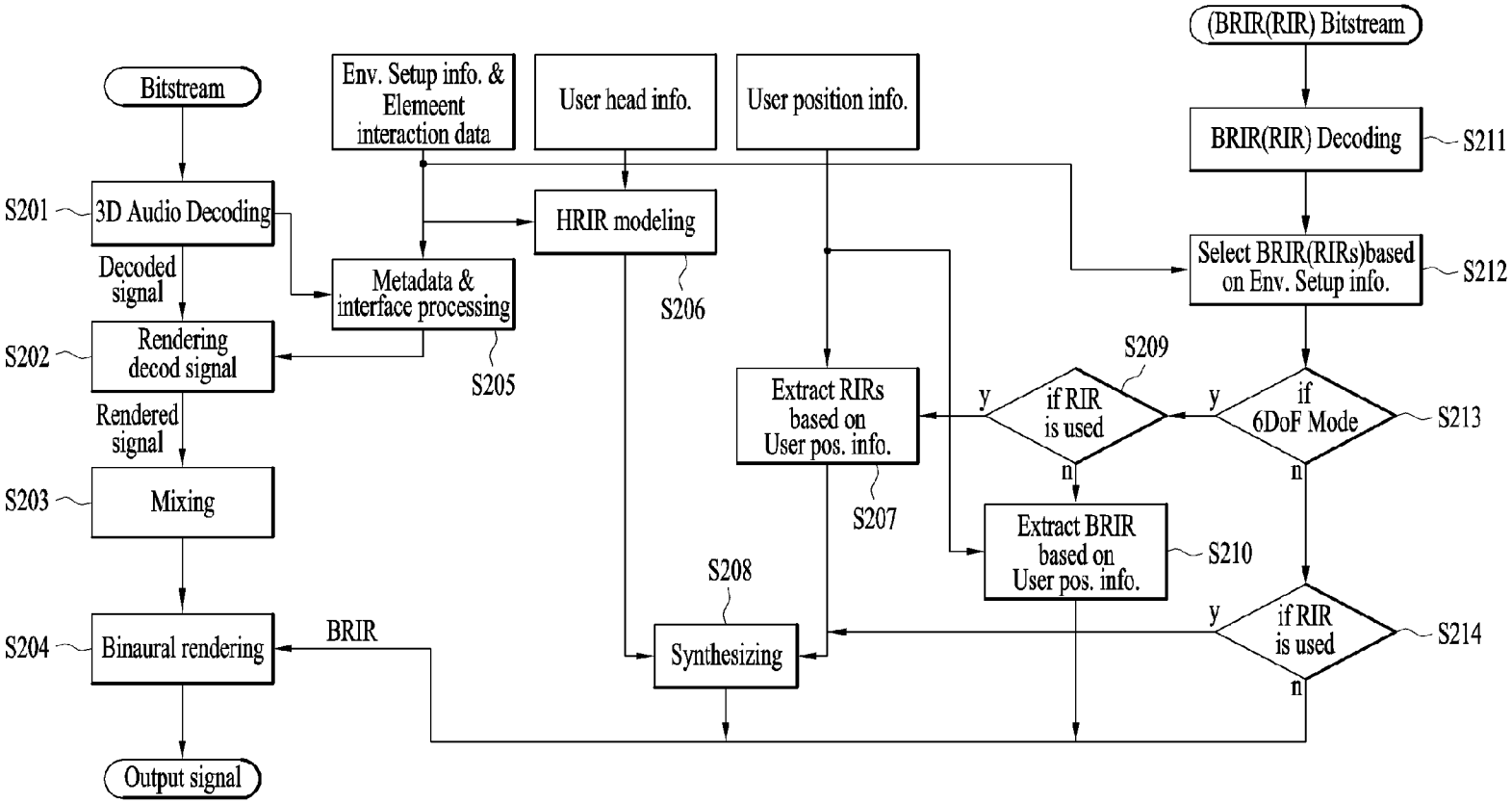
FIG. 50 is a flowchart of an audio decoding method corresponding to FIG. 49 according to the present disclosure.

FIG. 49 shows a flowchart of an audio encoding method according to the present disclosure. FIG. 50 is a flowchart of an audio decoding method corresponding to FIG. 49 according to the present disclosure. In this regard, the flowcharts of FIGS. 49 and 50 of the present disclosure illustrate, among the foregoing examples, examples of performing encoding and decoding without a BRIR (or RIR) parameterization operation.

Operation S101 is an operation of generating a measured or modeled BRIR (or RIR).

Operation S102 is an operation of generating BRIR (or RIR) data by inputting the measured or modeled BRIR (or RIR) from operation S101 to a BRIR (or RIR) encoder.

Operation S103 is an operation of inputting an input signal to a 3D audio encoder and generating an encoded audio signal.

Operation S104 is an operation of generating a bitstream by multiplexing the BRIR (or RIR) data and the encoded audio signal generated in operations S102 and S103, respectively.

The bitstream is received and decoded through the following operations.

Operation S201 is an operation of inputting the received bitstream to a 3D audio decoder and outputting a decoded audio signal and object metadata.

Operation S205 an operation of receiving, by a metadata processor (metadata and interface data processing), environment setup information and user position information along with the object metadata input, generating and configuring playback environment information, and modifying, when necessary, the object metadata with reference to element interaction information.

Operation S202 is an operation of performing, by a renderer, rendering in response to the input decoded audio signal and playback environment information. Specifically, the object signal of the decoded audio signals is rendered by applying the object metadata.

Operation S203 is an operation of adding two types of signals by a renderer or a mixer when the rendered signals are of two or more types. The mixing operation in operation S203 is also used in additionally applying a delay or a gain to the rendered signal.

Operation S211 is an operation of inputting a BRIR (or RIR) bitstream to a BRIR (or RIR) decoder and outputting decoded BRIR (or RIR) data.

Operation S212 is an operation of selecting a BRIR (or RIR) suitable for a playback environment with reference to environment setup information.

Operation S213 is an operation of checking, in syntax of the input bitstream, whether a 6DoF mode is supported.

Operation S209 is an operation of checking whether RIR data is used when the 6DoF mode is operated.

Operation S207 is an operation of extracting, when it is determined, through operations S213 and S209, that the 6DoF mode is operated and the RIR is used (path 'y' in S209), an RIR measured at a position closest to a user position with reference to the user position information.

Operation S206 is an operation of performing HRIR modeling based on user head information and the environment setup information and outputting HRIR data as a result.

Operation S208 is an operation of generating a BRIR by synthesizing the modeled HRIR data and the RIR data extracted in operation S207.

Operation S210 is an operation of extracting, when it is determined, through operations S213 and S209, that the 6DoF mode is operated and the RIR is not used (path 'n' in S209), a BRIR measured at a position closest to the user position with reference to the user position information.

Operation S214 is an operation of delivering, when it is determined, through operation S213, that the 6DoF mode is not operated and the RIR is used (path 'y' in S214), the RIR to the operation S208 (of synthesizing). The RIR delivered to operation S208 and the HRIR generated through operation S206 described above are used to synthesize a BRIR. However, when it is determined through operation S213 that the 6DoF mode is operated and the BRIR is used (path 'n' in S214), the decoded BRIR is delivered to operation S204. Accordingly, after decoding of the BRIR (or RIR) bitstream in operation S211, the final BRIR is obtained through one of operations S208, S210, and S214 described above.

Operation S204 is an operation of filtering the obtained BRIR to the output signal of operation S203 to output a binaural rendered audio output signal.

Figure 51:
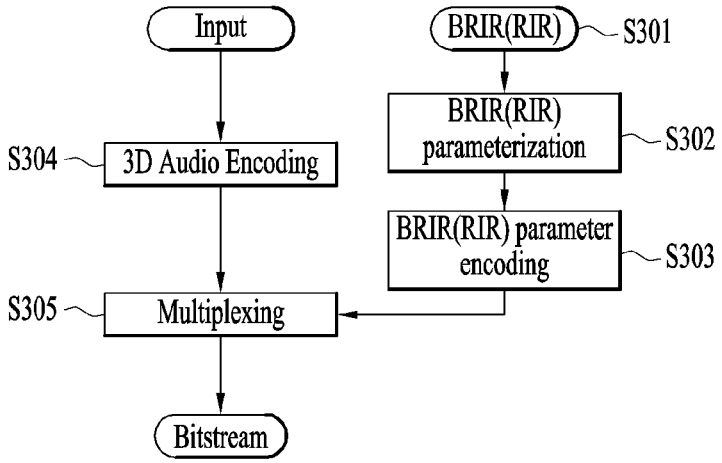
FIG. 51 is another flowchart of an audio encoding method according to the present disclosure.
Figure 52:
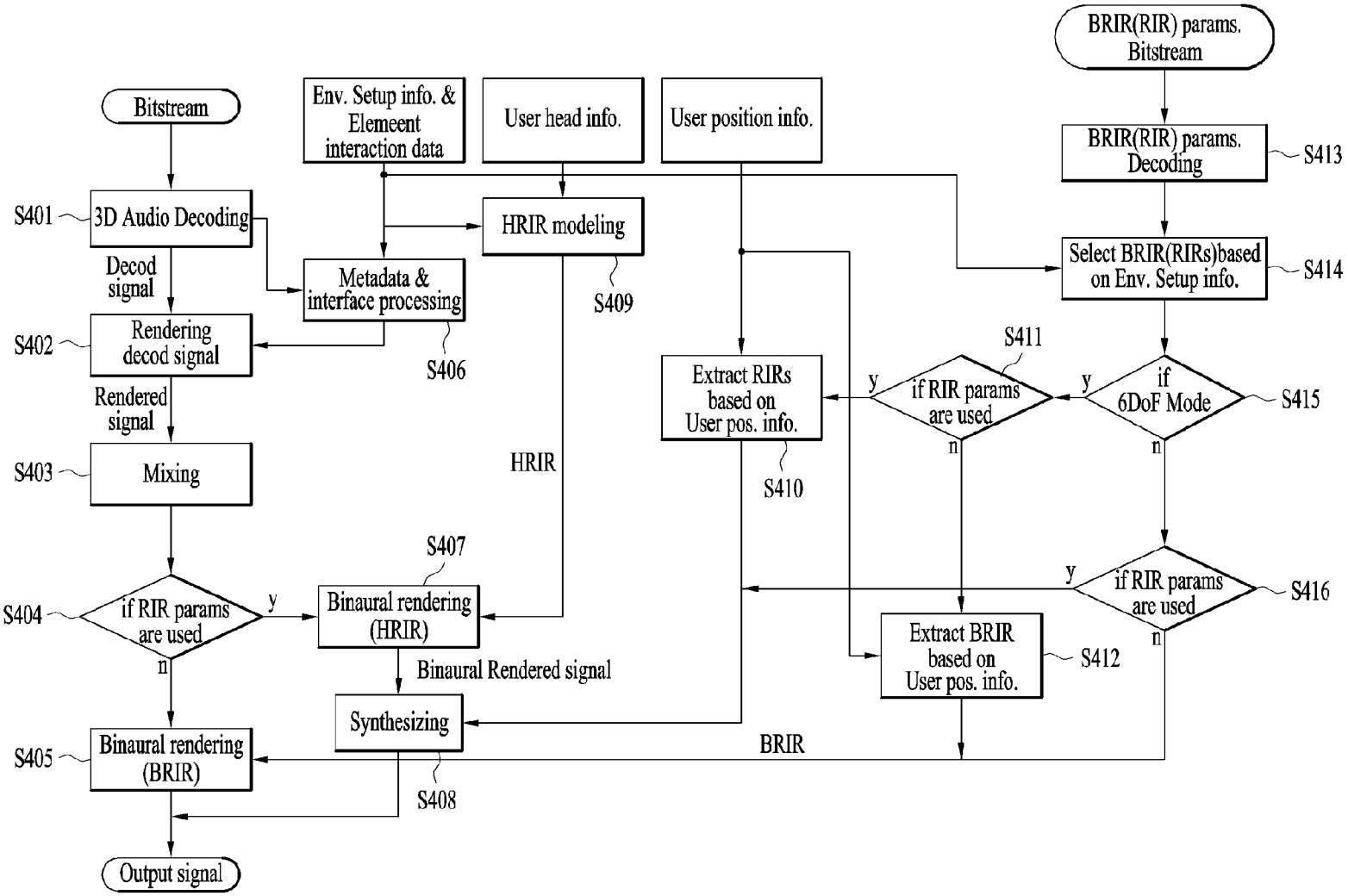
FIG. 52 is another flowchart of an audio decoding method corresponding to FIG. 51 according to the present disclosure.

FIG. 51 is another flowchart of an audio encoding method according to the present disclosure. FIG. 52 is another flowchart of an audio decoding method corresponding to FIG. 51 according to the present disclosure. In this regard, the flowcharts of FIGS. 51 and 52 of the present disclosure describe, among the foregoing examples, examples of performing encoding and decoding, including a BRIR (or RIR) parameterization operation.

Operation S301 is an operation of generating a measured or modeled BRIR (or RIR).

Operation S302 is an operation of inputting the measured or modeled BRIR (or RIR) to a BRIR (or RIR) parameterizer (parameterization) and extracting BRIR (or RIR) parameters.

Operation S303 is an operation of encoding the BRIR (or RIR) parameters extracted in operation S302 and generating encoded BRIR (or RIR) parameter data.

Operation S304 is an operation of inputting an input signal to the 3D audio encoder and generating an encoded audio signal.

Operation S305 is an operation of multiplexing the BRIR (or RIR) parameter data and the encoded audio signal generated in operations S303 and S304, respectively, and generating a bitstream.

The bitstream is received and decoded through the following operations.

Operation S401 is an operation of inputting the received bitstream to the 3D audio decoder and outputting a decoded audio signal and object metadata.

Operation S406 an operation of receiving, by a metadata processor (metadata and interface data processing), environment setup information and user position information along with the object metadata input, generating and configuring playback environment information, and modifying, when necessary, the object metadata with reference to element interaction information.

Operation S402 is an operation of performing, by a renderer, rendering in response to the input decoded audio signal and playback environment information. Specifically, the object signal of the decoded audio signals is rendered by applying the object metadata.

Operation S403 is an operation of adding two types of signal by a renderer or a mixer when the rendered signals are of two or more types of signal. The mixing operation in operation S403 is also used in additionally applying a delay or a gain to the rendered signal.

Operation S413 is an operation of inputting a BRIR (or RIR) bitstream to a BRIR (or RIR) parameter decoder and outputting decoded BRIR (or RIR) parameter data.

Operation S414 is an operation of selecting a BRIR (or RIR) suitable for a playback environment with reference to environment setup information.

Operation S415 is an operation of checking, in syntax of the input bitstream, whether a 6DoF mode is supported.

Operation S411 is an operation of checking whether RIR parameter data is used when the 6DoF mode is operated.

Operation S410 an operation of extracting, when it is determined, through operations S415 and S411, that the 6DoF mode is operated and the RIR is used (path 'y' in S411) an RIR measured at a position closest to a user position with reference to the user position information.

Operation S409 is an operation of performing HRIR modeling based on user head information and the environment setup information and outputting HRIR data as a result.

Operation S412 is an operation of extracting, when it is determined, through operations S415 and S411, that the 6DoF mode is operated and the RIR is not used (path 'n' in S411), a BRIR measured at a position closest to the user position with reference to the user position information.

Operation S416 is an operation of checking, when it is determined through operation S415 that the 6DoF mode is not operated (path 'n' of S415), whether an RIR parameter is used.

When it is determined through operation S416 that the RIR parameter is used (path 'y' of S416), the HRIR data generated in the operation S409 and the decoded RIR parameter are utilized. However, When it is determined through operation S416 that a BRIR parameter is used (path 'n' of S416), the decoded BRIR parameter is used. Accordingly, after decoding of the bitstream including the BRIR (or RIR) parameter data, the final BRIR parameter or RIR parameter and the HRIR data are obtained through operations S49, S410, S412, and S416 described above.

Operation S404 is an operation of checking whether to use the RIR parameter after operation S403 (of mixing).

Operation S407 is an operation of performing, when it is it determined in S404 that the RIR parameter is used (path 'y' in S404), HRIR binaural rendering on the HRIR data generated through operation S409 described above and outputting a rendered signal.

Operation S408 is an operation of synthesizing the signal rendered in operation S407 with the RIR parameter extracted in operation S410 and outputting a final binaural rendered audio signal (output signal).

Operation S405 is an operation of outputting, when it is it determined in operation S404 that the RIR parameter is not used, namely, the BRIR parameter is used (path 'n' in S404), a final binaural rendered audio signal (output signal) based on the BRIR parameter generated in operation S412 or S416.

[Mode]

Various audio playing apparatuses and methods for playing three-dimensional audio in a 3DoF environment and/or a 6DoF environment are proposed in the foregoing examples of the present disclosure. The present disclosure may also be implemented through the following audio playback procedure.

An audio signal and RIR data are separately extracted from an input bitstream by a de-multiplexer. The 3D audio decoder decodes the audio data and outputs object metadata of the decoded audio signal. The object metadata is input to the metadata processor and modified by the playback environment information and the element interaction information. Subsequently, the object metadata is used to output channel signals $ch_1, ch_2, \ldots, ch_N$ suitable for the playback environment set through the rendering and mixing operation along with the decoded audio signal. The RIR data extracted by the de-multiplexer is input to an RIR decoding and selection unit, and necessary RIRs are decoded with reference to the playback environment information. When the decoder is used in a 6DoF mode, the RIR decoding and selection unit decodes only necessary RIRs by further referring to user position information. User head information, which is other information, and the playback environment information are input to HRIR modeling to model an HRIR. The modeled HRIR is synthesized with the decoded RIR data to generate a BRIR. The generated BRIR is input to a binaural renderer to output binaural rendered 2-channel audio signals (left signal and right signal). The binaural rendered 2-channel audio signals are played by left and right transducers of a headphone via a digital-to-analog (D/A) converter and an amplifier (Amp).

INDUSTRIAL APPLICABILITY

The examples of the present disclosure described above are applicable to various applications for playing three-dimensional audio. The examples of the present disclosure may be embodied as computer readable code on a medium on which a program is recorded. The computer readable medium includes all kinds of recording devices capable of storing data readable by a computer system is stored. Examples of computer-readable media include hard disk drives (HDDs), solid state disks (SSDs), silicon disk drives (SDDs), ROMs, RAMs, CD-ROMs, magnetic tapes, floppy disks, and optical information storage devices, and also include those implemented in the form of carrier waves (e.g., transmission over the Internet). The computer may include, in whole or in part, an audio decoder 11, a renderer 12, a binaural renderer 13, and a metadata and interface data processor 14. Accordingly, the above detailed description should be construed in all aspects as illustrative and not restrictive. The scope of the disclosure should be determined by the appended claims and their equivalents, and all changes within the equivalent scope of the present disclosure are intended to be embraced therein.

The invention claimed is:

1. A method for playing three-dimensional audio by an apparatus, the method comprising:

a decoding operation of decoding a received audio signal and outputting a decoded audio signal and metadata;

a room impulse response (RIR) decoding operation of decoding RIR data when the received audio signal contains the RIR data;

a head-related impulse response (HRIR) generation operation of modeling and generating HRIR data based on user head information when the received audio signal contains the RIR data;

a binaural room impulse response (BRIR) synthesis operation of synthesizing the decoded RIR data and modeled and generated HRIR data and generating BRIR data; and a binaural rendering operation of applying the generated BRIR data to the decoded audio signal and outputting a binaural rendered audio signal.

2. The method of claim 1, further comprising:

receiving speaker format information, wherein the RIR decoding operation comprises:

selecting a portion of the RIR data related to the speaker format information and decoding only the selected portion of the RIR data.

3. The method of claim 2, wherein the modeled and generated HRIR data is related to the user head information and the speaker format information.

4. The method of claim 2, wherein the HRIR generation operation comprises:

selecting and generating the HRIR data from an HRIR database (DB).

5. The method of claim 1, further comprising:

checking 6 degrees of freedom (DoF) mode indication information (is6DoFMode) contained in the received audio signal; and when 6DoF is supported, acquiring user position information and speaker format information from the information (is6DoFMode).

6. The method of claim 5, wherein the RIR decoding operation comprises:

selecting a portion of the RIR data related to the user position information and the speaker format information and decoding only the selected portion of the RIR data.

7. A method for playing three-dimensional audio by an apparatus, the method comprising:

a decoding operation of decoding a received audio signal and outputting a decoded audio signal and metadata;

a room impulse response (RIR) decoding operation of decoding an RIR parameter when the received audio signal contains the RIR parameter;

a head-related impulse response (HRIR) generation operation of generating HRIR data based on user head information when the received audio signal contains the RIR parameter;

a rendering operation of applying the generated HRIR data to the decoded audio signal and outputting a binaural rendered audio signal; and a synthesis operation of correcting the binaural rendered audio signal such as to be suitable for spatial characteristics by applying the decoded RIR parameter thereto and outputting the corrected audio signal.

8. The method of claim 7, further comprising:

checking information (isRoomData) indicating whether an RIR parameter for a 3 degrees of freedom (DoF) environment is included, the information (isRoomData) being contained in the received audio signal;

checking, based on the information (isRoomData), information (bsRoomDataFormatID) indicating an RIR parameter type provided in the 3DoF environment, and acquiring one or more of a 'RoomFirData( )' syntax, an 'FdRoomRendererParam( )' syntax, or a 'TdRoomRendererParam( )' syntax as an RIR parameter syntax related to the information (bsRoomDataFormatID).

9. The method of claim 7, further comprising:

checking information (is6DoFRoomData) indicating whether an RIR parameter for a 6 degrees of freedom (DoF) environment is included, the information (is6DoFRoomData) being contained in the received audio signal;

checking, based on the information (is6DoFRoomData), information (bs6DoFRoomDataFormatID) indicating an RIR parameter type provided in the 6DoF environment; and acquiring one or more of a 'RoomFirData6DoF( )' syntax, an 'FdRoomRendererParam6DoF( )' syntax, or a 'TdRoomRendererParam6DoF( )' syntax as an RIR parameter syntax related to the information (bs6DoFRoomDataFormatID).

10. An apparatus for playing three-dimensional audio, the apparatus comprising:

an audio decoder configured to decode a received audio signal and outputting a decoded audio signal and metadata;

a room impulse response (RIR) decoder configured to decode RIR data when the received audio signal contains the RIR data;

a head-related impulse response (HRIR) generator configured to model and generate HRIR data based on user head information when the received audio signal contains the RIR data;

a binaural room impulse response (BRIR) synthesizer configured to synthesize the decoded RIR data and modeled and generated HRIR data and generate BRIR data; and a binaural renderer configured to apply the generated BRIR data to the decoded audio signal and output a binaural rendered audio signal.

11. The apparatus of claim 10, wherein the RIR decoder is configured to:

receive speaker format information; and select a portion of the RIR data related to the speaker format information and decode only the selected portion of the RIR data.

12. The apparatus of claim 11, wherein the HRIR generator comprises an HRIR modeler configured to model and generate the HRIR data and wherein the modeled and generated HRIR data is related to the user head information and the speaker format information.

13. The apparatus of claim 11, wherein the HRIR generator comprises an HRIR selector configured to selecting and generating the HRIR data from an HRIR database (DB).

14. The apparatus of claim 10, wherein the RIR decoder is configured to:

check 6 degrees of freedom (DoF) mode indication information (is6DoFMode) contained in the received audio signal; and acquire user position information and speaker format information from the information (is6DoFMode) when 6DoF is supported.

15. The apparatus of claim 14, wherein the RIR decoder is configured to select a portion of the RIR data related to the user position information and the speaker format information and decode only the selected portion of the RIR data.

16. An apparatus for playing three-dimensional audio, the apparatus comprising:

an audio decoder configured to decode a received audio signal and outputting a decoded audio signal and metadata;

a room impulse response (RIR) decoder configured to decode an RIR parameter when the received audio signal contains the RIR parameter;

a head-related impulse response (HRIR) generator configured to generate HRIR data based on user head information when the received audio signal contains the RIR parameter;

a binaural renderer configured to apply the generated HRIR data to the decoded audio signal and output a binaural rendered audio signal, and a synthesizer configured to correct the binaural rendered audio signal such as to be suitable for spatial characteristics by applying the decoded RIR parameter thereto and output the corrected audio signal.

17. The apparatus of claim 16, wherein the RIR decoder is configured to:

check information (isRoomData) indicating whether an RIR parameter for a 3 degrees of freedom (DoF) environment is included, the information (isRoomData) being contained in the received audio signal;

check, based on the information (isRoomData), information (bsRoomDataFormatID) indicating an RIR parameter type provided in the 3DoF environment, and acquire one or more of a 'RoomFirData( )' syntax, an 'FdRoomRendererParam( )' syntax, or a 'TdRoomRendererParam( )' syntax as an RIR parameter syntax related to the information (bsRoomDataFormatID).

18. The apparatus of claim 16, wherein the RIR decoder is configured to:

check information (is6DoFRoomData) indicating whether an RIR parameter for a 6 degrees of freedom (DoF) environment is included, the information (is6DoFRoomData) being contained in the received audio signal;

check, based on the information (is6DoFRoomData), information (bs6DoFRoomDataFormatID) indicating an RIR parameter type provided in the 6DoF environment; and acquire one or more of a 'RoomFirData6DoF( )' syntax, an 'FdRoomRendererParam6DoF( )' syntax, or a 'TdRoomRendererParam6DoF( )' syntax as an RIR parameter syntax related to the information (bs6DoFRoomDataFormatID).

* * * * *